US005627563A

United States Patent [19]

Nakagiri et al.

[11] Patent Number: 5,627,563

[45] Date of Patent: May 6, 1997

[54] MULTICOLOR DISPLAY APPARATUS

[75] Inventors: Tadahiko Nakagiri; Kazuo Teramoto, both of Tokyo; Mitsuhiro Okamoto, Sayama, all of Japan

[73] Assignees: Citizen Watch Co., Ltd.; T.I.C.-Citizen Co., Ltd., both of Tokyo, Japan

[21] Appl. No.: 463,309

[22] Filed: Jun. 5, 1995

Related U.S. Application Data

[62] Division of Ser. No. 384,589, Feb. 3, 1995, which is a continuation of Ser. No. 904,575, Jun. 26, 1992, abandoned.

[30] Foreign Application Priority Data

Jun. 28, 1991 [JP] Japan ..... 3-158374

[51] Int. Cl.[6] ..... G09G 3/16

[52] U.S. Cl. ..... 345/111; 345/108; 40/449

[58] Field of Search ..... 345/108, 109, 345/110, 111; 40/447, 449, 450

[56] References Cited

U.S. PATENT DOCUMENTS

| | | | |
|---|---|---|---|
| 4,024,532 | 5/1977 | Sherwin | 345/110 |
| 4,426,799 | 1/1984 | Winrow | 40/449 |
| 4,462,177 | 7/1984 | Browne | 40/449 |
| 4,531,318 | 7/1985 | Chang et al. | 40/447 |
| 4,694,599 | 9/1987 | Hart et al. | 40/449 |
| 4,706,398 | 11/1987 | Browne et al. | 40/449 |
| 4,769,638 | 9/1988 | Woolfolk | 345/111 |
| 4,811,008 | 3/1989 | Woolfolk | 345/111 |

*Primary Examiner*—Richard Hjerpe
*Assistant Examiner*—Matthew Luu
*Attorney, Agent, or Firm*—Finnegan, Henderson, Farabow, Garrett and Dunner, L.L.P.

[57] ABSTRACT

A large multicolor display apparatus displays pictures and animations of high quality with multiple colors. The apparatus is used for advertisement and information purposes. The apparatus comprises unit blocks, which are divided into a plurality of sections. In each of the sections, there is arranged a multicolor display element having a rotary color display member. The color of each unit block is determined by the multicolor display elements disposed in the unit block. Each of the unit blocks, therefore, can display multiple colors, to improve the quality of images displayed on the apparatus. Since the multicolor display elements can be prepared in small sizes, they operate at high speed to display animations and make the apparatus thinner and lighter.

8 Claims, 54 Drawing Sheets

Fig. 5A

| | | |
|---|---|---|
| R | R | R |
| R | R | R |
| R | R | R |

Fig. 5B

| | | |
|---|---|---|
| W (170) | R (171) | R |
| R | R | R |
| R | R | R |

Fig. 5C

| | | |
|---|---|---|
| W (168) | W | W |
| W | R | R |
| R | R | R |

Fig. 5D

| | | |
|---|---|---|
| W | W (169) | R |
| W | R | R |
| W | R | R |

Fig. 5E

| | | |
|---|---|---|
| W | W (172) | W |
| W | W | R |
| W | W | R (173) |

Fig. 5F

| | | |
|---|---|---|
| W | W | W |
| W | W | W |
| W | W | W |

MULTICOLOR DISPLAY APPARATUS

This is a division of application Ser. No. 08/384,589 filed Feb. 3, 1995; which is a continuation of Ser. No. 07/904,575, filed Jun. 26, 1992, now abandoned.

BACKGROUND OF THE INVENTION

1. Field of the Invention

This invention relates to a multicolor display element and a multicolor display apparatus employing a plurality of the multicolor display elements. In particular, the invention relates to a large multicolor display apparatus such as an advertisement display apparatus or a traffic information board, that dynamically displays a large number of characters and graphics with high quality clear colors at high speed.

2. Description of the Related Art

FIG. 1 shows a large display apparatus disclosed in Japanese Examined Patent Publication Nos. 63-63910 and 63-63911. This apparatus comprises a display board BOD that has 80,000 plastic cubes RI (400×200 cubes arranged in directions X and Y, respectively). Each cube RI has a side of 5 cm and includes four planes colored in red, white, blue, and green, respectively. Each cube RI is provided with a magnetic device GI that turns the cube RI for 90 degrees at a time. This apparatus displays characters and graphics in a mosaic form.

In this apparatus, each 5-cm plastic cube RI serves as a display element, i.e., a pixel, which is turned 90 degrees at a time by the magnetic device GI to display color images one after another on a front screen with each pixel providing only four colors. The plastic cube RI is too large and heavy to turn at high speed, and therefore, the apparatus is not suitable for displaying animations.

Such a conventional display apparatus requires several seconds or even several minutes to switch a displayed image to another. In addition, the cubes RI serving as display elements make a loud noise when they are turned to change a displayed image to another. Since the dimensions of the display apparatus with the 5-cm cubes RI are about 10 m×20 m, the noise collectively creates a serious environmental problem. The display board BOD is thick and heavy and has poor resolution owing to the 5-cm cubes RI.

In an information-oriented society, large outdoor display apparatuses serve as important communication, advertisement, and information media. In this regard, the display apparatuses are required to correctly inform the public of a large amount of high quality information by displaying clear color animations at high speed. The conventional multicolor display apparatuses do not satisfy such a requirement.

SUMMARY OF THE INVENTION

An object of the invention is to provide a multicolor display element that meets the above requirement and a multicolor display apparatus employing a plurality of multicolor display elements.

Another object of the invention is to provide a large multicolor display apparatus having pixels each being able to reproduce a plurality of colors, to improve color reproducibility and the quality of the displayed images.

Still another object of the invention is to provide a compact and high-speed multicolor display element, and a large multicolor display apparatus employing a plurality of the display elements to display even animations.

Still another object of the invention is to provide a multicolor display unit or a composite multicolor display unit that correctly operates even under severe outdoor conditions, and a large display apparatus employing a plurality of multicolor display units. The multicolor display unit comprises a plurality of multicolor display elements packaged in a waterproof and dustproof casing.

In order to accomplish these objects and advantages, the invention basically provides the following technical configurations.

A multicolor display element according to one aspect of the invention comprises a rotary member having independent color regions painted in different colors for separately displaying the colors, a support member for supporting a rotary shaft of the rotary member, a drive means for turning the rotary member, and control means for controlling the drive means so that one of the optional color regions of the rotary member is turned to a predetermined position. Each of the color regions of the rotary member is square with at least one side being 20 mm or shorter in length.

According to another aspect of the invention, a multicolor display element comprises a rotary member having independent color regions painted in different colors for separately displaying the colors, a support member for supporting a rotary shaft of the rotary member, a drive means for turning the rotary member, and a control means for controlling the drive means so that one of the optional color regions of the rotary member is turned to a predetermined position at a speed of 100 milliseconds or less.

According to still another aspect of the invention, a plurality of the multicolor display elements form a multicolor display unit, and a plurality of the multicolor display units form a large multicolor display apparatus in which each of the multicolor display units serves as a pixel.

In the present invention, the term "multicolor display element" means a basic element comprising a rotatory member having a plurality of colored sections thereon each having a different color from each other, a pulse motor for rotating the rotatory member and supported on a suitable supporting member, and the multicolor display element of the present invention can display any one of different colors contained on the rotatory member.

While the term "multicolor display unit" means a display unit in which a plurality of the multicolor display element, i.e., at least two, are adjacently arranged to each other on the same supporting member, in any configuration form such as in serially arrangement in one direction or in two dimensional arrangement or the like.

On the other hand, the term "multicolor display apparatus" means a display apparatus which comprises a plurality of the multicolor display units adjacently arranged to each other on the same supporting board, in any configuration form such as in serially arrangement in one direction or in two dimensional arrangement or the like.

Since each multicolor display unit serving as a pixel of the large multicolor display apparatus involves a plurality of the multicolor display elements, each pixel can reproduce one of $4^n$ colors (where 4 is the number of colors painted on each multicolor display element and n is the number of the multicolor display elements arranged in each multicolor display unit).

When each multicolor display unit involves nine multicolor display elements, each pixel may provide $4^9$=262,144 combinations of colors. Compared with the conventional display apparatus that provides four colors for each pixel, the multicolor display apparatus of the invention can present many intermediate colors.

Each multicolor display element of the invention is very small because a plurality of elements must form each pixel (multicolor display unit) of the multicolor display apparatus. Owing to this compactness, each multicolor display element, which may be cylindrical or polyhedral, is capable of turning at high speed to quickly switch display images from one to another on the multicolor display apparatus, which can therefore present animations. The compact multicolor display element also reduces the size of the multicolor display apparatus.

The multicolor display unit may be packaged in a sealed casing. The casing provides the unit with waterproof and dustproof effects, thereby improving the stable operation and durability of the multicolor display apparatus under severe weather conditions.

A plurality of the multicolor display units may be disposed in a common sealed casing, to form a composite multicolor display unit, and a plurality of the composite multicolor display units may form a large multicolor display apparatus. This method reduces the number of parts and simplifies assembly and maintenance of the apparatus.

The cylindrical or polyhedral multicolor display element of the invention is driven by a step motor. The step motor comprises a laminated substrate formed of a magnetic plate and a circuit board, a bearing hole formed in the laminated substrate, excitation coils disposed on the circuit board along a circle concentric to the bearing hole; ends of the excitation coils being electrically connected to circuit patterns formed on the circuit board, magnetic cores anchored in and magnetically connected to the magnetic plate through the respective magnetic coils, stators arranged in a ring and connected to the free ends of the respective magnetic cores, and a permanent magnet fitted to a rotary shaft and disposed in a circular space surrounded by the stators. The rotary shaft has one end supported by the bearing hole formed in the laminated substrate, and the other end by a support member that extends from the laminated substrate and is bent.

This step motor can be assembled by sequentially arranging, on the laminated substrate, the excitation coils, magnetic cores, rotary shaft, and support member. It is possible, therefore, to employ an automatic assembling machine for mass-producing the step motors from precision parts.

As mentioned before, each pixel of the conventional multicolor display apparatus comprises one multicolor display element that is very large with each side being at least 5 cm, to slowly change colors from one to another. Since each pixel provides a maximum of four colors, the conventional multicolor display apparatus presents poor resolution of characters and images. Namely, the conventional multicolor display apparatus does not reproduce clear and colorful characters and images.

To solve this problem, the multicolor display element according to the invention employs a very small rotary member having color regions for separately displaying a plurality of colors. The size of the multicolor display element is less than half the size of the conventional multicolor display element. For example, the element of the invention is 20 mm or shorter, preferably 10 mm or shorter in side length. The multicolor display element according to the invention is compact and easy to fabricate. In other words, a pitch length formed between the adjacent two multicolored elements 103 is set at less than 20 mm.

The compact multicolor display element of the invention can be turned at high speed. The compactness of the multicolor display element of the invention is realized by a drive means involving a fine motor and controller for correctly driving the element.

The multicolor display element of the invention can be driven to change colors at a speed of 100 milliseconds (msec) or faster, preferably 10 msec or faster. Accordingly, the large multicolor display apparatus employing the multicolor display elements of the invention can display animations similar to a television set.

Since each pixel of the multicolor display apparatus of the invention comprises a plurality of multicolor display elements, every pixel may present various colors and gradations, thereby displaying pictures with improved resolution and clear natural colors.

For example, one pixel, i.e., one multicolor display unit according to the invention is made of 9 (3×3), 16 (4×4), or 25 (5×5) multicolor display elements arranged in a matrix. Accordingly, every pixel can be changed in 9, 16, or 25 color levels. Many of such multicolor display units, i.e., pixels are arranged to form a large multicolor display apparatus, that can reproduce clear and natural color images at high speed.

BRIEF DESCRIPTION OF THE DRAWINGS

FIGS. 5(A) to 5(F) are views showing a mixture of colors presented by the multicolor display unit according to the invention;

DESCRIPTION OF THE PREFERRED EMBODIMENTS

Multicolor display elements, multicolor display units, and multicolor display apparatuses according to the invention will be explained in detail with reference to the drawings.

Figure 1:
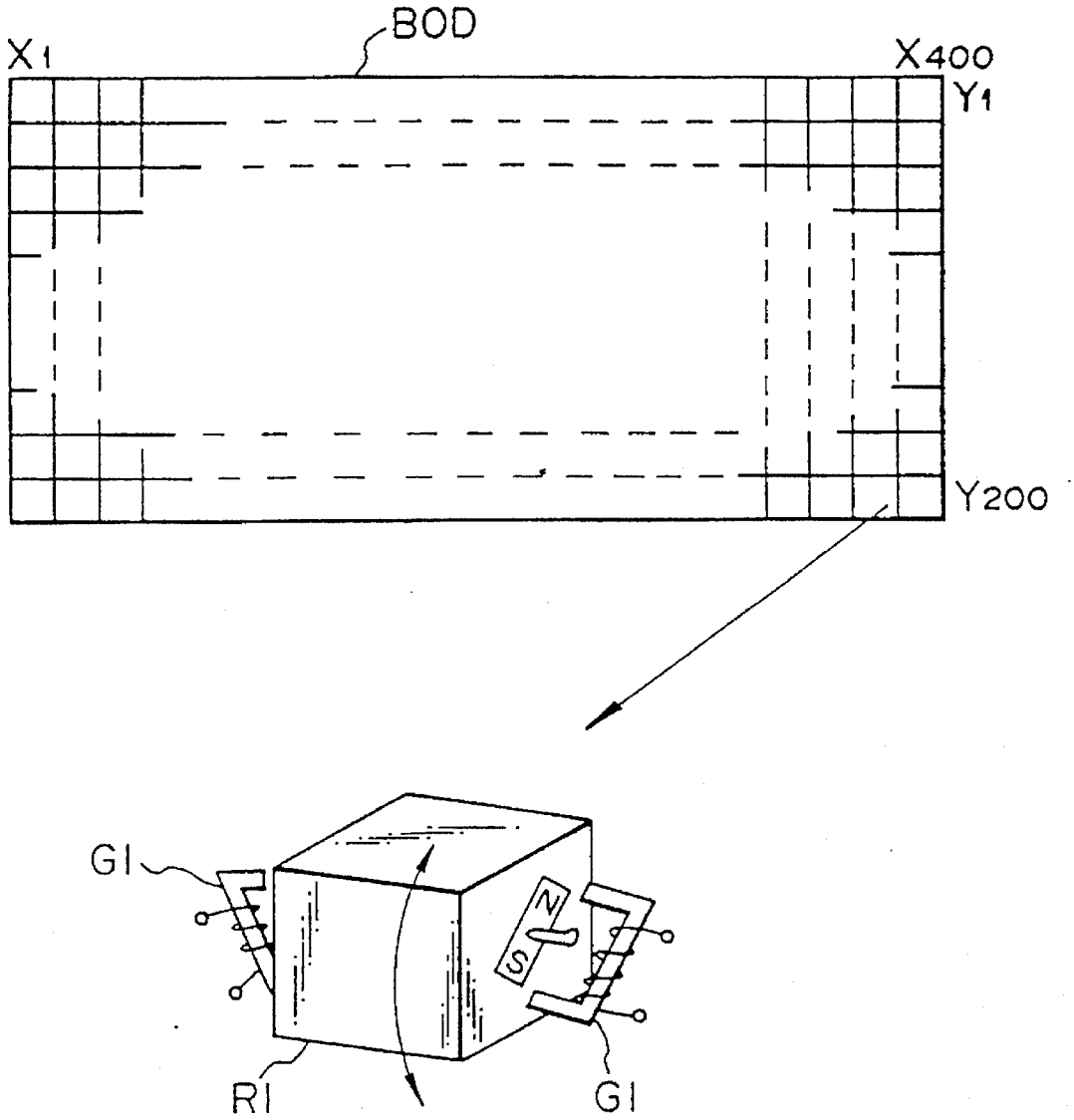
FIG. 1 is a view showing a display apparatus and a multicolor display element according to a prior art.
Figure 2A:
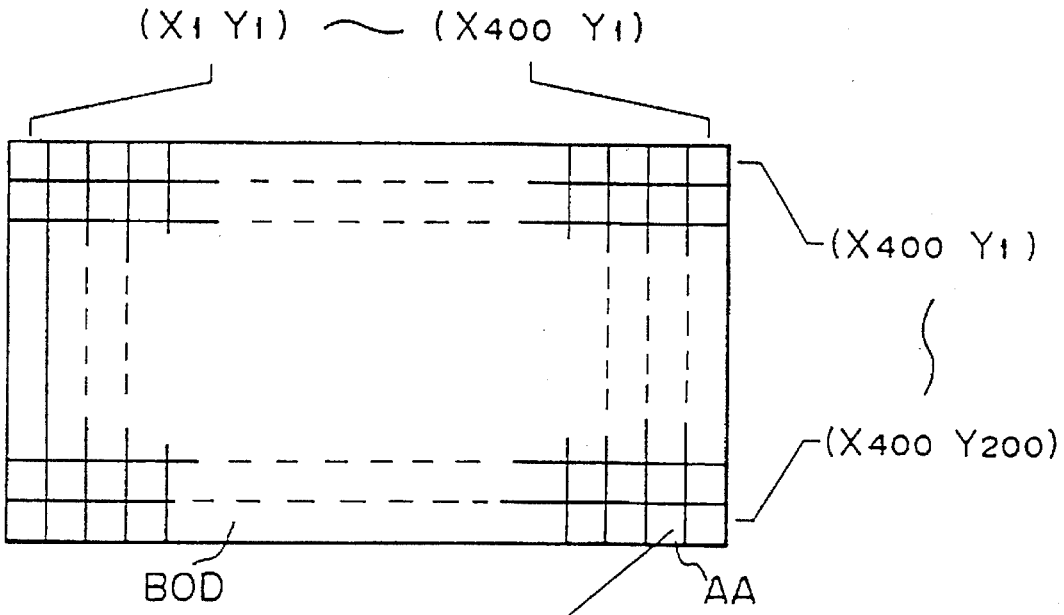
FIGS. 2(A) and 2(B) are front views showing a large multicolor display apparatus and one of multicolor display units disposed in the apparatus, according to an embodiment of the invention.

FIG. 2(A) shows a large multicolor display apparatus according to the invention.

In the figure, a display board BOD of about 20 m×10 m in size includes 80,000 unit blocks AA each of 5 cm square. The blocks AA are expressed as (X1, Y1) to (X400, Y200). Each unit block forms a pixel and corresponds to a multicolor display unit of the invention.

Each unit block AA is divided into sections, and each of the sections comprises a multicolor display element 103. The multicolor display element 103 is able to display, for example, four colors such as white, red, blue, and green. Namely, each unit block AA involves a mixture of colors displayed by the multicolor display elements 103.

Figure 2B:
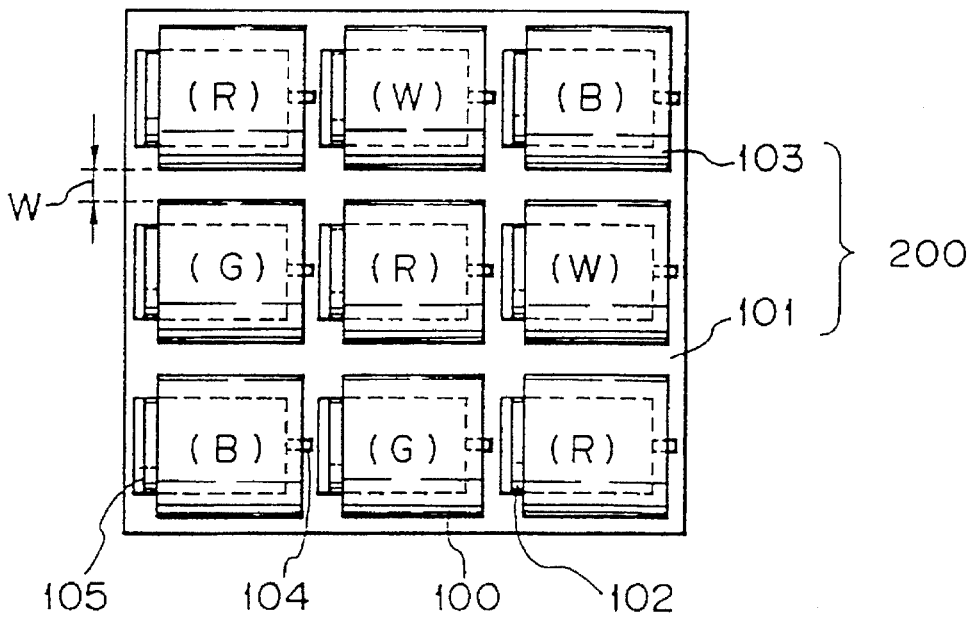

In FIG. 2(B), each unit block AA is divided into nine sections each having the multicolor display element 103. The size of each unit block AA is about 5 cm×5 cm, so that the area of each multicolor display element 103 is about 5 to 13 mm square.

The nine multicolor display elements 103 are arranged in a matrix on a mother board 101 serving as a support member. The unit block AA involving the nine multicolor display elements 103 that determine the color of the unit block forms a multicolor display unit 200.

Figure 3:
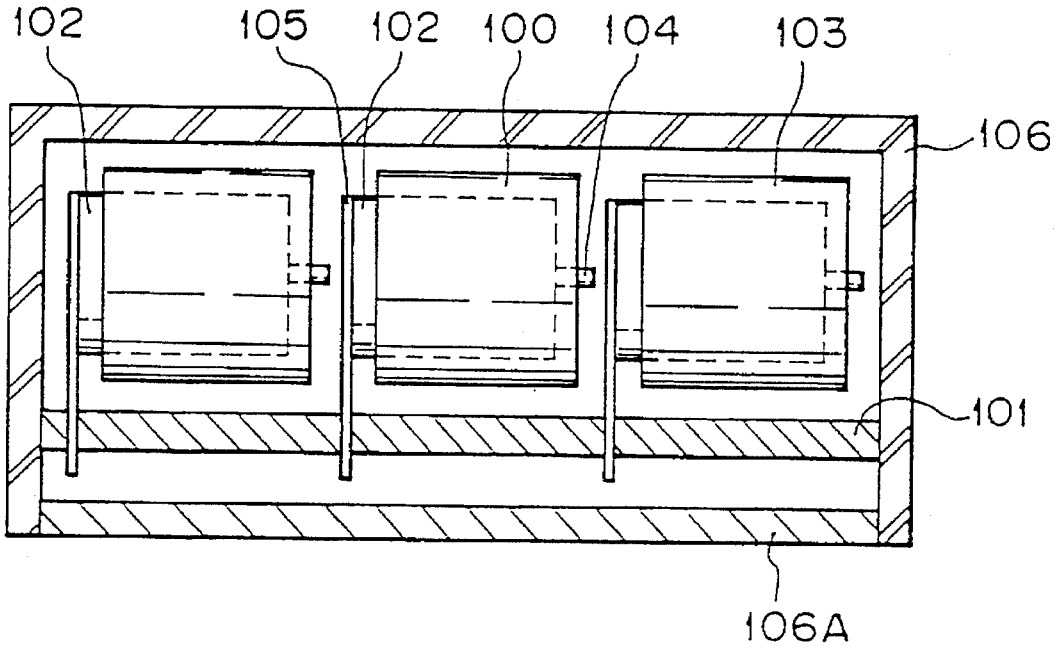
FIG. 3 is a sectional view showing a multicolor display unit having multicolor display elements according to the invention.

In FIG. 3, each multicolor display element 103 comprises a compact pulse motor 102 and a cylindrical or polyhedral multicolor display member (rotary member) 100. The multicolor display rotary member 100 is fitted to a rotary shaft 104 of the pulse motor 102. A support plate 105 is fitted to a rear end of the pulse motor 102, and pressurized into a slit formed on the mother board 101.

The pulse motor 102 may be a pulse motor STP-10S manufactured by Seiko Epson Co. This pulse motor is about 10 mm in outer diameter as well as in length, so that it is sufficiently applicable to this embodiment. Since this pulse motor provides a drive angle of 18 degrees per pulse, five pulses must be applied to the pulse motor when used in this embodiment. This may be achieved by an electric circuit. It is possible to form a 4-pole pulse motor that turns 90 degrees per pulse.

The multicolor display member 100 is made of, for example, resin such as plastics and formed in a cuboid or cylindrical shape with one end closed. The closed end has a center hole into which the rotary shaft 104 of the pulse motor 102 is fitted. Accordingly, the multicolor display rotary member 100 is rotatably supported by the pulse motor 102. The pulse motor 102 is received and hidden in a hollow portion of the multicolor display rotary member 100.

The multicolor display member (hereinafter referred to as the rotary member as well) 100 has separate surface regions painted in different colors to be independently displayed.

Figure 4:
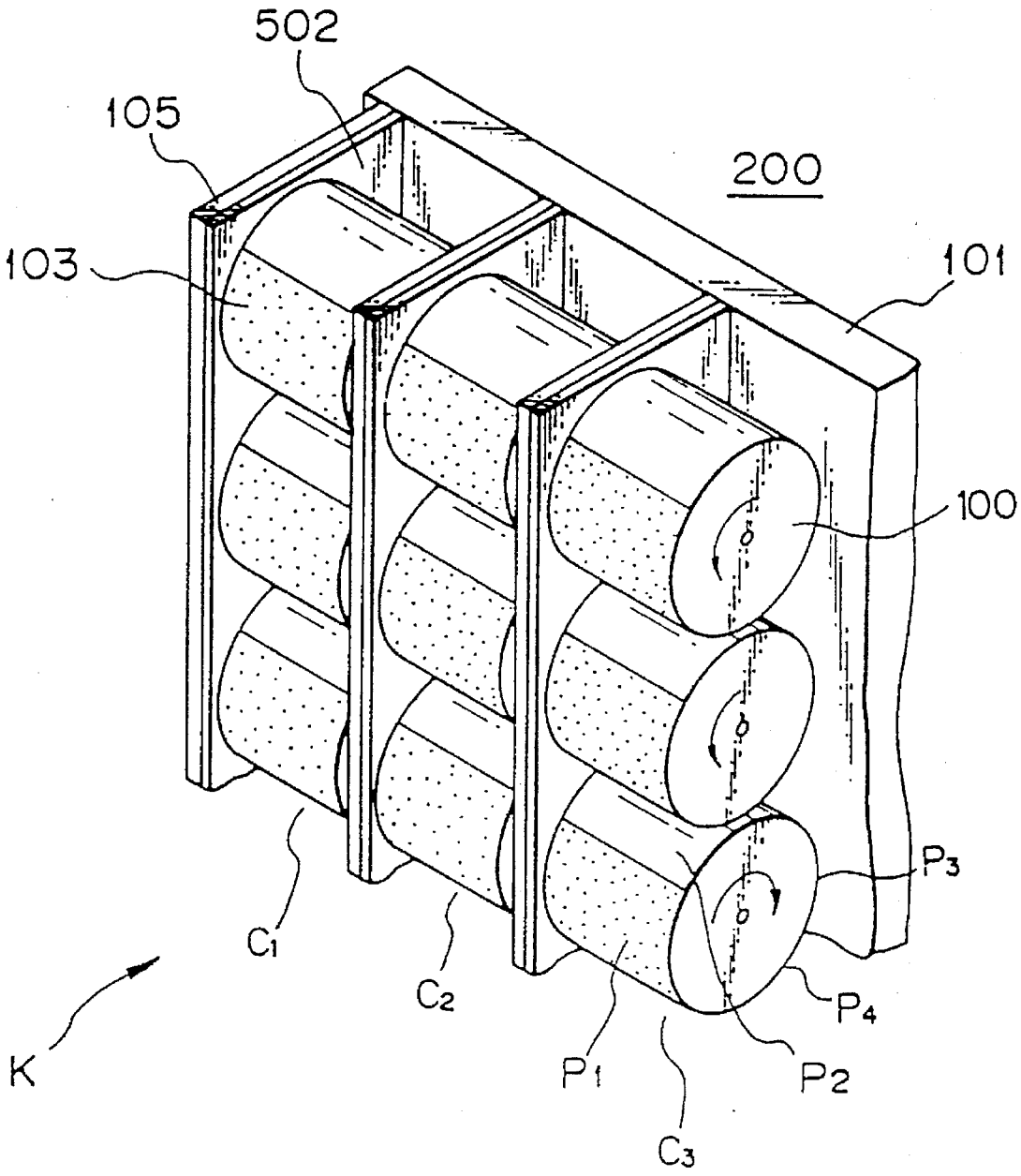
FIG. 4 is a perspective view showing a multicolor display unit having cylindrical multicolor display elements according to the invention.

In FIG. 4, the rotary member 100 is cylindrical with rectangular surface regions P1, P2, P3, and P4 painted in different colors.

In FIG. 3, the mother board 101 with the multicolor display elements 103 is preferably disposed inside a sealed casing 106 having a transparent front panel and a back panel 106A.

The pulse motor 102 turns 90 degrees at a time so that the color regions of the multicolor display member 103 may be successively oriented frontward. The four color regions of the multicolor display rotary member 100 are painted in, for example, white (W), red (R), green (G), and blue (B), and one of these colors is displayed according to the rotation of the multicolor display element 100 driven by the pulse motor 102.

In FIG. 2(B), the multicolor display rotary elements 100 regularly display different colors and marked with W, R, G, and B, and the multicolor display unit 200 as a whole provides a mixture of the colors.

In FIG. 2(B), the nine multicolor display element 103 form one pixel, i.e., one multicolor display unit 200. This means that every pixel of the multicolor display board BOD may provide $4^9$ mixtures of colors. This is equal to 4H9=12C9=220 color combinations. Compared with the four primary colors used by the conventional display element, which corresponds to one pixel, the apparatus of the present invention can display more colors including intermediate colors.

FIGS. 5(A) to (F) show a color mixing effect of the multicolor display unit 200 of the invention. In FIG. 5(A), all of the multicolor display elements 103 of the multicolor display unit 200 display red (R). This red is gradually changed to white (W) in FIG. 5(F) through FIGS. 5(B) to 5(E). FIG. 5(B) involves only one white (W), so that the multicolor display unit 200 may provide a slightly whitish red when seen from a distance. FIGS. 5(C) and 5(D) may provide pink and reddish color, respectively, and FIG. 5(E) slightly reddish white. Other combinations of colors are also possible.

The embodiment provides optional combinations of the four colors, as well as different diagonal and circular lines with boundary lines 168 and 169 as shown in FIGS. 5(C) and 5(D). When the multicolor display unit 200 displays a mixture of colors, the white (W) and red (R) shown in FIGS. 5(B) and 5(E) may be displayed at centers 171 and 172 instead of corners 170 and 173.

Including positional differences in calculating permutations with the nine multicolor display elements 100 each having four colors, there will be 262,144 color combinations, and excluding the positional differences, there will be 220 color combinations.

The multicolor display elements 103 in each multicolor display unit 200 may have different combinations of colors. For example, some have R, G, B, and W, and others have R, G, Y (yellow), and BL (black). This arrangement provides more colors.

If each multicolor display unit 200 incorporates 16 (4×4) multicolor display elements 103, it will provide $4^{16}=4.3\times10^9$ color permutations and 4H16=19C16=969 color combinations. If each multicolor display unit 200 incorporates 25 (5×5) multicolor display elements 103, it will provide $4^{25}=1.125\times10^{15}$ color permutations and 4H25=20C25=3276 color combinations. In this way, the invention can display fine intermediate colors that are unachievable by the conventional technique.

In FIGS. 2(B) and 3, the rotary shafts 104 of each row of the multicolor display elements 103 in each multicolor display unit 200 are axially aligned on the mother board 101. According to this arrangement, the multicolor display elements 103 are allowed to simultaneously move only when a gap W (FIG. 2(B)) between adjacent rows of the rotary members 100 is larger than a predetermined value, which is relatively large.

When the multicolor display member (rotary member) 100 having a cuboid shape is turned, a corner of the cuboid draws a maximum circle. When the multicolor display members 100 of the multicolor display elements 103 are simultaneously turned in one multicolor display unit 200, the gap W must be large. The large gap W deteriorates an aperture factor of the unit 200. The gap W, therefore, must be as small as possible. To minimize the gap, the usual technique is to simultaneously turn every second rows of the multicolor display elements 100. This may narrow the gap W to an extent that allows only one of the adjacent two rows of the multicolor display members 100 to turn.

Figure 6:
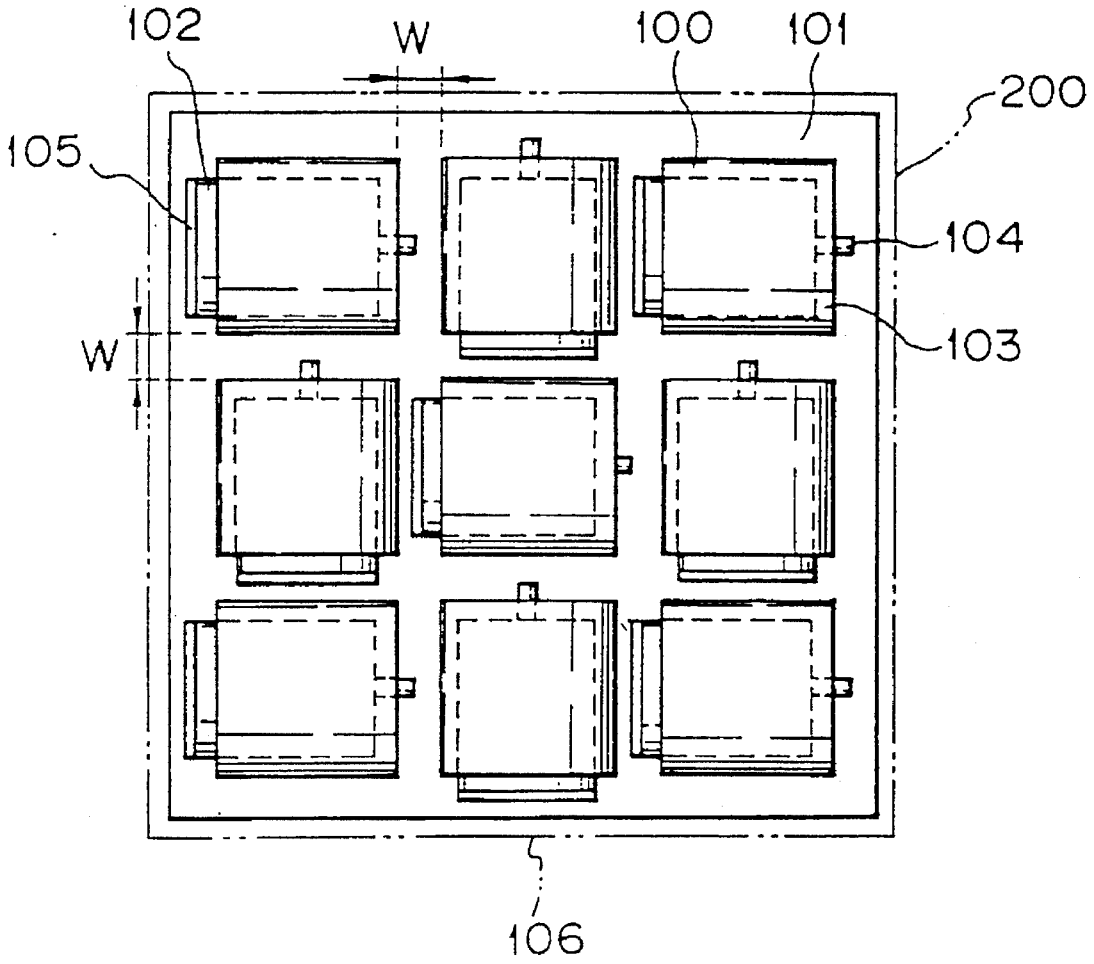
FIG. 6 is a view showing a multicolor display unit according to another embodiment of the invention.

FIG. 6 shows a multicolor display unit 200 according to the invention. The multicolor display unit 200 incorporates multicolor display elements 103 that can be simultaneously turned without deteriorating the aperture factor. Rotary shafts of adjacent multicolor display elements 103 are orthogonally oriented so that rotary faces of the adjacent elements will not face each other. According to this arrangement, a gap between the adjacent multicolor display elements 103 may be set to allow one of the multicolor display rotary members 100 of the adjacent multicolor display elements 103 to turn. The aperture factor of this embodiment is the same as that of the embodiment of FIG. 2. With the same aperture factor, all of the multicolor display elements 103 of FIG. 6 can simultaneously turn without creating interference.

Figure 7:
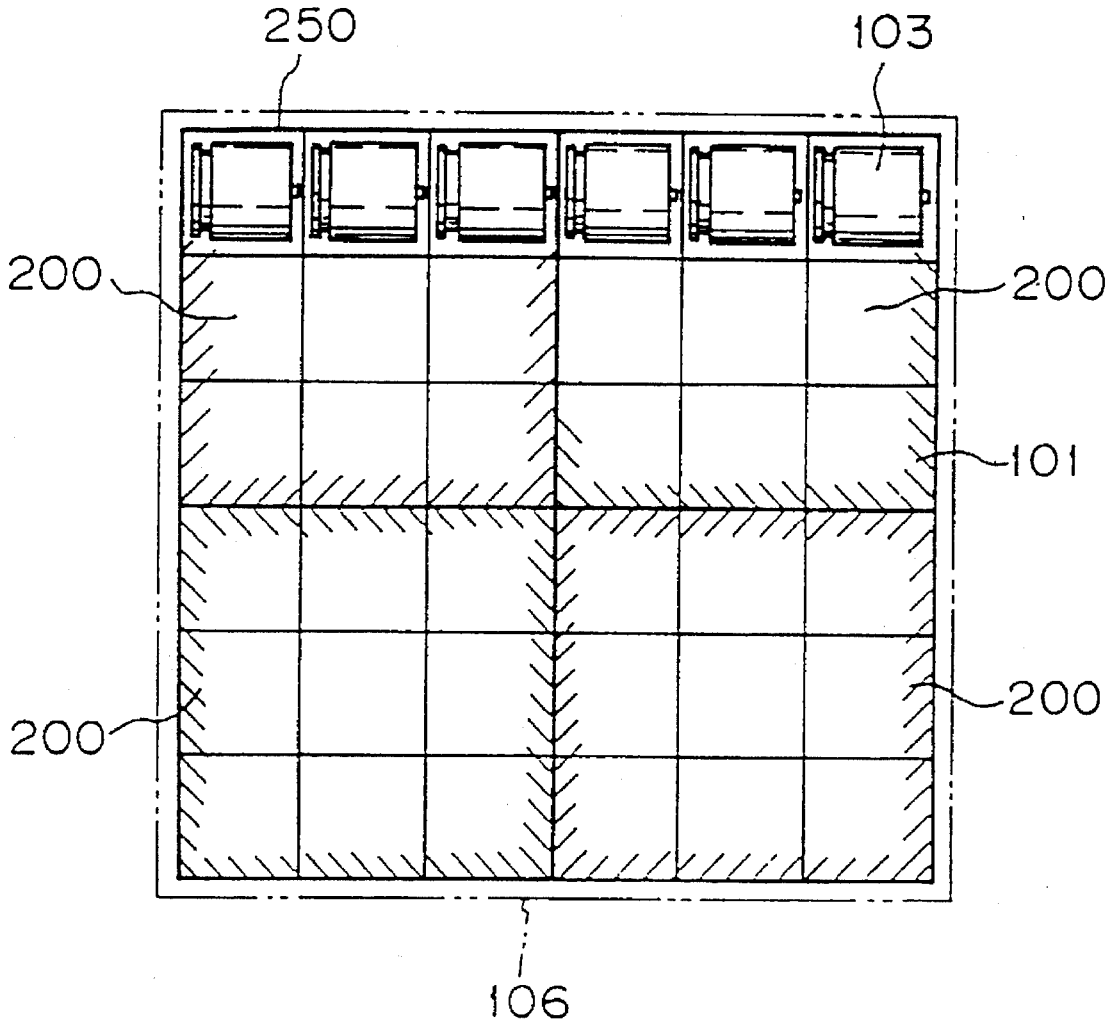
FIG. 7 is a view showing a multicolor display unit according to still another embodiment of the invention.

FIG. 7 shows another embodiment of the invention.

In this embodiment, a multicolor display unit 200 is formed by arranging 9 (3×3) multicolor display elements 103 on a mother board 101 and further a plurality (for example, 4 (2×2)) of the multicolore display units 200 are arranged on a common supporting frame (not shown) to form a composite multicolor display unit 250, i.e., a multicolor display apparatus 300 explained hereunder, and it is received in a closed casing 106.

This arrangement with the composite multicolor display unit 250 comprising a plurality of the multicolore display elements 200 contained in the closed casing 106, Simplifies a work of installing the multicolor display units 200 on a display board such as one shown in FIG. 2(A). The number of the multicolor display units 200 disposed on the same mother board 101 is not particularly limited.

Figure 8:
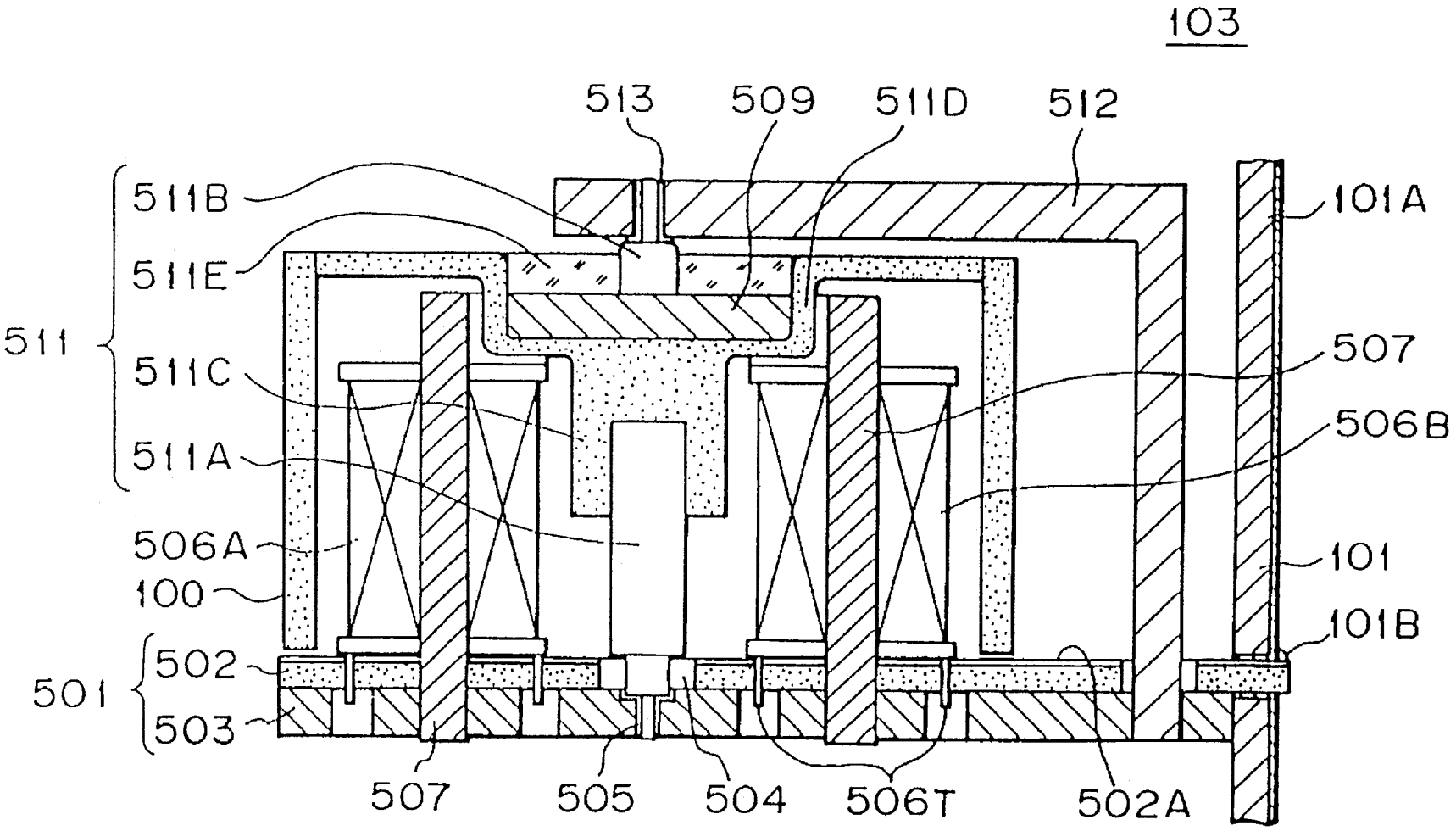
FIG. 8 is a sectional view showing a multicolor display element for mass production according to the invention.
Figure 9:
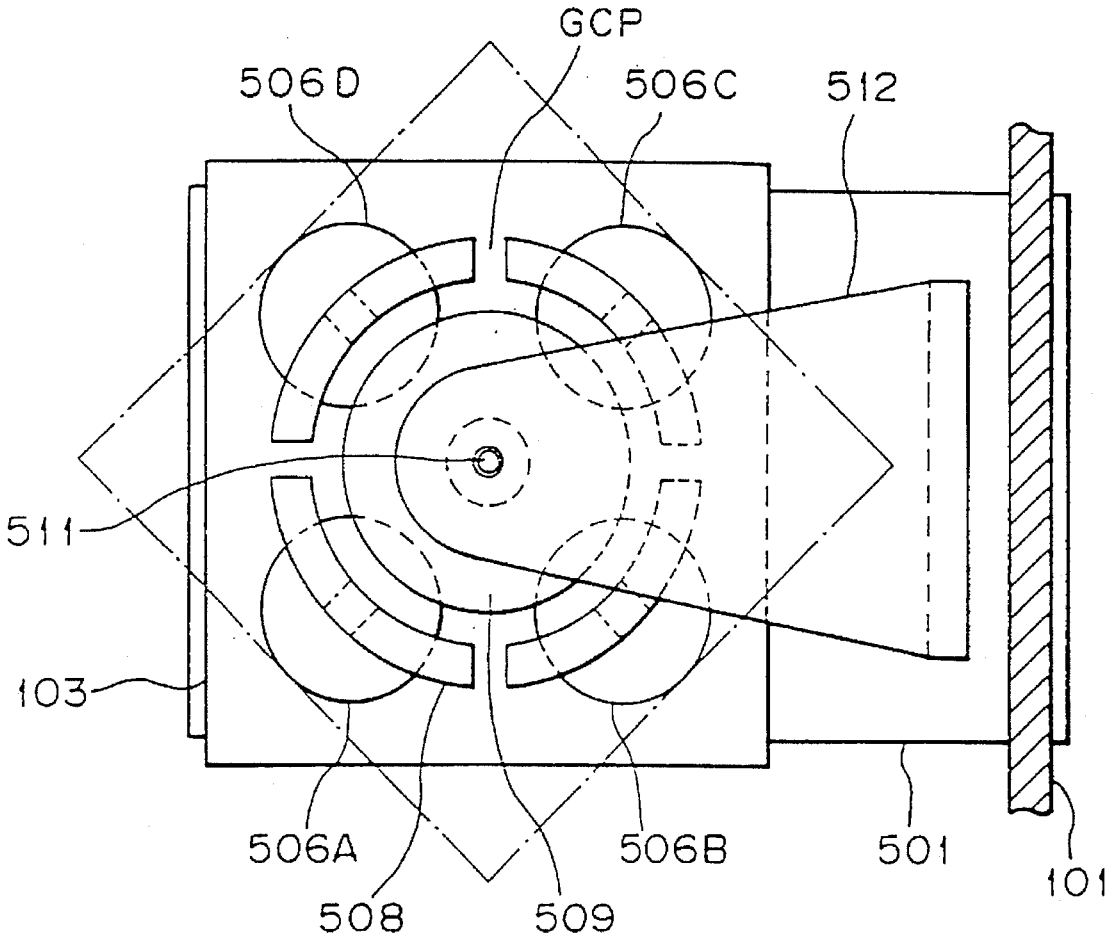
FIG. 9 is a plan view showing the multicolor display element of FIG. 8.

FIGS. 8 and 9 show a multicolor display element 100 according to the invention.

A laminated substrate 501 forms part of a support member. The laminated substrate 501 comprises a circuit board 502 and a magnetic plate 503, that are adhered to each other. One end of the circuit board 502 is longer than that of the magnetic plate 503, and the longer part of the circuit board 502 is inserted into a slit formed on a mother board 101. The mother board 101 has a circuit pattern 101A, and the circuit board 502 has a circuit pattern 502A. These circuit patterns 101A and 502A are electrically connected to each other by soldering 101B. The laminated board 501 is thus mechanically fixed to the mother board 101.

The circuit board 502 has a relatively large hole 504 for exposing the magnetic plate 503 where a bearing hole 505 is formed. Along a circle that is concentric to the bearing hole 505, four excitation coils 506A, 506B, 506C, and 506D are arranged. Terminals 506T of the excitation coils 506A to 506D are fitted to through holes formed in the circuit board 502. Since the terminals 506T are fitted to the through holes and since they are soldered together, the excitation coils 506A to 506D are electrically connected to the circuit pattern 502A of the circuit board 502, and mechanically connected to the circuit board 502.

The magnetic plate 503 serves as a support plate for supporting the above-mentioned components.

A magnetic core 507 is inserted in a center hole of each of the excitation coils 506A to 506D. An end of the magnetic core 507 is passed through the circuit board 502 and fitted to the magnetic plate 503. Accordingly, each magnetic core 507 is magnetically connected to the magnetic plate 503. A free end of each magnetic core 507 orthogonally extends to the magnetic core 507, thereby forming a stator 508.

Figure 10:
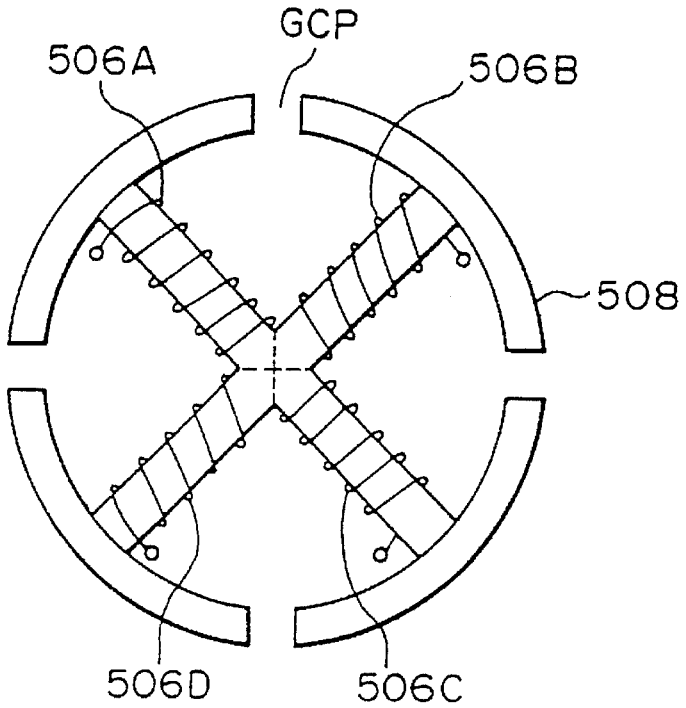
FIG. 10 is a view showing an equivalent circuit of the multicolor display element of FIG. 8.

Each stator 508 is formed in an arc, and four stators 508 are arranged in a ring as shown in FIG. 9. A magnetic gap GCP is formed between adjacent stators 508 (FIGS. 9, 10, and 12). The stators 508 surrounds a circular area where a permanent magnet 509 is rotatably supported by a rotary shaft 511.

The rotary shaft 511 is a combination of different material. Namely, the rotary shaft 511 comprises pivots 511A and 511B disposed on and under the permanent magnet 509. Ends of the pivots 511A and 511B are made of metal. One end of the pivot 511A is integrally inserted into a resin shaft member 511C. The shaft member 511C has a flange, which is bent to form a cylindrical portion 511D. The permanent magnet 509 is pressurized into the cylindrical portion 511D.

The pivot 511B is inserted into a center hole of a resin disk member 511E, which is pressurized into the cylindrical portion 511D, so that the pivots 511A and 511B are coaxial to each other. The other end of the pivot 511B is supported by a bearing hole 513 formed on a support member 512. The support member 512 is bent, and one end thereof is fixed to the magnetic plate 503.

An open end of the cylindrical portion 511D is bent orthogonally to the rotary shaft 511, and the periphery of the bent end is fixed to a multicolor display rotary member 100. It is preferable to integrally form the multicolor display member 100, shaft member 511C, and cylindrical portion 511D with the same resin material.

The pivot 511B of the rotary shaft 511 is supported by the bearing 513 of the L-shaped support member 512, which is supported by the magnetic plate 503. This configuration does not limit the invention. For example, only one end of the rotary shaft 511 may be fixed to the support member 503.

The multicolor display member (rotary member) 100 has a cuboid shape with four faces painted in white (W), red (R), green (G), and blue (B), respectively.

Figure 18:
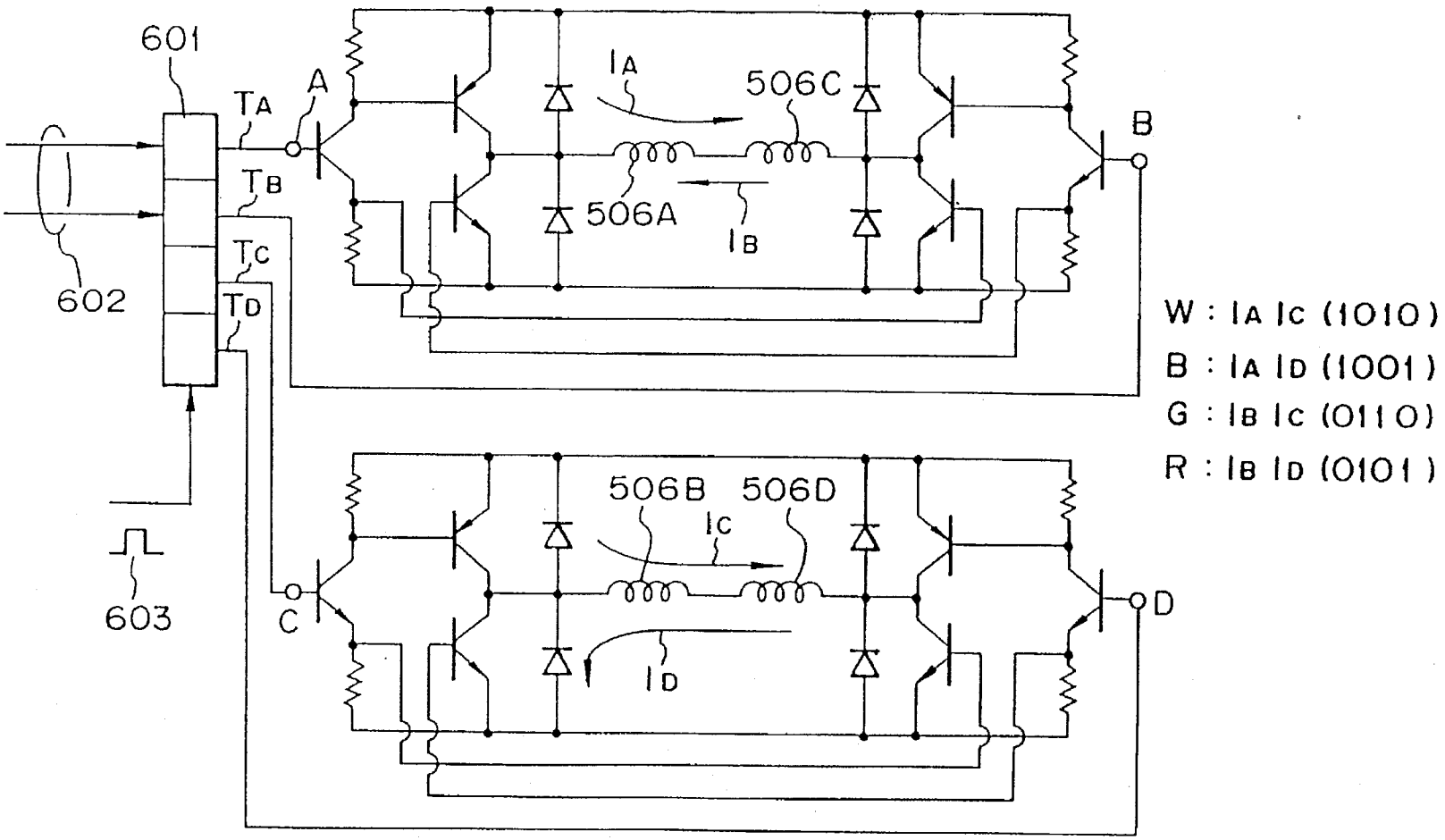
FIG. 18 is a circuit diagram showing a drive circuit for a multicolor display element disposed in a multicolor display unit, according to the invention.

In FIG. 10, the excitation coils 506A and 506C are connected in series, and the excitation coils 506B and 506D are connected in series. These coils are excited by a drive circuit shown in FIG. 11. This figure shows one drive circuit that may drive one set of the excitation coils 506A and 506C, or 506B and 506D. In practice, two drive coils are prepared as shown in FIG. 18.

Figure 11:
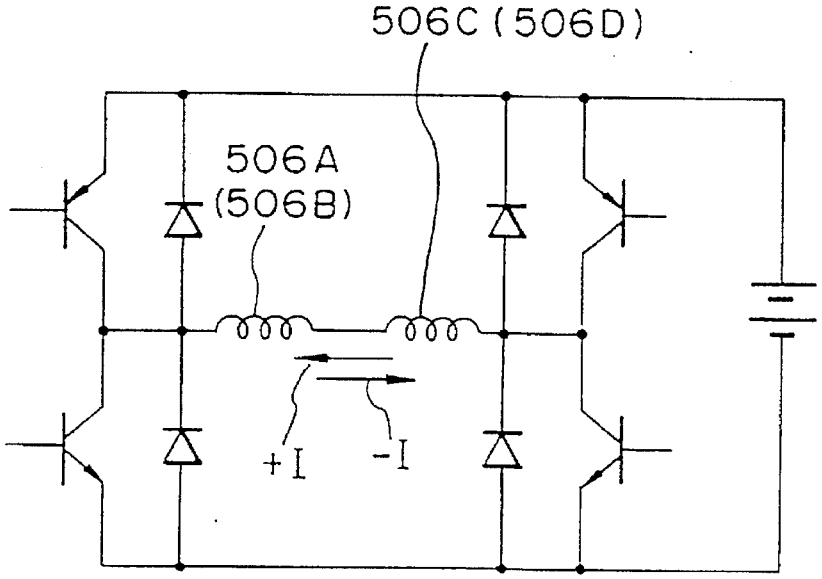
FIG. 11 is a circuit diagram showing a circuit for driving the multicolor display element of FIG. 8.

The drive circuit of FIG. 11 supplies positive and negative excitation currents +I and −I to one set of the excitation coils 506A and 506C, or 506B and 506D. It is possible, therefore, to successively form magnetic poles N1, S1, N2, and S2 in the stators 508 by successively switching the direction of the currents supplied to the series connected excitation coils, as shown in FIGS. 12(A) to 12(D). Here, the magnetic poles N1 and S1 are produced by the series connected excitation coils 506A and 506C, and the magnetic poles N2 and S2 are produced by the series connected excitation coils 506B and 506D. According to these magnetic poles N1, S1, N2, and S2, the magnetic poles N and S of the permanent magnet 509 are located as shown in FIGS. 12(A) to 12(D).

When a combination of the excitation currents determines the rotational position of the permanent magnet 509, the color of the multicolor display rotary member 100 is determined. Seen from an arrow mark LOK, FIG. 12(A) displays white (W), FIG. 12(B) blue (B), FIG. 12(C) green (G), and FIG. 12(D) red (R).

The magnetic poles N1, S1, N2, and S2 are produced by the stators 508 only while the multicolor display member 100 is being turned. When the multicolor display member 100 reaches a target position, the magnetic poles N1, S1, N2, and S2 may disappear. Accordingly, the excitation currents supplied to the excitation coils 506A to 506D may be pulse currents. During a stationary state, the excitation currents are each zero. Even if the excitation currents are zero, the multicolor display member 100 is held at the position by a magnetic force of the permanent magnet 509. Namely, the multicolor display member 100 is stabilized when the magnetic poles N and S of the permanent magnet 509 are positioned at the magnetic gaps GCP between the adjacent stators 508.

Figure 12A:
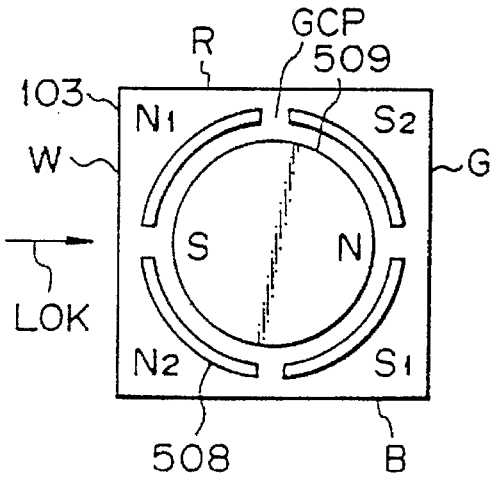
FIGS. 12(A) to 12(D) are views explaining operations of the multicolor display element of FIG. 8.
Figure 12B:
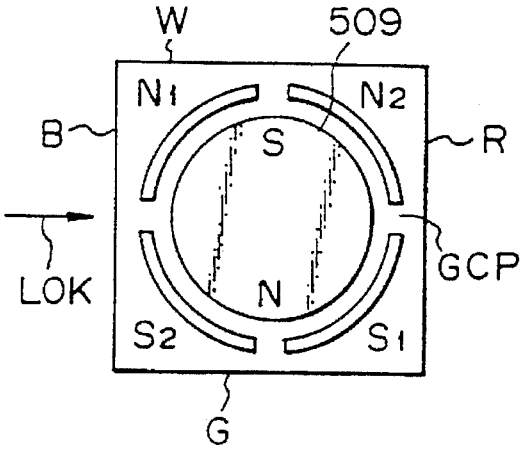
Figure 12C:
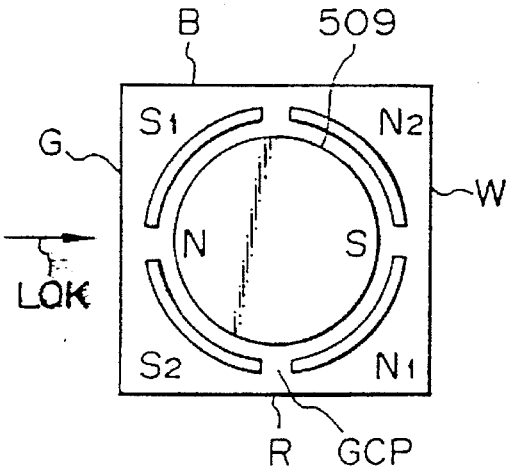
Figure 12D:
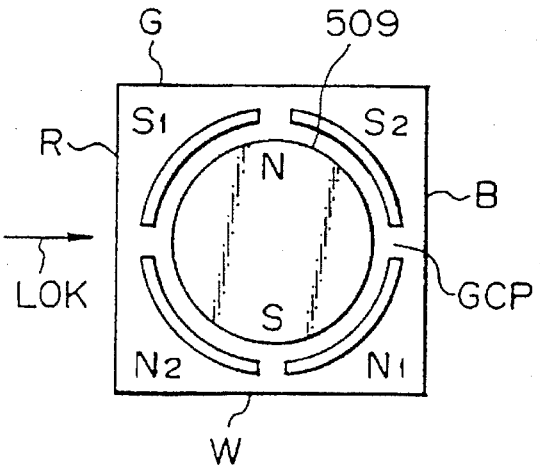

The white (W) of FIG. 12(A) may be changed to green (G) of FIG. 12(C), or blue (B) of FIG. 12(B) may be changed to red (R) of FIG. 12(D). In this way, the multicolor display member 103 may be optionally turned 90 or 180 degrees.

Figure 13A:
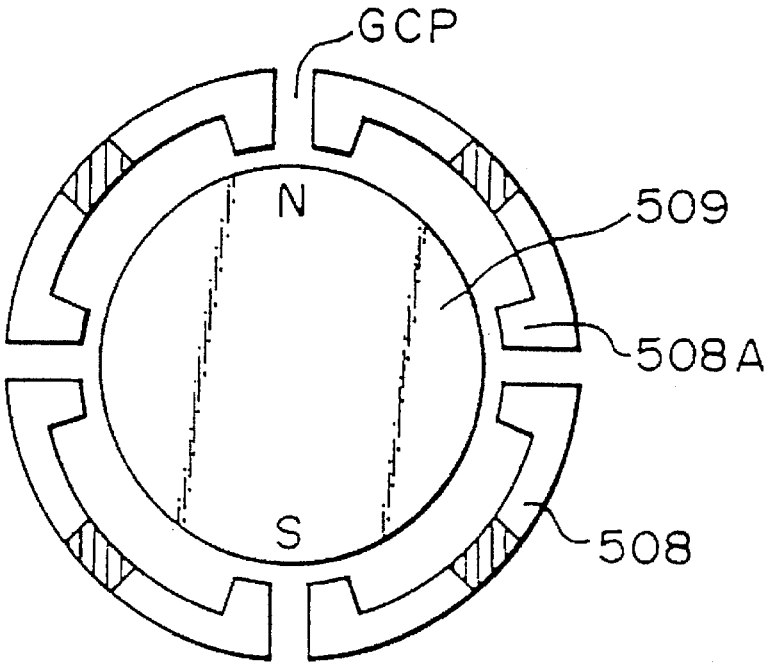
FIGS. 13(A) and 13(B) are plan views showing modifications of stators of the multicolor display element of FIG. 8.
Figure 13B:
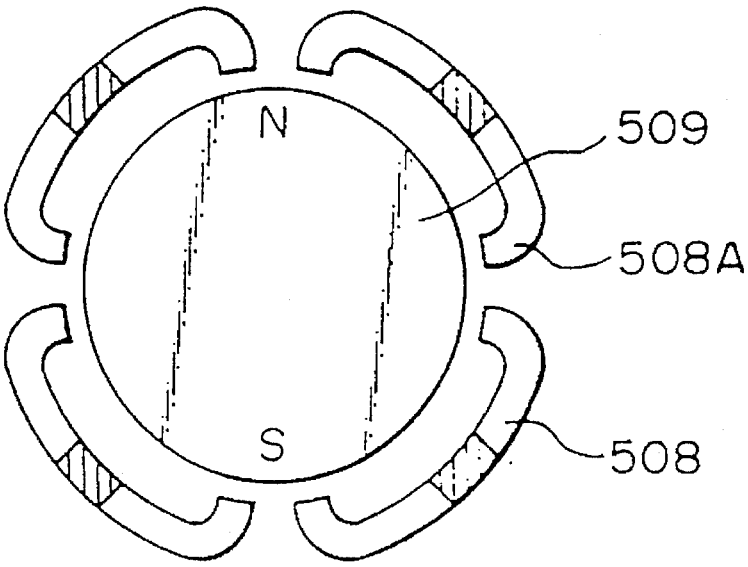
Figure 14:
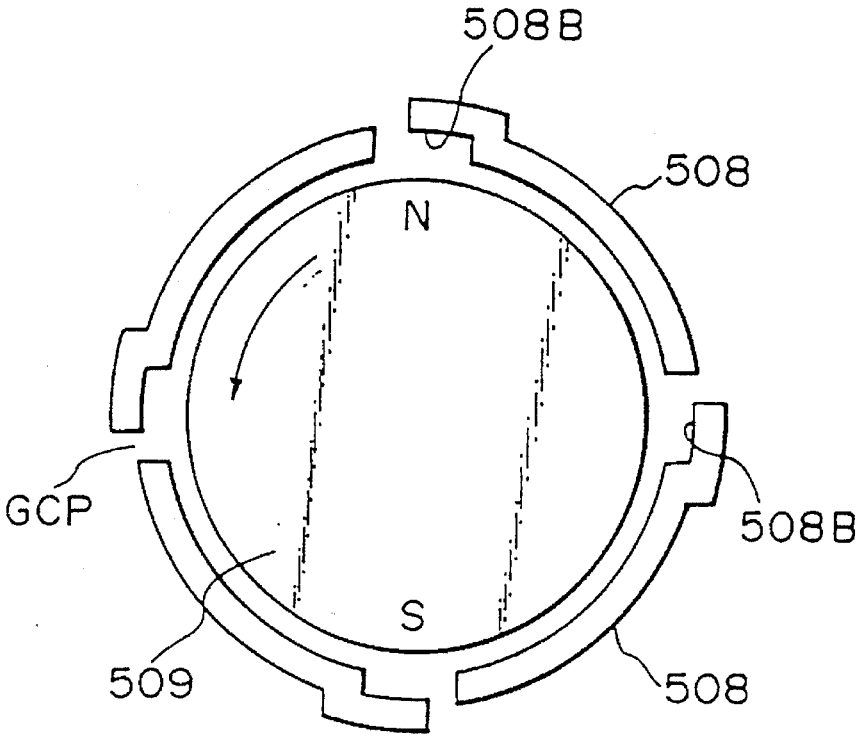
FIG. 14 is a plan view showing a modification of stators of the multicolor display element of FIG. 8.

FIGS. 13(A), 13(B), and 14 show modifications of the stators 508. In FIGS. 13(A) and 13(B), each stator 508 has protruding ends 508A oriented toward the permanent magnet 509. These protruding ends 508A reinforce the magnetic power for holding the permanent magnet 509 during a stationary state.

FIG. 14 shows a stator 508 having a recessed end 508B. This recessed end 508B restricts the turning direction of the permanent magnet 509 when it turns 180 degrees. To change the state of FIG. 12(A) to the state of FIG. 12 (C), the stators 508 are excited as shown in FIG. 12(C) with the permanent magnet 509 being at the position of FIG. 12(A). In this case, it is not easy to determine whether the permanent magnet 509 is turned in a clockwise direction or counterclockwise direction.

Generally, a magnetic imbalance in the magnetic poles N1, S1, N2, and S2 produced by the stators 508 determines the rotational direction of the permanent magnet 509 to achieve a 180-degree turn. If the magnetic poles N1, S1, N2, and S2 of the stators 508 are perfectly balanced, the rotational direction of the permanent magnet 509 will not be determined, and therefore, the 180-degree turn will never be achieved. Accordingly, the stators 508 of FIG. 14 cause magnetic imbalances at the ends of the stators 508 in advance to restrict the turning direction of the permanent magnet 509 when it turns 180 degrees.

To restrict the turning direction, it is possible to produce a phase difference, a pulse width difference, or a pulse amplitude difference in the pulse excitation currents supplied to the series connected excitation coils 506A and 506C, or 506B and 506D.

Figure 15:
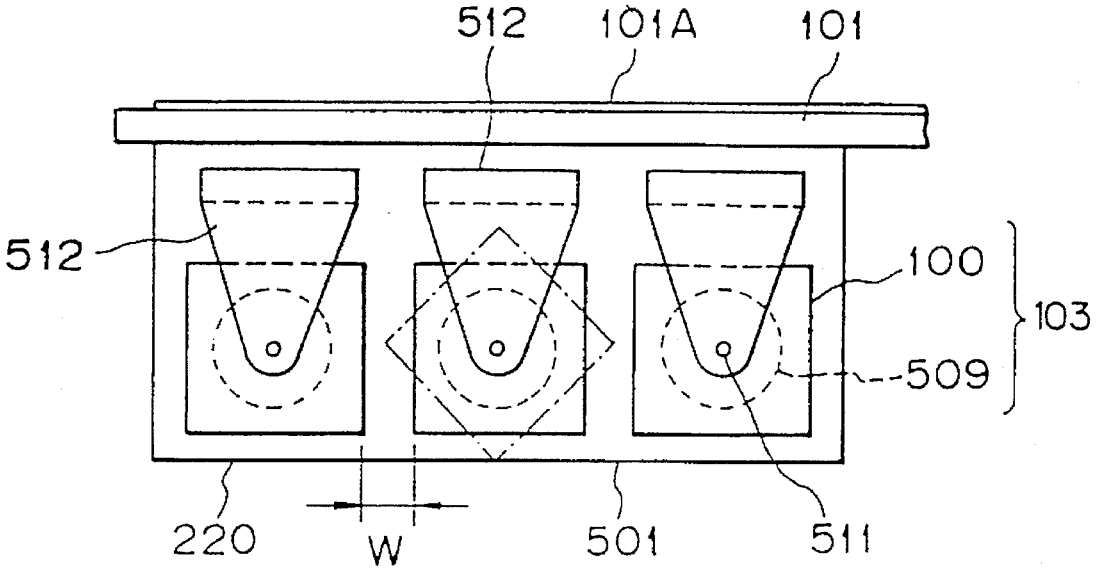
FIG. 15 is a view showing multicolor display elements according to the invention.

In FIGS. 8 and 9, one multicolor display element 103 is assembled on one laminated substrate 501. In FIG. 15, a plurality of multicolor display elements 103 are disposed on one laminated substrate 501, to form a multicolor display unit 220. The multicolor display unit 220 of FIG. 15 involves three multicolor display elements 103 disposed on the same laminated substrate 501. A gap W between adjacent multicolor display elements 103 is set to allow only one of the adjacent multicolor display elements 103 to be turnable.

Figure 16:
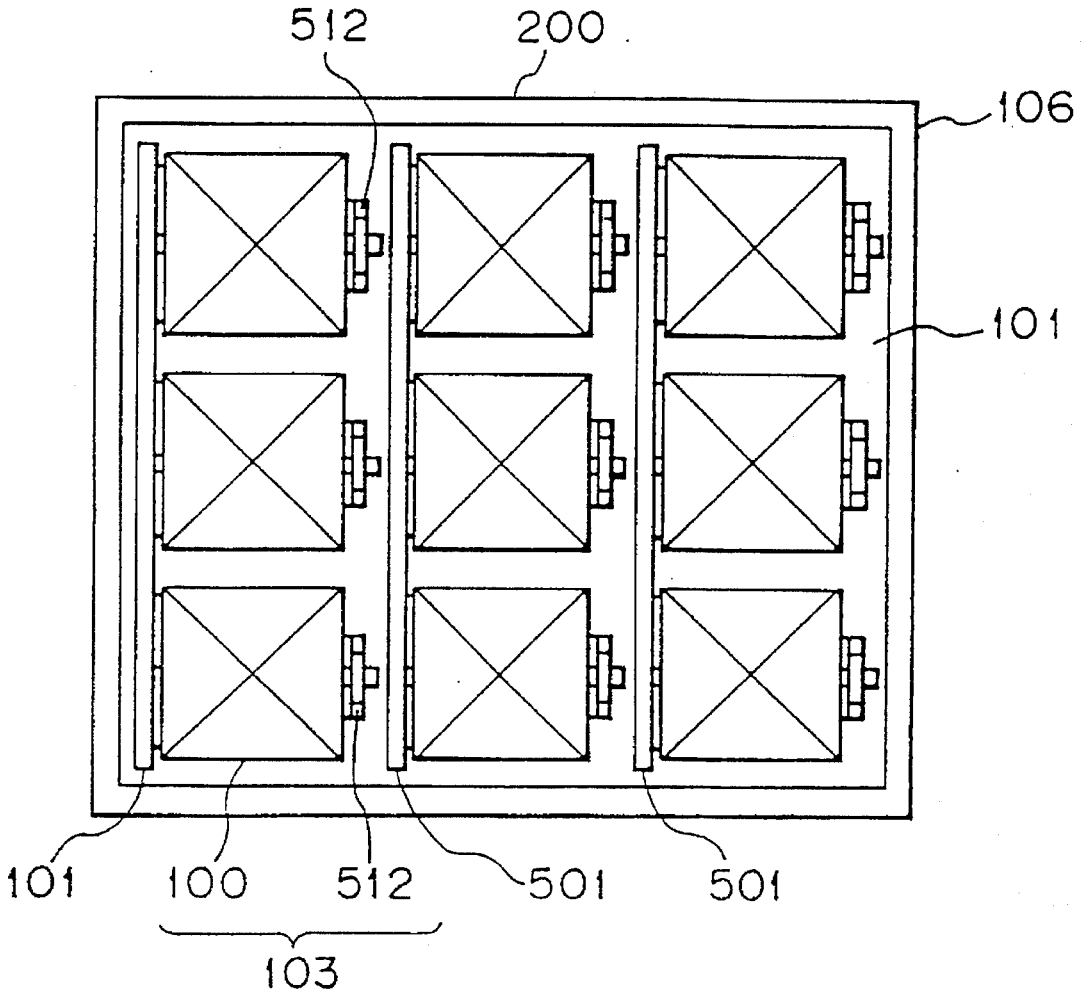
FIG. 16 is a front view showing a multicolor display unit using the multicolor display elements of FIG. 15.
Figure 17:
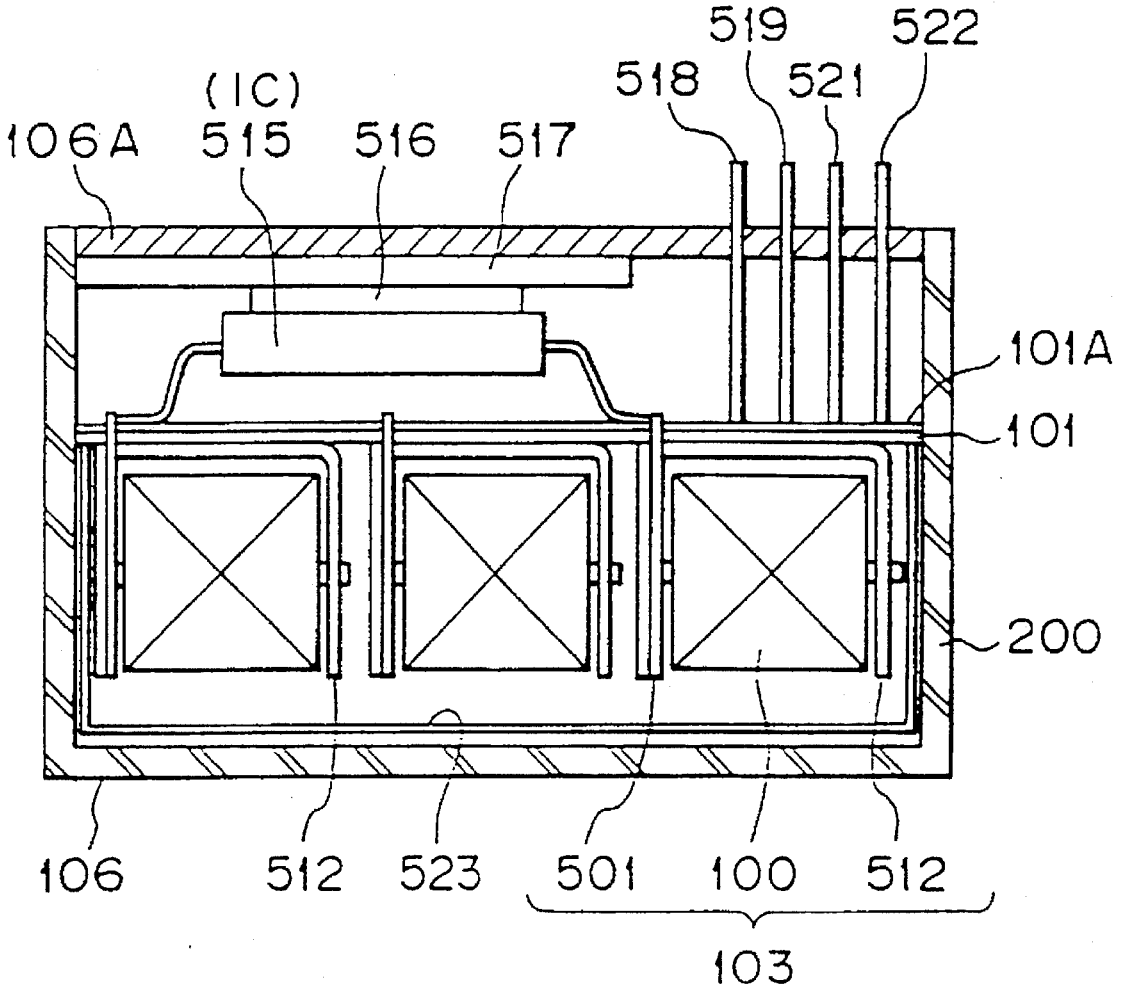
FIG. 17 is a sectional view showing the multicolor display unit of FIG. 16.

FIGS. 16 and 17 show a multicolor display unit 200 comprising the multicolor display elements 103 of FIG. 15 received in a common sealed casing 106. The casing 106 isolates the multicolor display unit 200 from outside dust, humidity, wind, etc., to extend the service life of the rotatable multicolor display members 100. The casing 106 may be made of resin or glass. Alternatively, a front face of the casing 106 may be made of glass and other parts may be made of ceramics or other organic material. The casing 106 may be hermetically sealed and vacuumed. When the casing 106 is vacuumed, air resistance against the movement of each multicolor display member 100 is reduced to achieve a fast response. The vacuumed casing 106 also prevents the evaporation of oil around rotary parts, a penetration of moisture, and atmospheric heat conduction.

FIG. 17 shows an example of packaging an IC 515 for controlling the multicolor display unit 200. The IC 515 is soldered to the circuit pattern 101A formed on the back of the mother board 101. The IC 515 produces a lot of heat because it incorporates a circuit for providing excitation currents to the excitation coils 506A to 506D of the multicolor display elements 103. To radiate the heat, radiation panel 516 and 517 are arranged over the IC 515, and if necessary, these radiation panels are attached to a back panel 106A of the casing 106, to discharge heat outside the casing 106. Four terminals 518, 519, 521, and 522 extend from the mother board 101. These terminals 518, 519, 521, and 522 are, for example, a ground terminal, power source terminal, signal terminal, and control terminal. The IC 515 operates in response to inputs to the terminals 518, 519,521, and 522, to turn the respective multicolor display elements 100 to optional positions.

In FIG. 17, a heater 523 is disposed at a lower part of the back of a front panel of the casing 106 and connected to the power source terminal 519 and ground terminal 518 through a semiconductor switch. When required, the semiconductor switch is turned ON in response to a control signal, to heat a display surface to melt snow, etc., on the display surface.

The IC 515 may be disposed on the mother board 101 according to packaging techniques such as DIP, QFP, flip-chip mounting, chip bonding, mini mod, face down, etc. The multicolor display unit 200 is received in the sealed casing 106, so that it may be easily replaced and maintained after mounted on a large display board BOD.

Heretofore, the structures of the large multicolor display apparatuses, multicolor display elements 103, and multicolor display units 200 have been explained. In the explanations, the multicolor display member (rotary member) 100 has been cuboid for the sake of simplicity. The multicolor display member 100 may be a triangular pipe for providing three colors, a pentagonal pipe for providing five colors, a cylinder, etc. When the multicolor display member 100 is a cylinder, a plurality of the members 100 can be disposed close to one another to improve the aperture factor of the multicolor display unit 200.

An electric control system of the large multicolor display apparatus 300 will be explained. The multicolor display element 103 with four display colors can be controlled by a 2-bit digital signal.

FIG. 18 shows a drive circuit that controls four colors according to a 2-bit digital signal. A serial-to-parallel converter (not shown) receives a 2-bit color signal 602 and converts it into a parallel signal. A 2-bit-to-4-bit converter 601 receives the converted 2-bit color signal 602 and a strobe pulse 603, and while the strobe pulse 603 is at, for example, logic H, provides a 4-bit signal through output terminals TA, TB, TC, and TD.

When the 2-bit color signal 602 is "0, 0," the output terminals TA to TD provide a 4-bit signal of, for example, "1010." Accordingly, an excitation current IA flows through the series connected excitation coils 506A and 506C, and an excitation current IC through the series connected excitation coils 506B and 506D, for a period corresponding to the pulse width of the strobe pulse 603. As a result, the multicolor display element 103 displays, for example, white (W).

When the 2-bit color signal 602 is "0, 1," the output terminals TA to TD provide a 4-bit signal of, for example, "1001." Accordingly, the excitation current IA flows through the series connected excitation coils 506A and 506C, and an excitation current ID through the series connected excitation coils 506B and 506D, for a period corresponding to the pulse width of the strobe pulse 603. As a result, the multicolor display element 103 displays, for example, blue (B).

When the 2-bit color signal 602 is "1, 0," the output terminals TA to TD provide a 4-bit signal of, for example "0110." Accordingly, an excitation current IB flows through the series connected excitation coils 506A and 506C, and the excitation current IC through the series connected excitation coils 506B and 506D, for a period corresponding to the pulse width of the strobe pulse 603. As a result, the multicolor display element 103 displays, for example, green (G).

When the 2-bit color signal 602 is "1, 1," the output terminals TA to TD provide a 4-bit signal of, for example "0101." Accordingly, the excitation current IB flows through the series connected excitation coils 506A and 506C, and the excitation current ID through the series connected excitation coils 506B and 506D, for a period corresponding to the pulse width of the strobe pulse 603. As a result, the multicolor display element 103 displays, for example, red (R).

Figure 19:
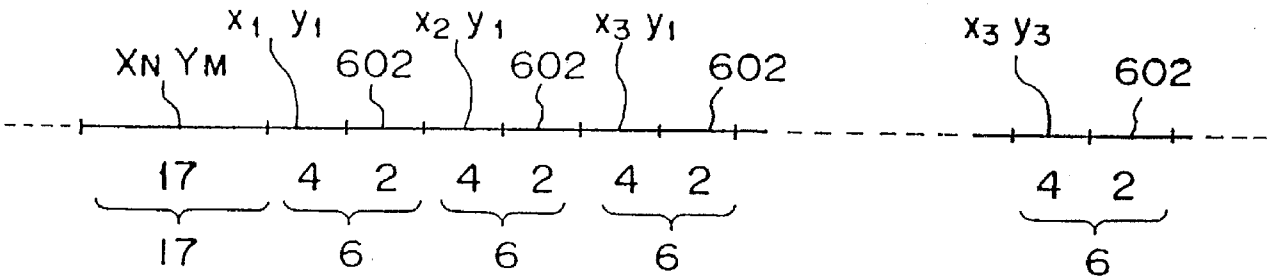
FIG. 19 is a view showing an example of a signal transmitted to the multicolor display unit according to the invention.

FIG. 19 shows the color signals 602 transmitted to a large multicolor display apparatus 300.

In the figure, XN and YM are address signals assigned for respective multicolor display units 200 arranged at pixel positions of the multicolor display apparatus. According to the embodiment of FIG. 2, N may be one of 1 to 400, and M one of 1 to 200. In this case, each address X may comprise nine bits, and each address Y eight bits. A signal for an address (X, Y), therefore, may comprise 17 bits.

Figure 20:
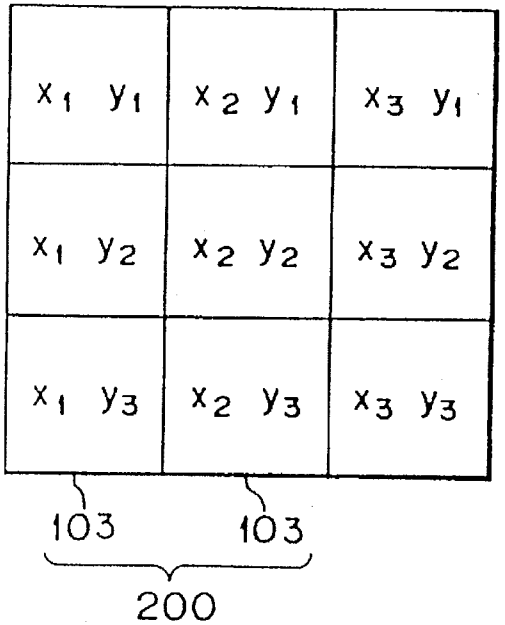
FIG. 20 is a front view showing addresses of multicolor display elements in the multicolor display unit according to the invention.

In FIG. 20, each multicolor display unit 200 incorporates nine multicolor display elements 103, which are addressed by addresses (x1, y1) to (x3, y3) each comprising four bits.

The color signal 602 is transmitted following each of the address signals (x1, y1) to (x3, y3) assigned for the multicolor display elements 103. In all, each multicolor display unit 200 may receive a signal of 71 (17+9×6=71) bits.

Figure 21:
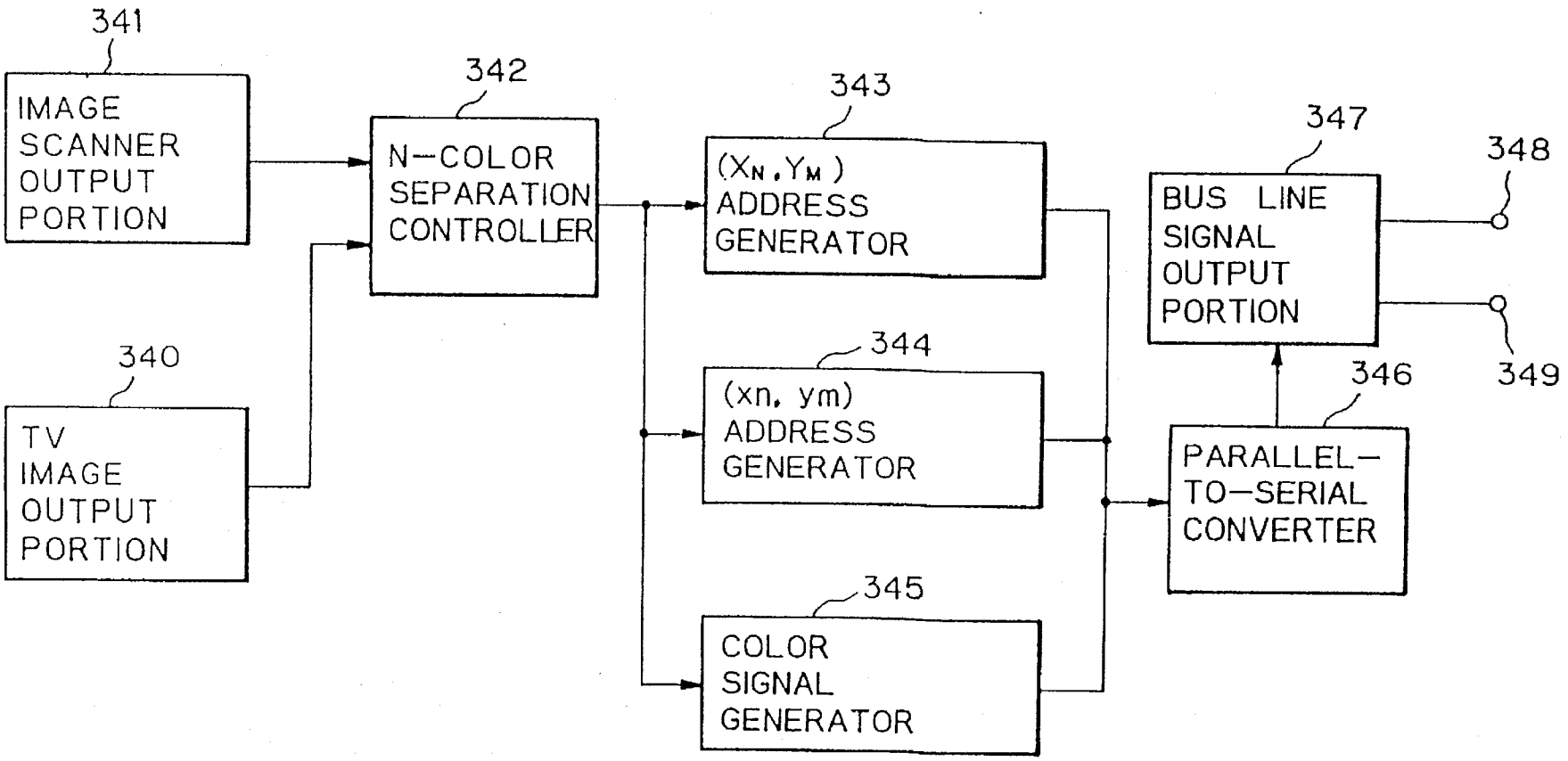
FIG. 21 is a block diagram showing an image processor for supplying a signal to the large multicolor display apparatus according to the invention.

FIG. 21 shows a video signal generator for generating the address signals (XN, YM) and (xn, ym), and color signals 602 shown in FIG. 19.

The video signal generator comprises video signal sources 340 and 341, an n-color separation controller 342, an (XN, YM) address generator 343, an (xn, ym) address generator 344, a color signal generator 345, a parallel-to-serial converter 346, and a bus line signal output portion 347.

The video signal source 340 may be a television signal generator such as a television camera or a VTR. The other video signal source 341 may be an image reader such as an image scanner.

Video signals provided by the video signal sources 340 and 341 are supplied to the n-color separation controller 342, which separates the video signals into a plurality of unit blocks each corresponding to one multicolor display unit 200. This separation may be done by fetching the video signals into an image memory and by allocating address regions of the memory for the unit blocks corresponding to the multicolor display units 200.

The video signals separated into the address regions of the image memory are averaged to provide mean colors for the address regions, respectively. This means that, when each multicolor display unit 200 comprises 9 (3×3) multicolor display elements 103, one of 220 colors is selected for the corresponding address region of the multicolor display unit 200.

Once colors to be displayed by the multicolor display units 200 are determined, the (XN, YM) address generator 343 generates an address signal for every multicolor display unit 200. At this time, the (xn, ym) address generator 344 generates address signals (xn, ym) for the multicolor display elements 103 contained in a corresponding multicolor display unit 200. Also, the color signal generator 345 picks up, from a table of color combinations to be displayed by the multicolor display elements 103 for displaying one of the 220 colors, a 2-bit color signal 602 for each multicolor display element 103. The color signal and the corresponding address signal (xn, ym) generated by the (xn, ym) address generator 344 are transferred to the parallel-to-serial converter 346.

The parallel-to-serial converter 346 converts the parallel signal into a serial signal, which the bus line signal output portion 347 is provided with. The bus line signal output portion 347 properly amplifies the serial signal and provides an output terminal 348 with said signal. At the same time, the converter 346 provides an output terminal 349 with a control signal such as a clock signal and a strobe pulse.

Figure 22:
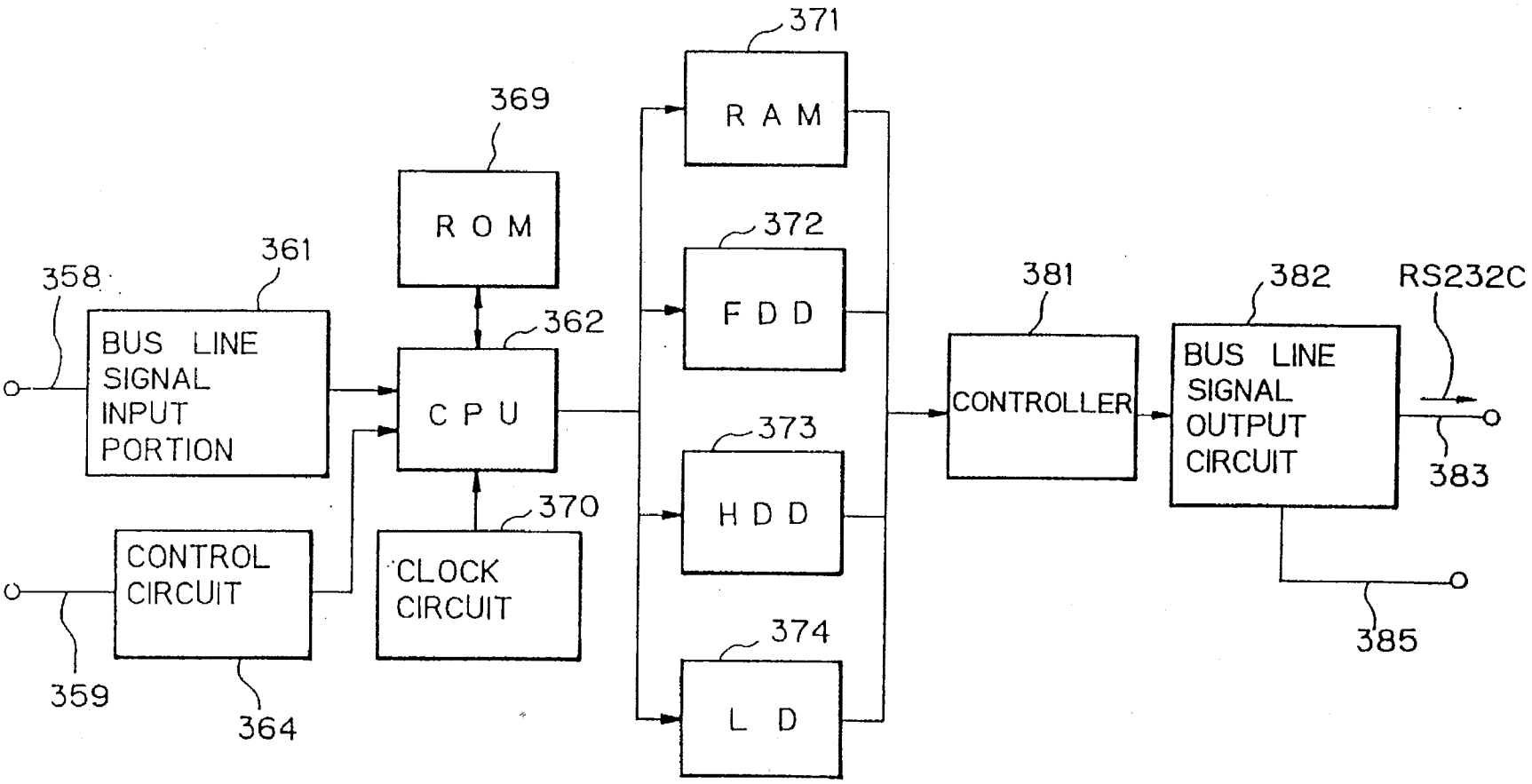
FIG. 22 is a block diagram showing an image processor for providing animations to the large multicolor display apparatus according to the invention.

FIG. 22 shows an animation display circuit. This circuit intermittently samples a high-speed signal such as a television signal and provides a slow speed video signal that is displayable as animations on the large multicolor display apparatus according to the invention. The circuit temporarily stores frames of images necessary for displaying animations in a memory and sends said images out at an optional speed.

An input terminal 358 is connected to, for example, the output terminal 348 of FIG. 21. An input signal to the input terminal 358 is shaped by a bus line signal input portion 361 and supplied to a CPU 362. An input terminal 359 is connected to, for example, the control output terminal 349 of FIG. 21. An input signal to the input terminal 359 is separated into a clock signal, address signal, and data signal by a control circuit 364 and supplied to the CPU 362.

The CPU 362 is connected to a ROM 369 and a clock circuit 370. The CPU 362 converts the input video signal into a string of bits that are easily stored in a group of memories, and selects frames to be jumped over. Output bits of the CPU 362 are temporarily stored in the proper recording means such as a RAM 371, floppy disk 372, hard disk 373, and laser disk 374. As and when required, the stored data are read out.

A controller 381 controls reading a string of bits. A bus line signal output circuit 382 amplifies the read signal and provides, for example, an RS232C signal to an output terminal 383. At the same time, the bus line signal output circuit 382 provides a control output terminal 385 with a control signal including a clock pulse used to determine a bit configuration of the output signal.

To display animations, color signals must be transmitted at high speed. For this purpose, 400 output terminals 383 corresponding to the X addresses may be prepared at the bus line signal output circuit 382, to transmit Y-direction color data for each of the 400 output terminals. This arrangement may improve the signal transmission speed about 400 times. In this case, the address signals (XN, YM) are required to discriminate 200 pieces of the multicolor display units 200 from one another in the direction of Y, so that each of the address signals (XN, YM) may comprise 8 bits.

Accordingly, the number of bits of the serial signal of FIG. 19 will be 62 (8+6×9=62).

According to the invention, a color signal for specifying, for example, 220 colors is transmitted to every multicolor display unit 200. To specify 220 colors, the color signal may comprise 8 bits. When only one signal path is used to transmit serial signals for the 80,000 multicolor display units 200 of the multicolor display apparatus of the invention, each address signal (XN, YM) will comprise 17 bits and the color signal will comprise 8 bits for specifying 220 colors.

Each of the multicolor display units 200 decodes and converts the transmitted 8-bit color signal into a (2×9)-bit signal by using a conversion table, to specify colors to be displayed by the nine multicolor display elements 100 of the multicolor display unit. According to this signal transmission method, the 25-bit (17+8–25) signal is supplied to each of the 80,000 multicolor display units 200.

Figure 23:
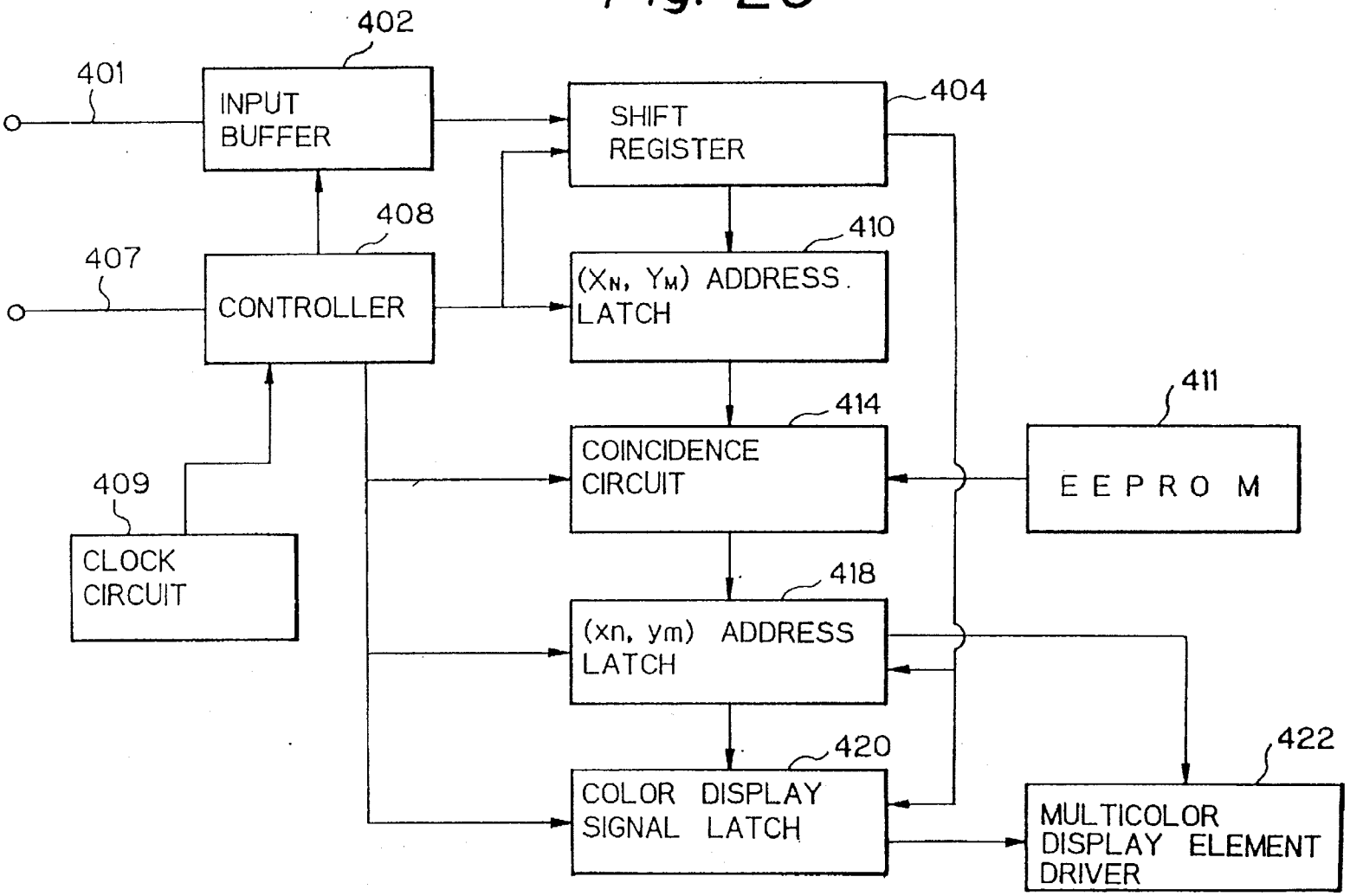
FIG. 23 is a block diagram showing an IC in the multicolor display unit according to the invention.

FIG. 23 shows an IC disposed in each multicolor display unit 200. An input terminal 401 is connected to the output terminal 348 or 383 shown in FIGS. 21 and 22 through a bus line such as a coaxial cable, to receive the color signals 602 with the address signals shown in FIG. 19. An input buffer 402 shapes the input signals and supplies them to a shift register 404, which stores serial bits. On the other hand, a control input terminal 407 is connected to the control output terminal 349 or 385 of FIGS. 21 and 22 through a coaxial cable, to receive the clock signal and discrimination signal used for separating the address signals and color signals 602 of FIG. 19 from one another.

A controller 408 lets a clock circuit 409 generate a clock pulse, and the shift register 404 provides an address (XN, YM) to an (XN, YM) address latch 410. A coincidence circuit 414 compares the address latched by the latch 410 with a specific address stored in an EEPROM 411. If these addresses coincide with each other, the following addresses (xn, ym) and color data are taken in, and if they do not coincide with each other, the shift register 404 is reset.

The EEPROM 411 is a permanent memory for storing an address specific to the corresponding multicolor display unit 200, so that it may be a ROM, EPROM, MONOS (an electrically writable and erasable semiconductor memory), or soldered wiring. For repair and replacement, EEPROM or MONOS is preferable because it is easily rewritten.

When the coincidence circuit 414 determines a coincidence of the address (XN, YM), the controller 408 lets an (xn, ym) address latch 418 latch the address of a multicolor display element 103. At the same time, a color display signal latch 420 latches color data. The latches 418 and 420 drive a multicolor display element driving portion 422 according to the address and color signal 602.

In this way, the color signal data of the transmitted original image are decoded by the receiver side and used to reproduce the original image.

According to this embodiment, each multicolor display element 103 displays four colors, and each multicolor display unit 200 incorporates a plurality of multicolor display elements 103. Accordingly, each multicolor display unit 200 is able to display a mixture of the XYth power of the four colors, i.e., the 4th, 9th, 16th, 25th, . . . power of the four colors. As a result, pixels, each comprising the multicolor display unit 200 of the multicolor display apparatus of the invention, are very fine.

Each multicolor display member (rotary member) 100 has a diameter of, for example, 5 to 10 mm, so that it may consume very little electric power and is turnable at high speed. As a result, the large multicolor display apparatus according to the invention can display animations. Since the multicolor display member 100 has small projections, the transparent front panel of the sealed casing 106 can be disposed in the vicinity of the multicolor display members 100, thereby improving clearness of the display.

The multicolor display units 200 received in the sealed casing 106 are protected from dust, rain, wind, etc., to improve durability.

The thickness of each multicolor display unit 200 is only a fraction of the thickness of the conventional unit, so that the large multicolor display apparatus according to the invention is light weight, which may require a simpler support frame.

The decoding IC of FIG. 23 is disposed inside each multicolor display unit 200, to reduce the number of terminals of the multicolor display unit 200 as well as the number of lines leading to the display apparatus to, for example, three.

Consequently, the multicolor display unit 200 has a simple structure that can be automatically assembled to save cost and improve quality.

A multicolor display element according to another embodiment of the invention will be explained.

In the above embodiments, the multicolor display element 103 comprises a relatively large number of parts, which may involve many assembling processes, complications, an increase in production cost, and fluctuations in the characteristics of the multicolor display element. It is necessary, therefore, to simplify the parts and assembly.

In this regard, a multicolor display element of the second embodiment comprises a rotary member having independent color regions painted in different colors for separately displaying the colors, a support member for supporting a rotary shaft of the rotary member, a drive means for turning the rotary member, and a support frame for supporting these components. The drive means includes at least four coils, magnetic cores disposed for the coils, stators connected to the magnetic cores and magnetized by the coils to form magnetic poles, a permanent magnet fixed to the rotary member, and a rotary shaft of the rotary member fixed to the permanent magnet. The magnetic cores are formed by uprightly bending parts of a base plate of the support frame made of magnetic material. The stators are arranged on the magnetic cores, respectively.

The rotary shaft to which the permanent magnet and rotary member (multicolor display member) are fixed forms a rotor. On the other hand, the magnetic cores and coils disposed around the rotor form a stator part. The rotor and stator part are arranged on the base plate to form a motor. The magnetic cores are formed by uprightly bending parts of the base plate. The stators are arranged for the magnetic cores, respectively, and if required, a stator frame for fixing the stators is disposed. The stator frame is preferably provided with a bearing hole for receiving the rotary shaft.

A plurality of the multicolor display elements may be collectively formed on a single base plate. In this case, a plurality of magnetic cores for a plurality of motors are integrally formed from the base plate, to prepare a plurality of motors on the single base plate. The base plate serves as a neutral point of magnetic circuits of the motors.

Figure 24:
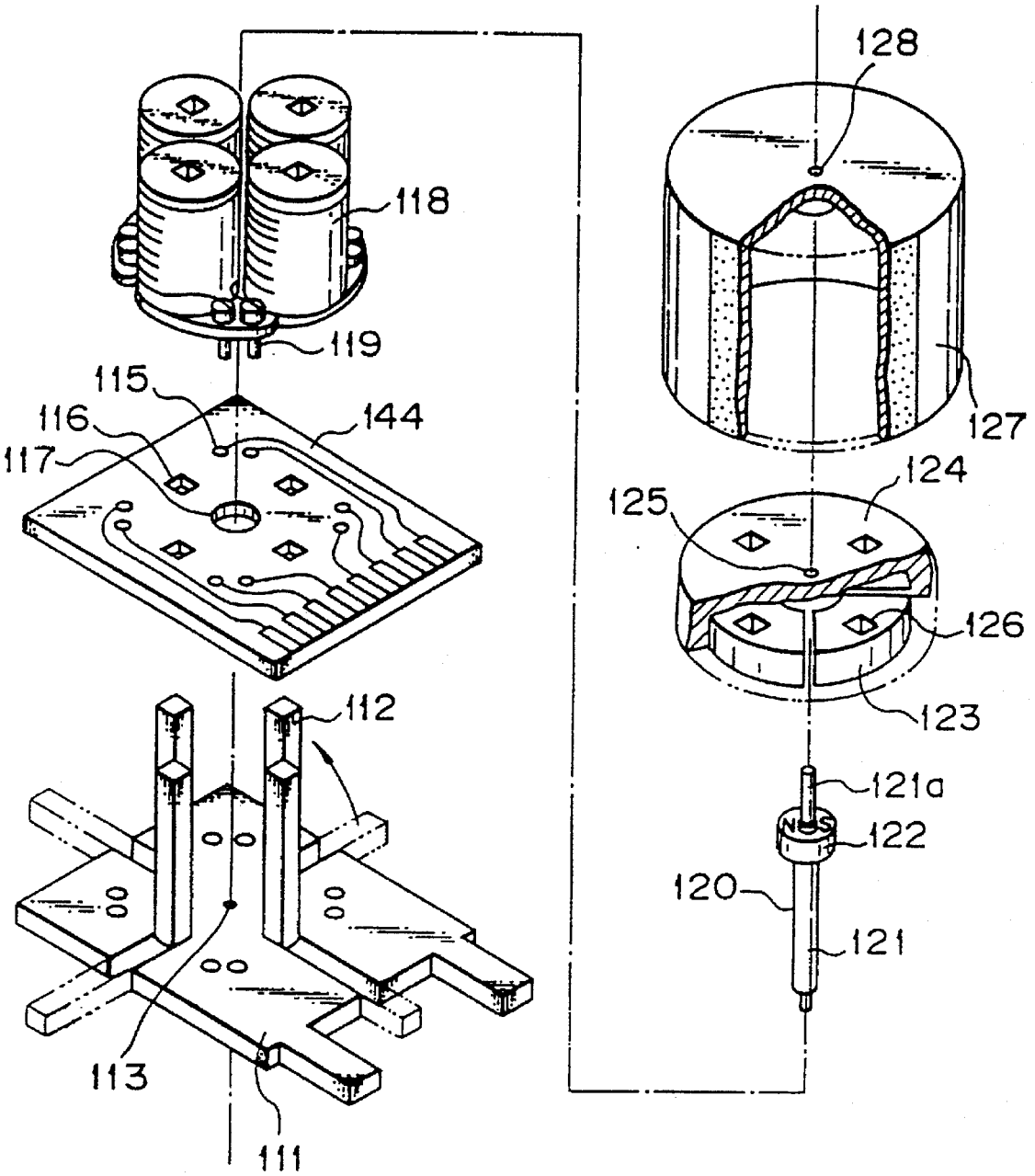
FIG. 24 is an enlarged view showing a multicolor display element according to the invention.

FIG. 24 shows a multicolor display element 103 according to the invention.

Four magnetic cores 112 serving as stators of an electromagnet are formed by bending parts of a magnetic base plate 111 serving as a support frame of the multicolor display element. Four arc stators 123 are fixed to predetermined positions of a stator frame 124. The stator frame 124 is disposed on the electromagnet such that the stators 123 are fitted to the magnetic cores 112, respectively, to form magnetic paths. The stator frame 124 has a bearing hole 125 serving as an upper bearing for a rotary shaft 121.

A plurality of the multicolor display elements 100 thus formed may be arranged to form a multicolor display unit 200. In this case, a row or a column of the multicolor display elements may share a single base plate 111 and a single printed board 144.

The multicolor display element 100 of FIG. 24 will reduce the number of parts and be fabricated by successively assembling the base plate, printed board, coils, stator frame, and multicolor display member one upon another. When a plurality of the multicolor display elements 100 are disposed on a single base plate, the base plate acts as a magnetic neutral point to prevent magnetic interference of the motors.

In FIG. 24, the four magnetic cores 112 are formed by bending parts of the magnetic base plate 111. At the center of the base plate 111 surrounded by the four magnetic cores 112, a bearing hole 113 is formed to receive a lower part of a rotary shaft 121. The printed board 144 has coil terminal holes 115 and predetermined wiring patterns. The printed board 144 also has holes 116 for receiving the magnetic cores 112, respectively, and an escape hole 117 for receiving the rotary shaft 121. The printed board 114 is placed over the base plate 111. Four coils 118 are placed on the printed board 114, to surround the magnetic cores 112, respectively.

The coils 118 are connected to the printed board 114 by directly soldering coil ends to the printed board, or by winding each coil end around a terminal pin and soldering the terminal pin to the printed board.

FIGS. 25(A) to 25(D) show various forms of connecting the coil end to the printed board.

Figure 25A:
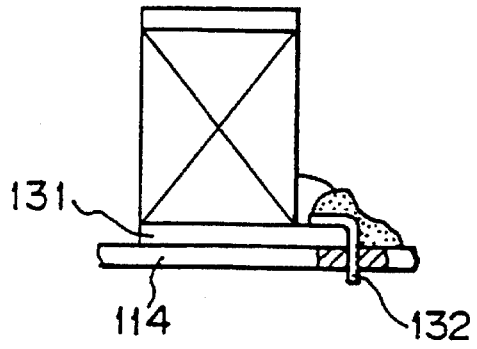
FIGS. 25(A) to 25(D) are views showing methods of connecting a coil to a printed board.

In FIG. 25(A), a terminal 132 is formed on a bobbin flange 131. The coil end is soldered to the terminal 132, and then the terminal 132 is soldered to the printed board 114.

Figure 25B:
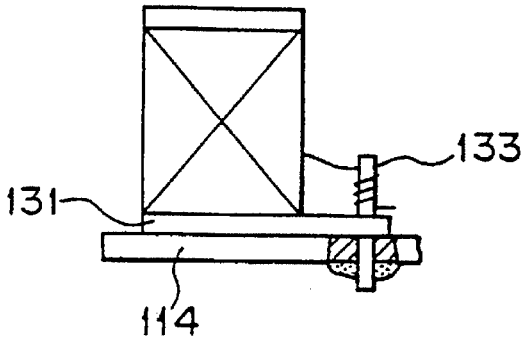

In FIG. 25(B), a terminal pin 133 is formed on a bobbin flange 131. The coil end is wound around the terminal pin 133, and the terminal pin 133 is soldered to the printed board 114.

In these two cases, the coil end is first connected to a terminal of a bobbin. This technique is advantageous in handling the coils during assembly.

Figure 25C:
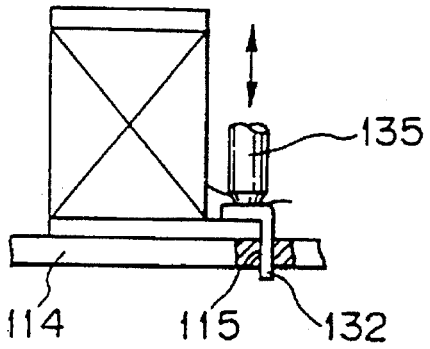
Figure 25D:
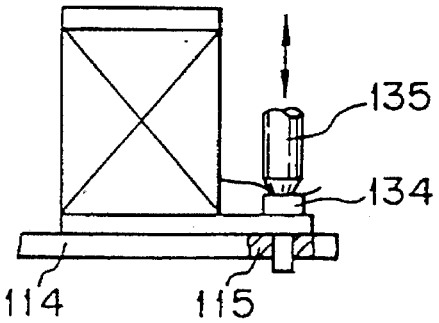

FIGS. 25(C) and 25(D) do not use soldering. A terminal 132 or a terminal pin 134 is formed on a bobbin flange. The coil end is attached to the terminal 132 or terminal pin 134 by a thermal press tool 135, and then the terminal 132 or terminal pin 134 is inserted into the through hole 115 of the printed board 114. This technique is also advantageous. The printed board 114 of FIG. 24 is provided with the through holes 115 for receiving the terminal pins 119 of the coils 118.

Figure 26:
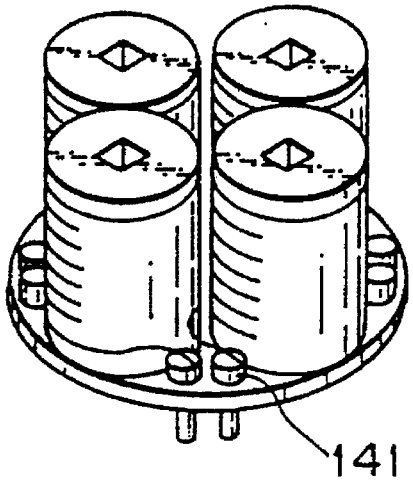
FIG. 26 is a view showing four coils placed on a common bobbin.

FIG. 26 shows four coils placed on a common bobbin 141. This arrangement is easier to assemble.

Figure 27:
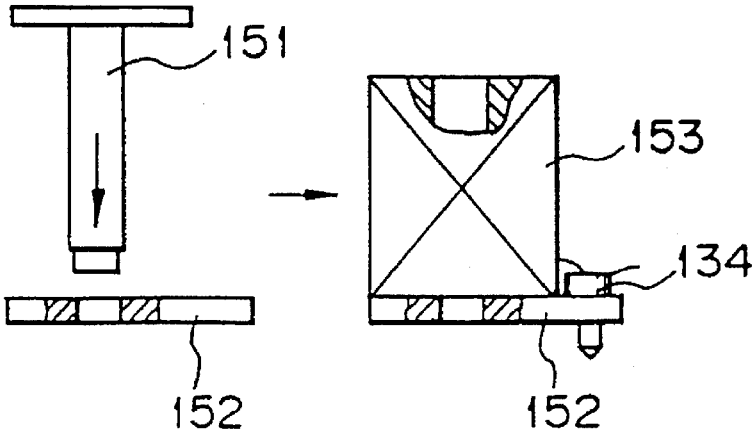
FIG. 27 is a view showing a hollow coil wound with use of upper and lower bobbins.

FIG. 27 shows an arrangement that is advantageous in forming a compact display element with no bobbin. First, upper and lower bobbins 151 and 152 are fitted together, and a coil is wound around them. A thermal press tool is used to thermally fix a coil end to a terminal pin 134 of the lower bobbin 152. The coil is heated so that wax over the surface of the coil melts to solidify the coil. Thereafter, the upper bobbin 151 is removed to make a hollow coil 153. In this case, the diameter of a center hole of the coil is substantially equal to the outer diameter of the magnetic core 112.

Referring again to FIG. 24, the permanent magnet 122 is fixed to the rotary shaft 121, and the lower end of the shaft 121 is inserted into the bearing hole 113 of the base plate 111.

To improve the magnetic characteristics of the step motor, the structure of FIG. 8 arranges the stators of FIG. 9 at the upper ends of the magnetic cores 507. Each stator protrudes to the left and right sides in an arc shape. The four stators are disposed at proper intervals and surround the permanent magnet 509.

According to the embodiment of FIG. 24, however, the coil cannot be installed if each stator protrudes from the magnetic core 112 that is integral with the base plate 111. Accordingly, the magnetic cores 112 and stators 123 are separately prepared, and the four stators 123 are fixed to the stator frame 124. In FIG. 24, the stator frame 124 is partly broken for the sake of explanation. At the center of the stator frame 124, a hole 125 is formed to bear the upper end of the rotor 120. Each stator 123 has a hole 126 to be engaged with the magnetic core 112. The four coils 118 are arranged around the magnetic cores 112, respectively. The stator frame 124 with the stators is placed on the magnetic cores 112. The tops of the magnetic cores 112 are inserted into the holes 126, thereby joining the magnetic cores 112 and stators 123 together. The upper end 121*a* of the rotor 120 is received in the bearing hole 125. In this way, the stator frame 124 holds the stators 123 and supports the rotor 120. The stator frame 124 is made of plastics such as teflon, which is easy to form and has a low friction coefficient. The stators 123 are adhered to or inserted in the stator frame 124.

Each magnetic core 112 may be drawn from the base plate 111, to have a square cross section. The magnetic core 112 may be forged by using of upper and lower molds having semicylindrical recesses, to form a circular cross section. This shape increases the coil winding volume. In this case, the hole 126 in the stator 123 must also be circular.

When the stator frame 124 with the four stators 123 is fitted to the upper ends of the four magnetic cores 112 having the coils 118, the upper end 121*a* of the rotary shaft 121 protrudes from the bearing hole 125 of the stator frame 124. A center hole 128 of the multicolor display member 127 is fitted and fixed to the shaft end 121*a*. This completes the assemble. The multicolor display member 127 is made of, for example, plastics and has color regions painted in a plurality of colors. In the embodiment, the multicolor display member 127 is cylindrical. It may be a polyhedral pipe having flat display faces.

A plurality of the multicolor display elements 103 each having the above-mentioned structure are arranged in a matrix to form a large multicolor display apparatus.

According to the embodiment, the multicolor display elements are collectively arranged on a mother board. A row of the multicolor display elements is arranged on a common base plate 111, and a plurality of such base plates 111 are fitted to the mother board.

In FIG. 4, the mother board 101 involves a plurality of support plates 105, and each of the support plates 105 supports a row of multicolor display members.

Figure 28:
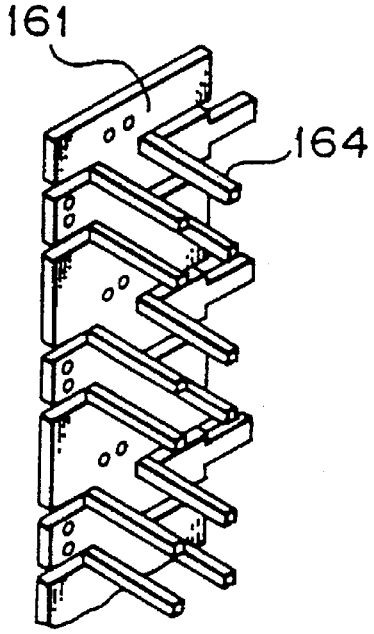
FIG. 28 is a view showing magnetic cores of a multicolor display element according to the invention.
Figure 29:
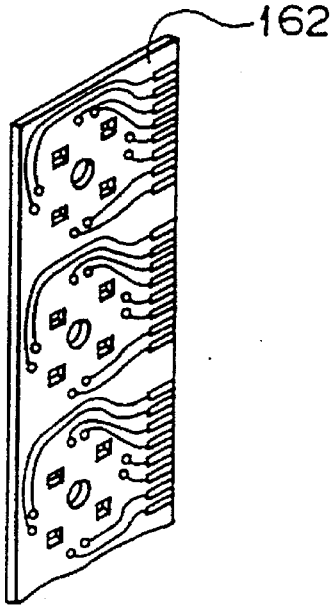
FIG. 29 is a view showing a printed board used for the structure of FIG. 28.

FIG. 28 shows an example of a common base plate 161. A plurality of magnetic cores 164 for a row of multicolor display elements are integrally formed with the base plate 161, with every four magnetic cores 164 forming one multicolor display element. A printed board 162 shown in FIG. 29 is also shared by a row of the multicolor display elements. The common printed board 162 has holes for receiving magnetic cores and rotary shafts, as well as wiring patterns for a row of the multicolor display elements.

The common base plate 105 of FIG. 4 shared by a plurality of the multicolor display elements is advantageous in simplifying the structure and improving the magnetic characteristics of the motors.

Figure 30:
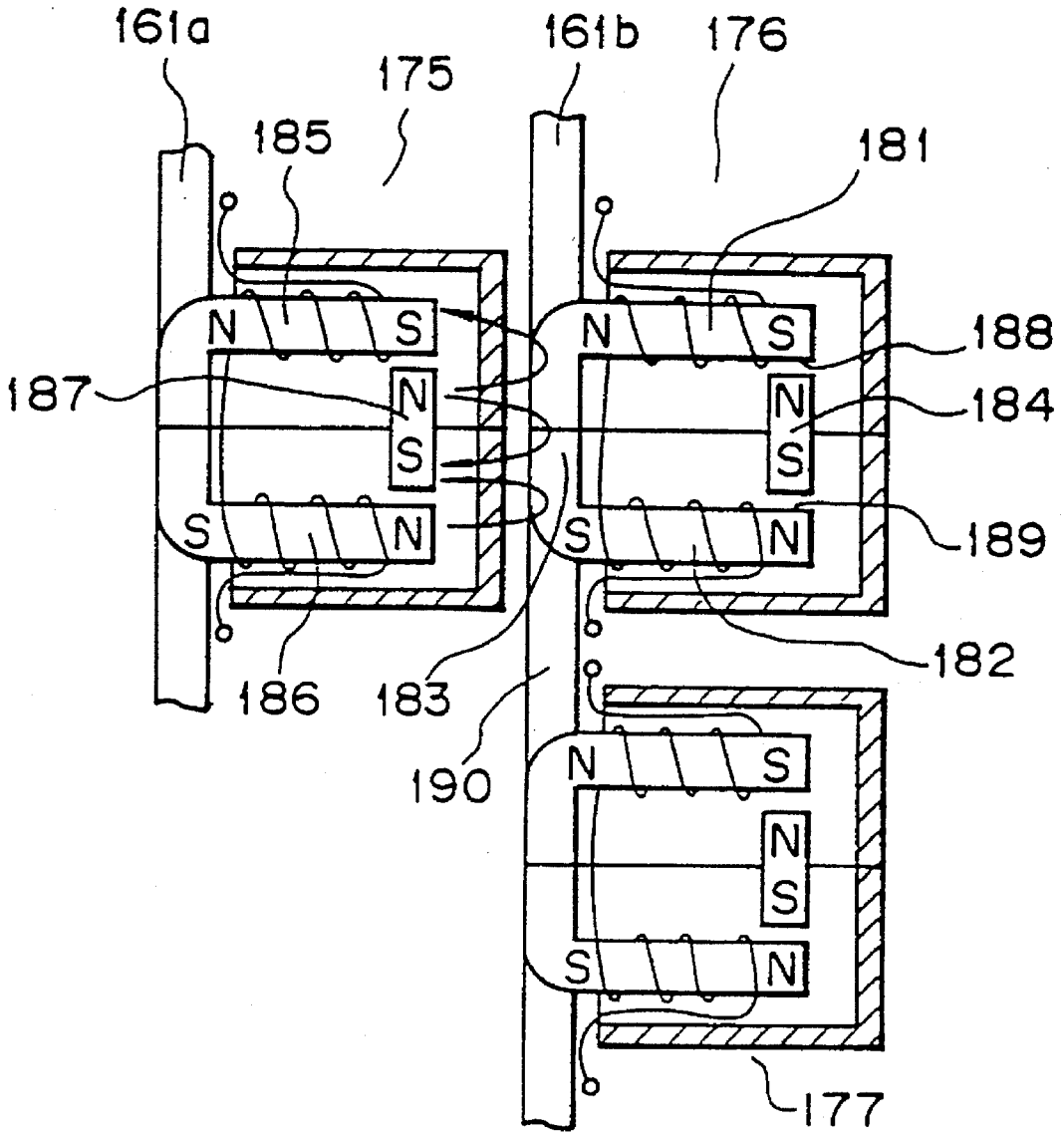
FIG. 30 is a view showing relations of motors of adjacent multicolor display elements according to the invention.

FIG. 30 shows magnetic relations between the multicolor display elements arranged on a common base plate. A multicolor display element 176 is arranged on a base plate 161*b*. A pair of electromagnets 181 and 182 of the multicolor display element 176 are connected to each other through an intermediate base plate portion 183. The base plate portion 183 is located at a magnetic neutral position of a magnetic circuit formed by the electromagnets 181 and 182 and a permanent magnet 184. Accordingly, the base plate portion 183 does not substantially cause flux leakage to interfere with a multicolor display element 175 arranged on an adjacent base plate 161*a*.

On the other hand, gaps between the electromagnets 185 and 186 and permanent magnet 187 of the multicolor display element 175 causes flux to leak, which may enter the base plate portion 183 of the multicolor display element 176 as indicated with arrow marks. This portion 183, however, is a magnetic neutral point of the motor of the multicolor display element 176, so that the flux in the gaps 188 and 189 of the motor of the multicolor display element 176 is not affected by the leaking flux.

The multicolor display elements 176 and 177 are adjacent to each other on the same base plate 161*b*. Since the multicolor display element 176 is integral with the base plate at the magnetic neutral point 183, the magnetic circuit of the multicolor display element 176 is completed with the base plate portion 183 of its own region, electromagnets 181 and 182, and permanent magnet 184. Consequently, the magnetic circuit of the multicolor display element 176 will never affect the adjacent multicolor display element 177 across an intermediate point 190 between the multicolor display elements 176 and 177. In this way, in integrating a plurality of multicolor display element motors and base plates, it is important that each base plate serves as a neutral point of the magnetic circuits of the motors. This arrangement prevents a magnetic interference of the motors, thereby making a magnetic shield of the motors unnecessary and enabling the multicolor display elements to be closely arranged in a matrix.

As explained above, the multicolor display element of the invention can be fabricated by sequentially assembling parts one upon another. Accordingly, it is suitable for automatic assembling. Stators and magnetic cores are separately prepared, so that the stators may have an optional shape suitable for motor characteristics. Four stators are fixed to a stator frame at first, so that the stators may be correctly positioned relative to one another, and gaps between the stators and a rotor are precisely set. This improves the motor characteristics such as torque and braking force.

When arranging the multicolor display elements in a matrix, a row of the multicolor display elements is arranged on a single base plate and a single printed board to form a multicolor display unit. Compared with a method of fitting each multicolor display element on one base plate, the arrangement of the invention greatly reduces the number of parts and manufacturing costs. In addition, according to the arrangement of the invention, a gap between adjacent multicolor display elements may be minimized to densely arrange the elements, thereby improving the aperture factor, i.e., a ratio of an effective display area to a total display area.

The large multicolor display apparatus of the invention can display images at high speed because it comprises the multicolor display units employing the compact multicolor display elements. For the high-speed display operation, it is necessary to swiftly switch colors from one to another. For this purpose, the multicolor display member (rotary member) having a plurality of color regions of each multicolor display element must be precisely and speedily turned for a predetermined angle by a drive means. At the same time, one of the required color regions must be correctly stopped behind a display window of the multicolor display element. Once the rotary member is stopped, its vibration must be suppressed as much as possible.

A drive control system according to the invention can satisfy these requirements.

The operations and positional relations of color regions of the multicolor display element according to the invention will be explained in detail.

The multicolor display member (rotary member) has, for example, a cylindrical shape. The surface of the multicolor display member has, for example, four equal color regions painted in different colors. To display a color on a color region adjacent to a presently displayed color region, the multicolor display member is turned 90 degrees. A color on a color region that is opposite the presently displayed color region can be displayed by turning the multicolor display member 180 degrees. To display a color on a color region oppositely adjacent to the presently displayed color region, the multicolor display member can be turned 90 degrees in an opposite direction, instead of turning it 270 degrees.

A drive control method based on these driving principles for precisely and quickly turning and stopping the multicolor display member will be explained in detail.

This driving method is achieved with the high-speed step motor employed in the multicolor display element shown in FIGS. 8 and 24. Due to the high-speed control method and step motor, the multicolor display unit can successively change colors at high speed without an error. The multicolor display unit of the invention, therefore, consumes low power, has a simple configuration, and is manufacturable at a low cost.

To control the 4-pole step motor, the invention employs an acceleration pulse and a braking pulse, thereby shortening the operation time of the motor. These two pulses may have an intermediate waveform portion between them, to reduce power consumption of the motor.

Gaps between stators and between the stators and a magnet of the step motor can be minimized to reduce the self-holding action, which is characteristic to a normal step motor, nearly to zero. At the same time, the step motor of the invention utilizes rotational resistance due to bearing friction between rotary parts, to balance a rotative force of the self-holding action and suppress vibration when braking the rotor. This improves high-speed operation.

According to the invention, one end of each stator of the motor may have a special shape to cause a magnetic imbalance between the stators, thereby restricting the rotor to turn in only one direction when the rotor turns 180 degrees.

To determine the rotational direction of the rotor and surely turn the same 180 degrees, the invention inserts a phase difference, a voltage difference, or a waveform difference between drive pulses to be applied to the two sets of coils of the motor.

When turning the rotor 180 degrees, the invention may provide each coil of the motor with a pulse for turning the rotor 90 degrees at first, and thereafter, a pulse for turning the rotor another 90 degrees in the same direction, thereby turning the rotor 180 degrees in total.

To detect a turning operation of the rotor, the invention may utilize a counter electromotive force produced by the coils or by additional detection coils. According to the detected force, the invention produces a braking pulse to quickly stop the rotor.

The invention also utilizes the counter electromotive force to detect immobility of the rotor and a deviation from a stop position, and based on the detection, again provide the coils with a drive pulse for correcting the position of the rotor.

One or a combination of the above means enables the step motor to correctly operate at high speed. Accordingly, the step motor can switch colors displayed on the multicolor display apparatus at high speed, to smoothly display characters and graphics on the apparatus. Also, the step motor is able to change images on the display apparatus within a frame time similar to a television system. The display apparatus of the invention, therefore, is capable of displaying animations similar in quality to motion pictures.

Figure 31:
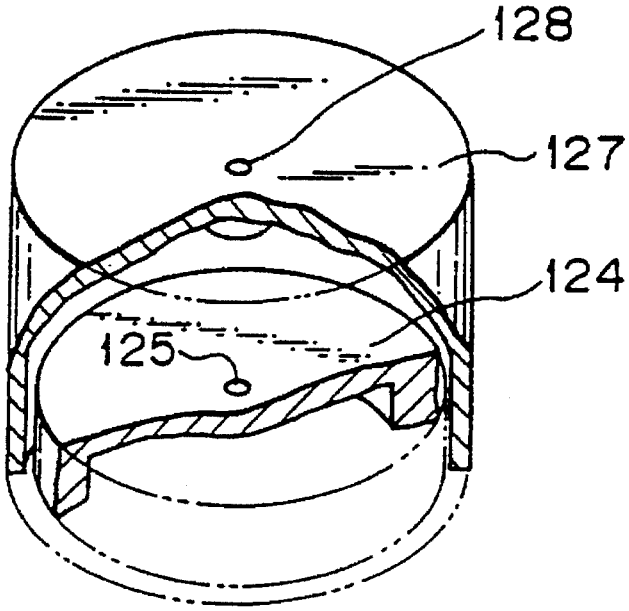
FIG. 31 is an enlarged perspective view showing a multicolor display element according to the invention.
Figure 31:
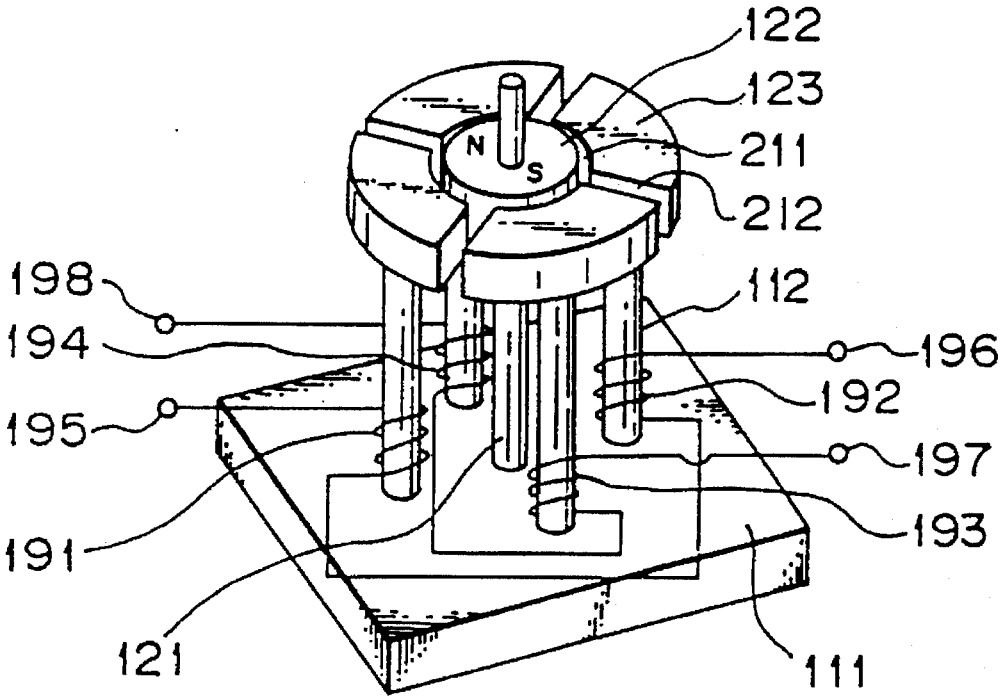

FIG. 31 is an enlarged perspective view showing a multicolor display element employing the step motor of the invention.

In the figure, a base plate 111 is made of magnetic material. Four magnetic cores 112 are uprightly formed on the base plate 111. Stators 123 are connected to the tops of the magnetic cores 112, respectively. The stators 123 surround a magnet 122 with magnet gaps 211 and stator gaps 212 between them. Coils 191, 192, 193, and 194 are wound around the magnetic cores 112, respectively. The opposing coils 191 and 192 are connected in series, and the opposing coils 193 and 194 are connected in series. Coil ends 195, 196, 197, and 198 receive different drive pulses.

A rotary shaft 121 is fixed to the magnet 122. The top of the rotary shaft 121 is passed through a bearing hole 125 of a stator frame 124, and fitted to a center hole 128 of a multicolor display member (rotary member) 127. The cylindrical surface of the multicolor display member 127 is axially painted, for example, four colors. The multicolor display member 127 is turned with the magnet 122, so that the four colors are switched from one to another when viewed from the side of the multicolor display member 127.

The stator frame 124 is a plastic frame for positioning and holding the four stators 123. In the figure, the stator frame 124 and multicolor display member 127 are pulled up for easy understanding. Once they are assembled, the magnet 122 turns inside the stator frame 124, and the stator frame 124 and an electromagnet portion including the magnetic cores 112 with the coils 191 to 194 are received in the multicolor display member 127.

Figure 32A:
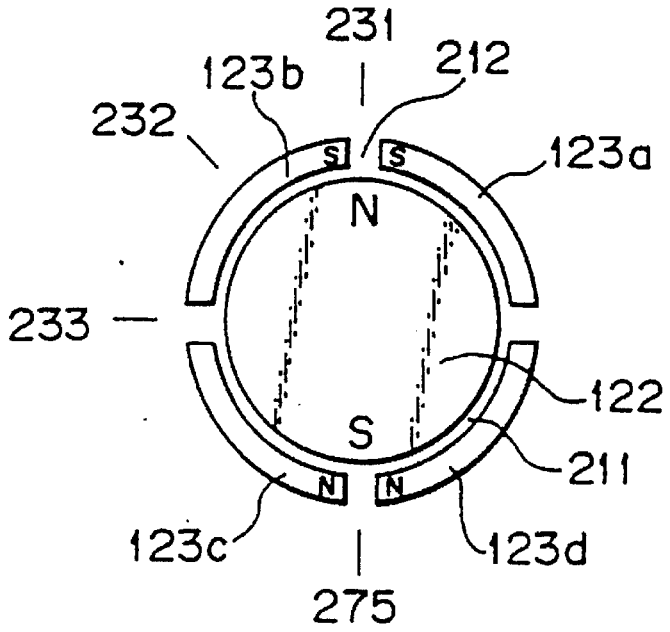
FIGS. 32(A) and 32(B) are views showing a magnet and stators of a step motor.
Figure 32B:
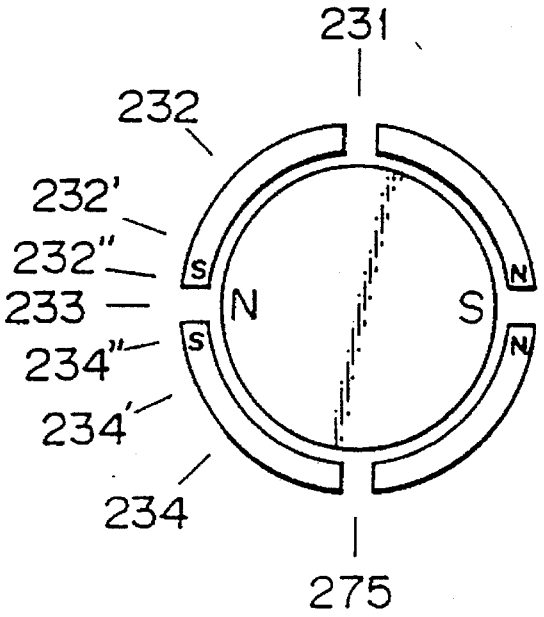

FIGS. 32(A) and 32(B) explain the magnet and stators of the step motor of FIG. 31. In FIG. 32(A), N and S poles of the magnet 122 are stabilized with the four stators 123*a*, 123*b*, 123*c*, and 123*d* being magnetized as shown. To turn the magnet 122 for 90 degrees in a counterclockwise direction, the four stators are magnetized into polarities shown in FIG. 32(B).

Figure 33:
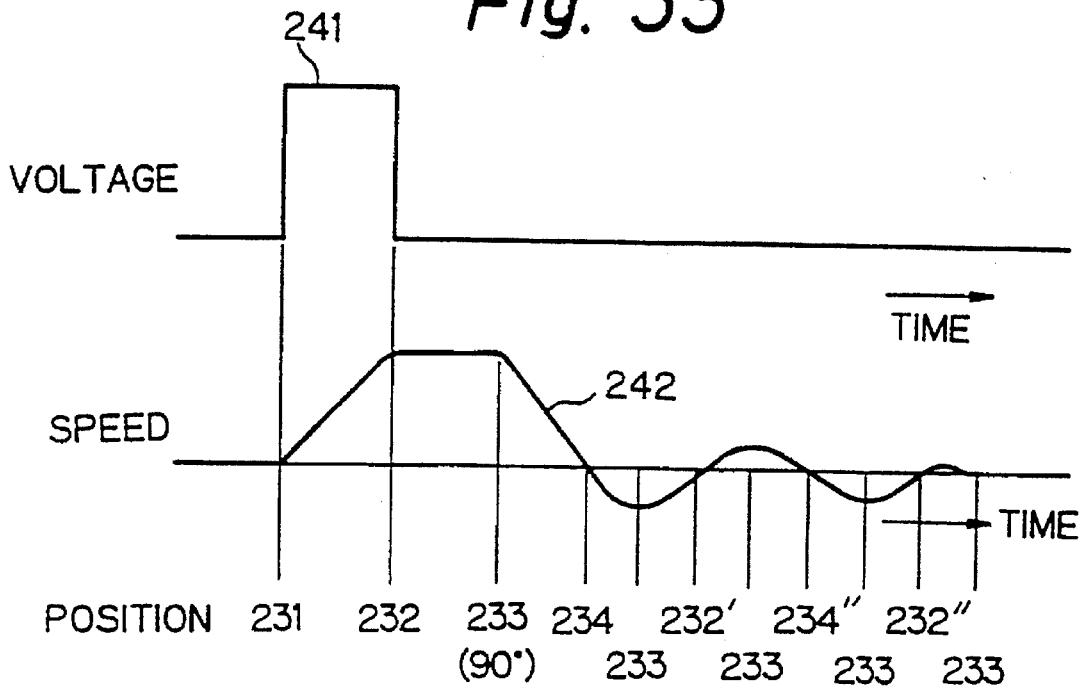
FIG. 33 is a view explaining an operation of the step motor according to a conventional driving waveform.

FIG. 33 explains an operation of the step motor of FIG. 32 driven according to a conventional driving waveform.

Two sets of coils of the motor are driven according to a single pulse 241 to change the polarities of the stators from FIG. 32(A) to FIG. 32(B). The N pole of the magnet 122 is released from a holding force of the stator gap 212 of FIG. 32(A) and oriented in a direction 232, which is inclined about 45 degrees to the left of the original direction 231. Thereafter, an inertial force moves the N pole of the magnet 122 into a direction 233, which is inclined 90 degrees to the left of the original direction 231.

A curve 242 of FIG. 33 indicates a rotational speed (positive in a counterclockwise direction) of the magnet 122 based on the drive pulse 241. When the drive pulse 241 is applied, the N pole is accelerated to start rotating. Even after the drive pulse 241 disappears, the N pole continuously rotates owing to an inertial force produced by the magnet 122 and multicolor display member 127, as indicated on the speed waveform 242. When the N pole is oriented in the direction 233 after moving 90 degrees, the speed attains the maximum owing to an attracting force of the stator gap at the position 233. At this moment, the drive pulse 241 has already disappeared. The N pole of the magnet 122 moves up to a position 234 of FIG. 32(B) owing to inertia, and carries out attenuating vibration around the position 233 as seen on the speed curve 242.

This driving method may be advantageous in reducing power consumption, but not suitable for displaying images at high speed because of the vibration.

Figure 34:
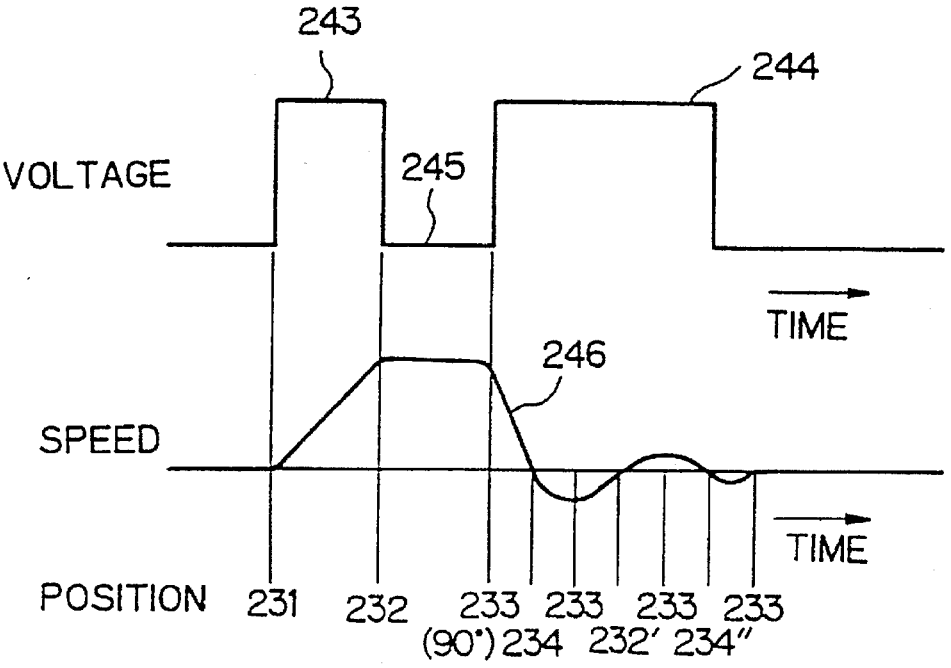
FIG. 34 is a view explaining an operation of the step motor based on a driving waveform according to an embodiment of the invention.

FIG. 34 explains an operation of the step motor according to a driving waveform of the invention.

A brake pulse 244 is applied after an acceleration pulse 243, to suppress vibration and stop the magnet 122 in a shorter time than in the example of FIG. 33. The drive voltage is dropped during a period 245. Even if the drive voltage is zeroed, the magnet 122 and multicolor display member 127 continuously turn because of inertia, to save electric power. The brake pulse 244 rapidly stops the magnet 122 and multicolor display member 127. During the zero voltage period 245, the magnet 122 does not accelerated, so that electric power for the brake pulse 244 can be minimized. The polarity of the driving waveform is set to change the stator polarities of FIG. 32(A) to those of FIG. 32(B). The acceleration pulse 243 and brake pulse 244 have the same polarity.

Figure 35:
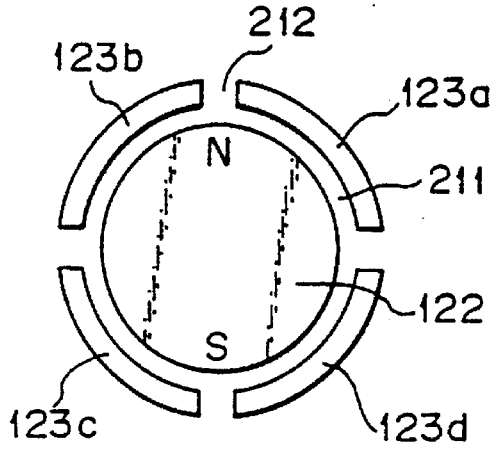
FIGS. 35 and 36 are views showing magnets and stators of conventional step motors.
Figure 36:
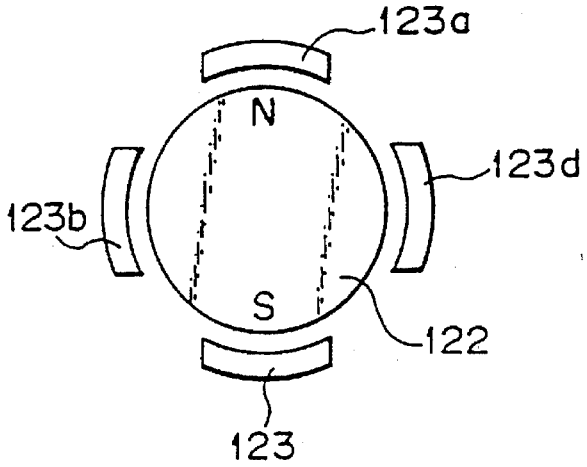

FIGS. 35 and 36 show relationships between stators 123 and a magnet 122 of a conventional step motor. The magnet 122 is stopped at a position that is determined by relationships between the magnet 122 and the stators 123*a*, 123*b*, 123*c*, and 123*d*.

In FIG. 35, a stator gap 212 is wider than a magnet gap 211, so that the N pole of the magnet 122 is stopped by a self-holding force at the center of the stator gap 212.

In FIG. 36, a stator gap is wider than that in FIG. 35, so that the N pole of the magnet 122 is stopped by the self-holding force at a position facing one of the stators 123*a* to 123*d*, instead of the position at the stator gap.

Figure 37:
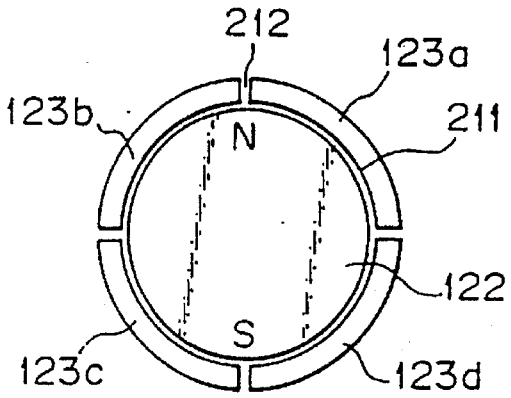
FIG. 37 is a view showing a magnet and stators of a step motor according to an embodiment of the invention.

FIG. 37 shows relationships between stators 123 and a magnet 122 according to the invention. In the conventional step motor, the stators produce a self-holding force for the magnet. In FIG. 37, however, a stator gap 212 is substantially equal to or smaller than a magnet gap 211. This arrangement reduces a self-holding force, so that the acceleration pulse and brake pulse of FIG. 34 can effectively work. When the stator gap 212 and magnet gap 211 are narrowed as small as possible, the self-holding force will be minimized to improve the acceleration and braking actions.

When the multicolor display units are enclosed in a casing having a windshield to prevent an unwanted rotation of the rotary members owing to wind, the self-holding force is not needed. With substantially no self-holding force, a large acceleration force will be generated even if the acceleration pulse 243 of FIG. 34 is weak. If the acceleration pulse 243 is weak, vibration of the magnet 122 owing to the self-holding force will be small and well require a smaller amplitude in the brake pulse 244. As a result, the magnet 122 can be turned and stopped at high speed to display clear images.

Even if the stator gap 212 is reduced, the self-holding force will never disappear if there is a gap. Accordingly, the invention produces rotational resistance by friction, and utilizes it for suppressing the vibration of the rotor caused by the self-holding force. Namely, in FIG. 31, the diameter of a bearing portion of the rotary shaft 121 is enlarged to increase bearing friction due to the weight of the rotor. Alternatively, the cross-sectional heights of the magnet 122 and stators 123 are differently formed to produce an axial magnetic attraction on the stators 123 toward the magnet 122. This attraction pushes a shoulder of the rotary shaft 121 to the edge of the bearing hole to increase friction between them. It is also possible to arrange a small strip of spring serving as a braking member in contact with the rotary shaft 121, so that the rotary shaft 121 is diametrally or axially pushed to create friction.

Through said means, the restitutive force of the rotor owing to the self-holding force will balance the rotational resistance due to the friction. The rotational resistance, which is originally a factor of deteriorating motor efficiency, can be utilized in this way to prevent vibration of the rotor during a braking stage, thereby achieving a high-speed operation required for displaying animations.

Figure 38:
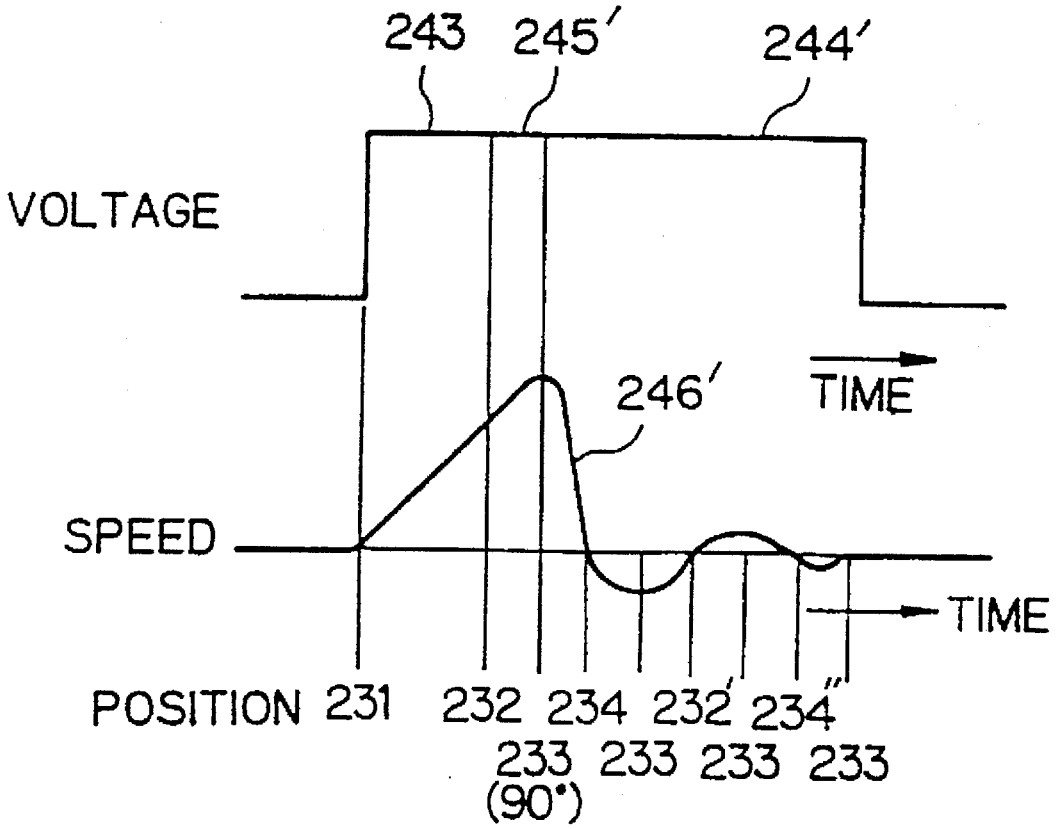
FIG. 38 is a view showing an operation of the step motor based on a driving waveform according the invention.

FIG. 38 shows an operation of the step motor according to another driving waveform of the invention.

This driving waveform does not involve the zero voltage waveform 245 between the acceleration pulse 243 and the brake pulse 244 of FIG. 34. In FIG. 38, an acceleration pulse 243, which usually ends when the magnet 122 turns to the position 232 of FIG. 32(B), continues as an acceleration voltage 245' until the magnet 122 turns to the position 233. Thereafter, a brake voltage 244' is applied to complete the rotation of the magnet 122 within a minimum time. To secure the rotation of the magnet 122, it is preferable to continue the brake voltage 244' until the magnet 122 is completely stopped. The driving waveform of this example will be more effective if used with the step motor of FIG. 37.

Figure 39:
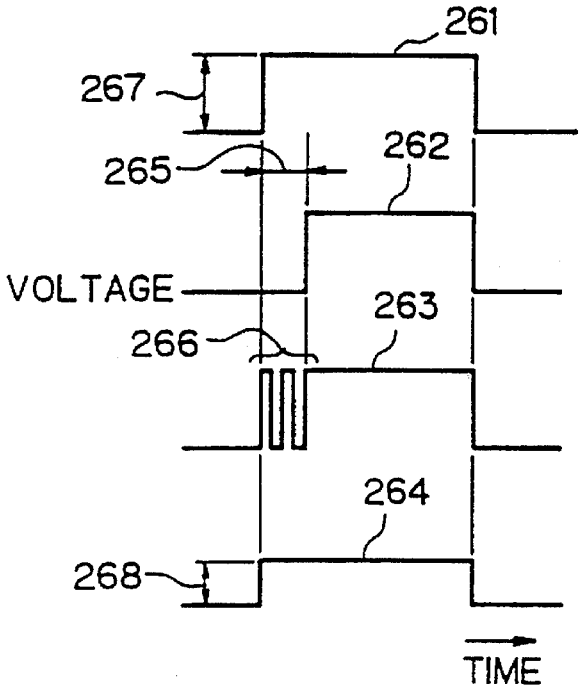
FIG. 39 is a view showing a driving waveform for turning a multicolor display element of the invention 180 degrees in a predetermined direction.

FIG. 39 shows a method of providing a driving waveform that causes a magnetic imbalance in stators, when turning a magnet 180 degrees.

In the figure, a pulse waveform 261 is applied to the coils of the stators 123*a* and 123*c* of FIG. 32(A), and a pulse waveform 262 is applied to the coils of the stators 123*b* and 123*d*. There is a phase difference 265 between the pulse waveforms 261 and 262, so that the two sets of coils are driven with a time difference between them. This causes a magnetic imbalance in the stators, thereby providing the similar effect as with the recessed stators of FIG. 14.

Instead of the phase difference of FIG. 39, other means for causing a difference in driving waveforms may be employed to produce a magnetic imbalance. For example, with respect to the driving waveform 261 applied for one set of coils, an oscillating waveform 266 may be inserted in a driving waveform 263 applied to another set of coils, as shown in FIG. 39. Alternatively, a waveform 264 may be applied to the other set of coils, the waveform 264 having a voltage 268 that is smaller than a voltage 267 of the driving waveform 261. It is also possible to employ a combination of these methods. Through these methods, the magnet is surely turned 180 degrees in a predetermined direction.

Figure 40:
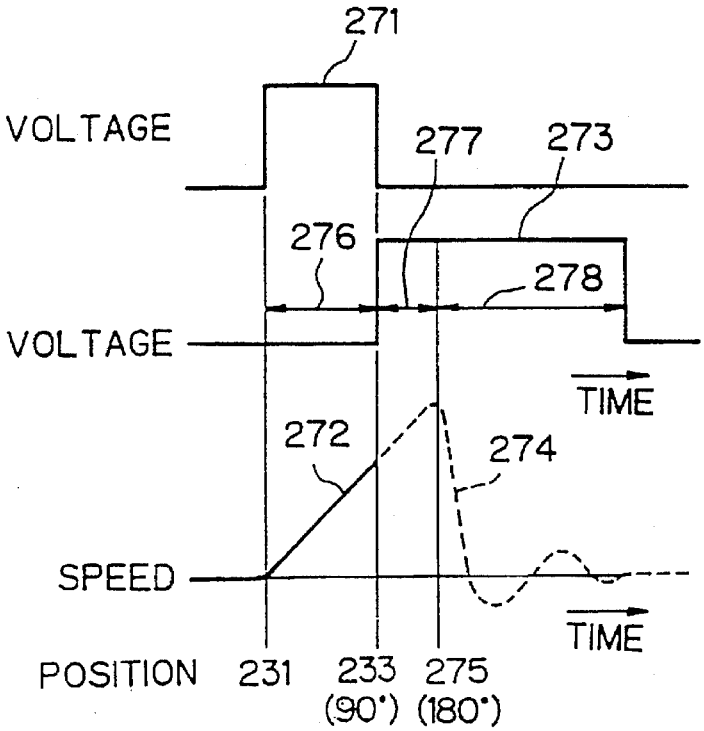
FIG. 40 is a view showing a driving waveform for turning the multicolor display element of the invention degrees in two steps each of 90 degrees.

FIG. 40 shows a driving waveform for turning the motor 180 degrees in two steps each of 90 degrees. A drive wave form 271 is simultaneously applied to the drive coils of the stators 123*a* to 123*d* of FIG. 32(A), to turn the magnet 122 for 90 degrees. The N pole of the magnet 122 turns 90 degrees from the position 231 of FIG. 32(A) to the position 233 in a counterclockwise direction, similar to the case of FIG. 38. This movement is indicated with a continuous line 272 on a speed waveform of FIG. 40. Thereafter, the coils receive a drive pulse 273 of required polarity for another 90-degree turn. This movement is indicated with a dotted line 274 on the speed waveform. The magnet 122 is continuously accelerated until it reaches a 180-degree turned position 275 (FIG. 32(B)), so that the rotational speed further increases as shown in FIG. 40. As a result, the second 90-degree turn is completed within a period 277, which is approximately half a period 276 for the first 90-degree turn. After the period 277, the pulse 273 serves as a braking pulse for a period 278 to stop the magnet 122, similar to the case of FIG. 38. According to this method, the rotor can turn 180 degrees within the shortest period.

Figure 41A:
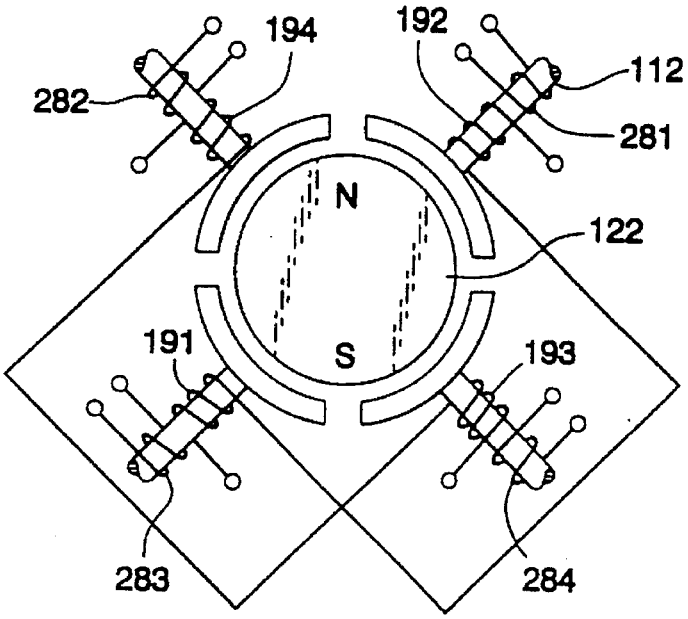
FIGS. 41(A) and 41(B) are views explaining a motor with detection coils.
Figure 41B:
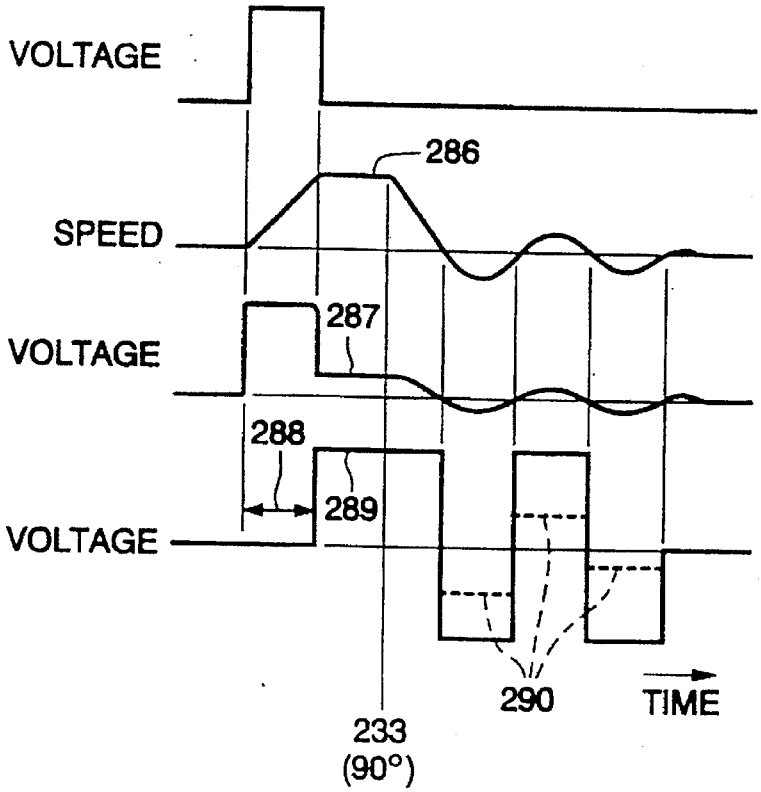

FIG. 41(A) shows magnetic cores of a motor provided with detection coils, and FIG. 41(B) shows drive pulses and operations of the arrangement of FIG. 41(A).

In FIG. 41(A), magnetic cores 112 of the motor have drive coils 191 to 194 and detection coils 281 to 284, respectively. In FIG. 41(B), a magnet 122 inertially turns and repeatedly oscillates after a driving waveform 285 disappears. This state is shown on a speed waveform 286. Since magnetic fields are changed in response to the movements of the magnet 122, a voltage 287 is induced on the detection coils 281 to 284. The induced voltage 287 is proportional to the driving waveform 285 and speed waveform 286. Except a drive period 288, the induced voltage 287 is amplified into a waveform 289, which is applied as a brake pulse to the drive coils 191 to 194. The degree of the amplification may optionally be selected to provide a proper brake pulse as indicated with dotted lines 290.

Although the embodiment of FIG. 41 employs the four detection coils, one detection coil will do. Instead of the detection coils, a counter electromotive voltage on the drive coils is employable. In this case, it is necessary to measure an oscillation frequency in advance.

Figure 42:
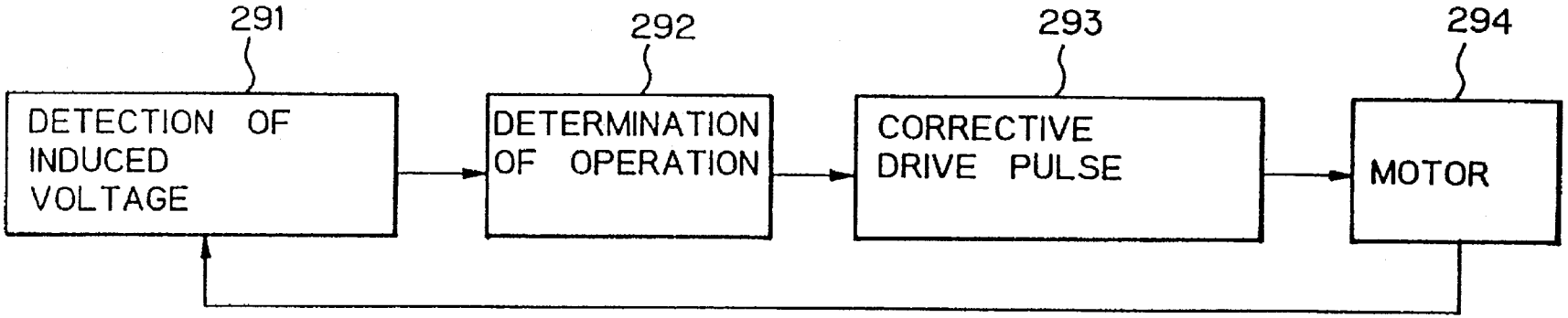
FIG. 42 is a block diagram showing a driving method according to the invention.

FIG. 42 is a block diagram showing a method of driving a motor based on the counter electromotive voltage detected as mentioned above.

This methods monitors the counter electromotive voltage, and upon detecting an abnormal operation, provides a corrective drive pulse. Step 291 detects the counter electromotive voltage. Step 292 determines whether or not the motor is correctly operating. If an abnormality such as a failure of operation occurs, Step 293 provides the motor 294 with a corrective drive pulse. Thereafter, the counter electromotive voltage is again checked.

This method of the invention drives the step motor at high speed and surely stops the motor at a predetermined position. Accordingly, the multicolor display member coaxially attached to the motor can swiftly switch display colors from one to another, to display animations like a television set. This method of the invention is applicable for a high-speed multicolor display apparatus employing a dot-matrix color mixing effect.

Also, the method is effective to remarkably reduce vibration just before the rotary member of the multicolor display element is stopped. The above method, however, cannot completely eliminate the vibration. In particular, when displaying animations, it is difficult for the above method to switch frames from one to another within a short time. This may sometimes blur and deteriorate the quality of the displayed images.

The inventors have developed a driving method that solves this problem and further improves the quality of displayed images. The newly developed method interposes a deceleration pulse between the acceleration pulse 243 and the braking pulse 244 of FIG. 34. This deceleration pulse provides the magnet with opposite torque. According to the method, the rotor is activated and accelerated with the acceleration pulse, rapidly decelerated by the opposite torque given by the deceleration pulse, and stopped by the braking pulse with minimized vibration.

Figure 43:
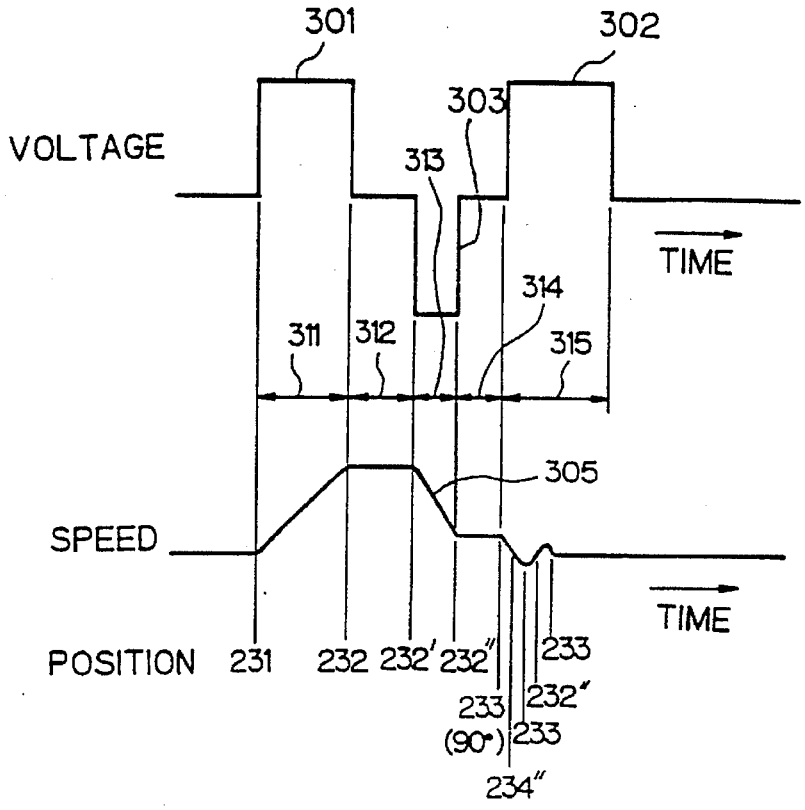
FIG. 43 is a view explaining an operation of a step motor based on a driving waveform according to the invention.

FIG. 43 explains an operation of a step motor according to this method. A deceleration pulse 303 is provided after an acceleration pulse 301, to suppress vibration and stop a rotor of the motor in a shorter time than those in the cases of FIGS. 33 and 34.

In FIG. 43, the polarity of the deceleration pulse 303 is opposite to those of the acceleration pulse 301 and braking pulse 302. Namely, when the magnet is turned 90 degrees in a counterclockwise direction from the state of FIG. 32(A) to the state of FIG. 32(B), the acceleration pulse 301 and braking pulse 302 magnetize the stators 123*a* to 123*d* as shown in FIG. 32(B), and the deceleration pulse 303 magnetizes the stators as shown in FIG. 32(A).

A speed curve 305 is flat in a period 312 in FIG. 43. The N pole of the magnet 122 starts to turn in the counterclockwise direction from the state of FIG. 32(A) and travels to an intermediate position between the positions 232 and 232' of FIG. 32(B) where rotational energy is large due to the inertia of the magnet 122 and multicolor display member 127. Accordingly, the deceleration pulse 303 is applied during a period 313 of FIG. 43, to provide torque for bringing the magnet 122 back toward the original position 231 of FIG. 32(A). Due to this counter torque, the magnet 122 is suddenly braked, and at a position 232" of FIG. 32(B), sufficiently slowed as indicated on the speed curve 305 of FIG. 43. During a period 314, the magnet 122 reaches the target position 233 of FIG. 32(B). Then, the braking pulse 302 of FIG. 43 works to stop the magnet 122 during a period 315. During this period, the N pole of the magnet 122 is suppressed to vibrate so that it may not move over to positions 234' and 234 of FIG. 32(B). The periods 311 to 315 of the drive pulses of FIG. 43 may be adjusted according to the inertia of the rotary members, the strength of the magnet, driving power, etc. For example, the periods 312 and 314 may be omitted.

In the above explanation, the magnet is turned 90 degrees. It may be turned 180 degrees basically in the same manner. For example, the width and voltage of the drive pulse 301 in the period 311 of FIG. 43 can be selected to turn the magnet for the first 90 degrees. The magnet is then turned for second 90 degrees during the period 312 by inertia. Just before the magnet reaches the position 275 of FIG. 32(B) after the 180-degree turn, the deceleration pulse 303 is applied.

Figure 44:
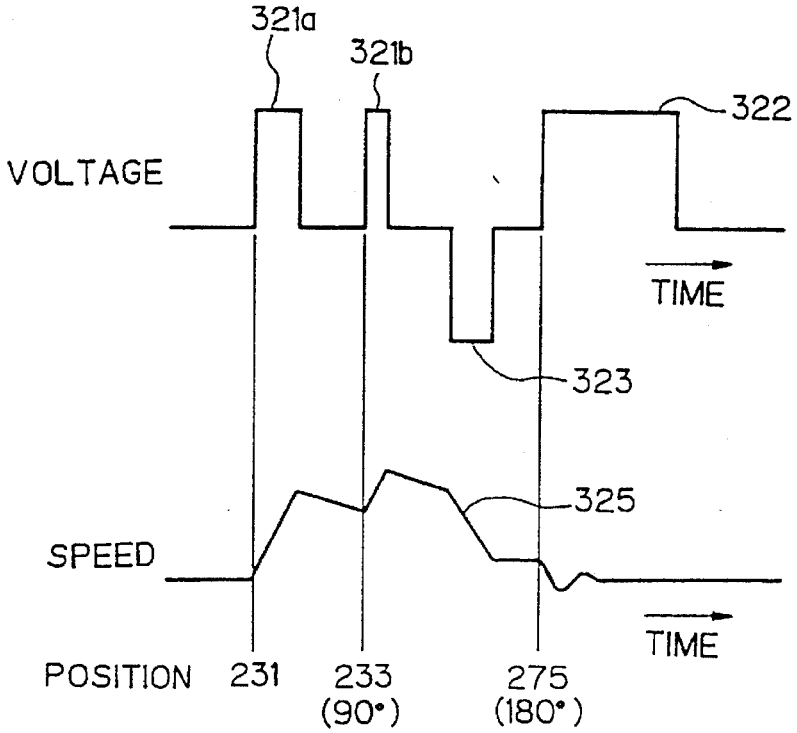
FIG. 44 is a view explaining the operation of a step motor based on a driving waveform according to the invention.

FIG. 44 shows a driving method involving two acceleration pulses 321*a* and 321*b*. These pulses turn the magnet 122 slightly at a speed as constant as possible. Then, a deceleration pulse 323 and braking pulse 322 suppress vibration and stop the magnet. The deceleration pulse 323 may comprise several short pulses whose widths and number are properly set depending on operating conditions.

This method turns and stops the multicolor display member with suppressed vibration, thereby switching displayed colors from one to another in a short time. This reduces switching time in displaying frames of images, increases an image display time, prevents a mixture of unwanted colors, and improves the quality of displayed images, in particular, animations. The deceleration pulse of this method helps narrow the width of the braking pulse, thereby saving electricity.

As explained before, the invention employs a plurality of multicolor display elements to form a multicolor display unit, and with a plurality of the multicolor display units, prepares a large multicolor display apparatus. Accordingly, the large multicolor display apparatus of the invention incorporates tens or hundreds of thousands of the multicolor display elements, which are independently and optionally controlled at high speed. This requires a complicated control means and operations.

According to a conventional large multicolor display apparatus employing many display elements, display control signals are supplied from an outside signal source to the display elements through a large number of lines, which are difficult to prepare and maintain. To solve the difficulty, the inventors have developed a technique to simplify the signal lines between the display apparatus and the signal source.

According to the invention, a plurality of multicolor display elements are arranged in rows to form a multicolor display unit, and a plurality of the multicolor display units are arranged in a matrix to form a large multicolor display apparatus. Each multicolor display unit has an address IC and a plurality of drive ICs. These ICs are connected to a small number of signal lines through which a signal source supplies serial signals with display data to the ICs.

Each address IC stores a specific address indicating the position of the corresponding multicolor display unit in the display apparatus. Each drive IC comprises a circuit for driving coils of motors of the multicolor display elements, and a thinning circuit for suppressing heat of the coils, when colors to be displayed are frequently changed. The multicolor display unit may have a capacitor or a battery for accumulating electricity to be used to simultaneously activate the multicolor display elements.

The serial signal transferred from the signal source to the ICs includes data related to the addresses of the multicolor display units and multicolor display elements in the multicolor display apparatus, as well as data related to colors to be displayed. The serial signal is sent to the address ICs at first. Each address IC checks address data in the signal, and receives its own data only. The address IC sorts the data for colors to be displayed and sends them to the drive ICs, respectively. Each of the drive ICs drives the corresponding multicolor display elements, to display required colors. A frame clear signal is periodically supplied to each of the drive ICs, to correct an erroneous display.

In this way, according to the invention, each multicolor display unit has an address IC and a plurality of drive ICs. The multicolor display unit may include a predetermined number of unit blocks each including a plurality of multicolor display elements, and each drive IC controls the multicolor display elements of one corresponding unit block. In the multicolor display unit, each unit block may comprise a row or a column of multicolor display elements. Also, each unit block of the multicolor display unit may comprise a matrix of multicolor display elements.

In any case, each of the unit blocks is provided with one drive IC, which is controlled by a single address IC provided for every multicolor display unit.

Returning to FIG. 4, the multicolor display unit 200 comprises columns of the multicolor display elements 103. A column C1 of the multicolor display elements 103 are disposed on the support frame made of the base plate 105 and circuit board 502. Columns C1 to C3 of the multicolor display elements 103 are fitted to the mother board 101. The base plate 105 is made of magnetic material. Magnetic cores (not shown) serving as stators of a motor are formed by bending parts of the base plate 105. The display element 103 has a cylindrical surface axially painted in four colors. The multicolor display unit 200 is viewed in the direction of an arrow mark K.

According to this embodiment, 16 multicolor display elements 103 are arranged on one circuit board 502 to form the column C1, and 16 columns C1 to C16 are fitted to the mother board 101. (note, only 3 columns are indicated in FIG. 45) Namely, 256 (16×16=256) multicolor display elements form one multicolor display unit 200.

Figure 45:
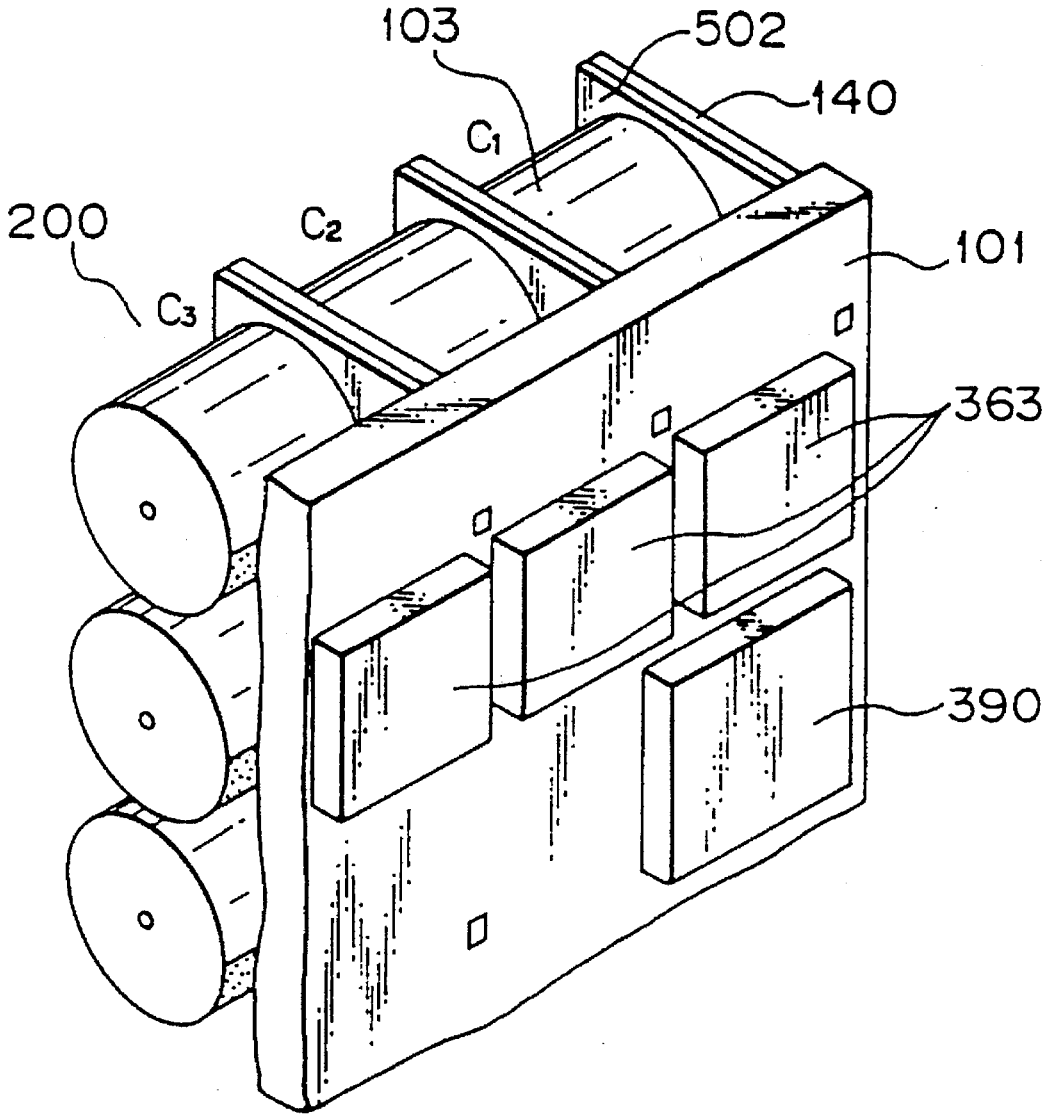
FIG. 45 is a perspective back view showing a multicolor display unit according to the invention.

FIG. 45 is a perspective view showing the back of the multicolor display unit 200 of FIG. 4. The circuit boards of the columns C1 to C16 are electrically connected to the mother board 101. One address IC 390 and 16 drive ICs 363 are disposed on the back face of the mother board 101. One drive IC 363 drives a column of the 16 multicolor display elements 103 on one circuit board 502, so that 16 drive IC2 363 are arranged for the 16 columns. Display data from an external signal source (not shown) are firstly received by the address IC 390, and only data related to the unit in question are distributed to the drive ICs 363, which drive the motors of the multicolor display elements 103 of the respective columns, to display required colors. The ICs 363, 390, etc., are directly mounted on the mother board 101 by means of wire bonding, flip-chip mounting, mini mod, etc. One or a plurality of the multicolor display units 200 are received in a casing having a transparent display face, to protect the motors of the multicolor display members from dust and water.

Figure 46:
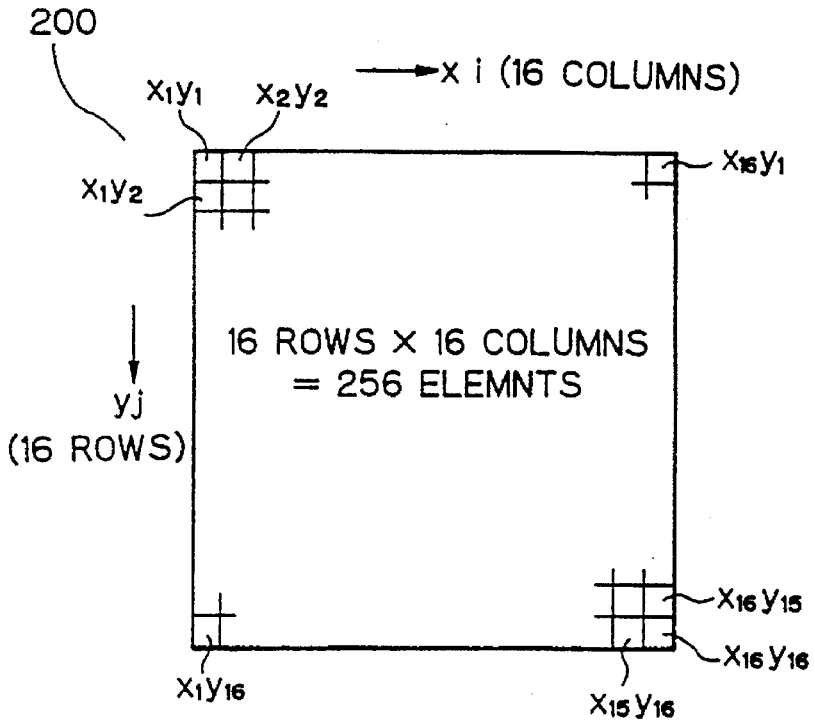
FIG. 46 is a view explaining addresses of multicolor display elements of a multicolor display unit according to the invention.

FIG. 46 shows addresses (Xn, Ym) of the multicolor display elements 103 in one multicolor display unit 200. In the figure, there are 16 rows "x1" to "x16" and 16 columns "y1" to "y16," i.e., 256 (16×16=256) multicolor display elements 103 in one multicolor display unit 200.

Figure 47:
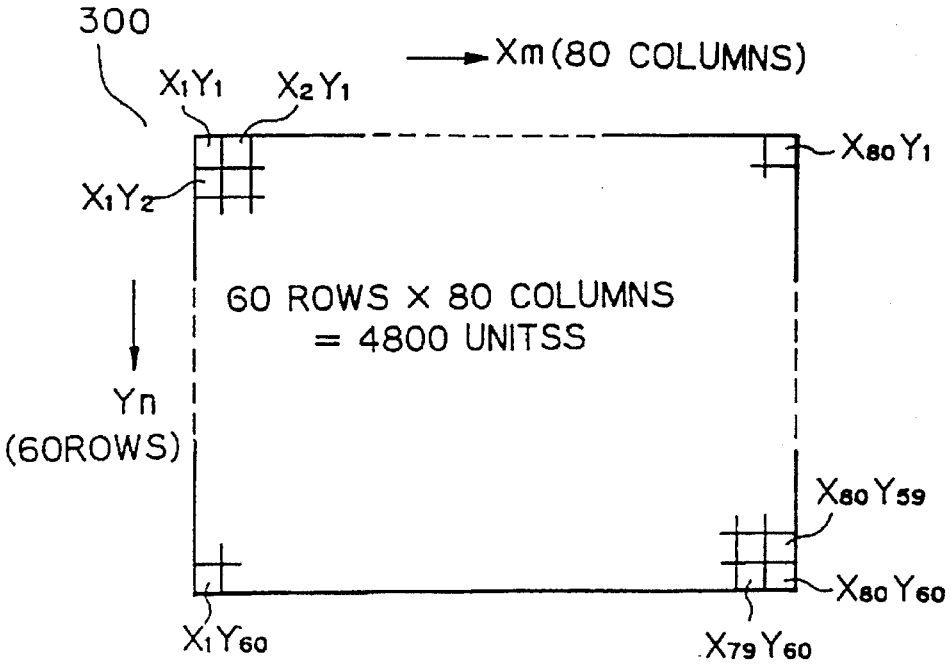
FIG. 47 is a view explaining addresses of multicolor display units of a multicolor display apparatus according to the invention.

FIG. 47 shows a large display apparatus 300 such as a television system for displaying animations. This apparatus 300 comprises a plurality of the multicolor display units 200 of FIG. 46. Each unit 200 is identified with an address (XN, YM). In FIG. 47, there are 80 rows X1 to X80 and 60 columns Y1 to Y60, i.e., 4,800 (80×60=4,800) multicolor display units 200. As shown in FIG. 45, each unit has one address IC 390, so that the display apparatus 300 of FIG. 47 involves 4,800 address ICs 390. Each address IC 390 stores its own specific address (XN, YM). The address IC 390 has a common mask pattern. As shown in FIG. 47, each unit 200 must have a different address corresponding to its own position in the display apparatus 300. Accordingly, the address IC 390 may be made of an erasable MONOS such as an EPROM or EEPROM.

The display apparatus 300 of FIG. 47 is very large with 4,800 multicolor display units, i.e., 4,800 addresses. A simpler display apparatus for horizontally displaying characters for the purpose of advertisement and information, ten horizontally arranged multicolor display units will do. In this case, there are ten addresses from (X1, Y1) to (X10, Y1).

Figure 48:
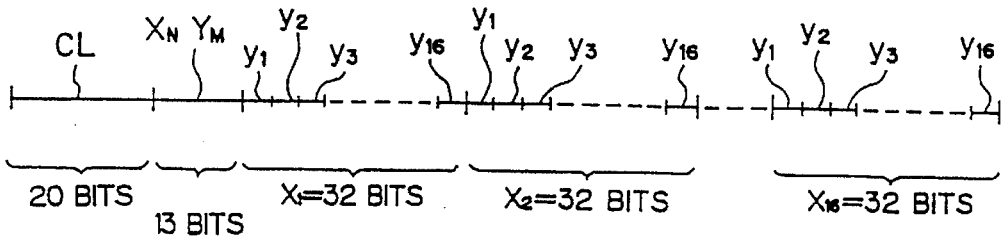
FIG. 48 is a view showing a serial display signal according to the invention.

FIG. 48 shows an example of a serial display signal transmitted from the external signal source to the 4,800 address ICs 390 of the display apparatus 300 of FIG. 47. A synchronous signal CL is, for example, a 20-bit serial signal. A clock generator made of an externally synchronized multivibrator and PLL of the address IC receives the signal CL and reproduces clock signals used by the multicolor display unit 200. Following the signal CL, there are intermittent signals. At first, there is a 13-bit unit address signal xnym for specifying one of the multicolor display units. Following this signal is data for driving the corresponding 256 multicolor display elements 103.

If the signal CL is not used, the signal source must provide clock pulses in addition to the display signal.

In FIG. 47, there are 4,800 multicolor display units 200. The address portion XNYM of the signal of FIG. 48, therefore, may comprise 13 bits to express 8,192 ($2^{13}$=8,192) addresses which are sufficient for covering the multicolor display units 200 of FIG. 47. The following y1 to y16 of the signal x1 are each 2-bit data for specifying one of four colors for one of the corresponding 16 multicolor display elements x1y1 to x1y16 in the column x1 in the multicolor display unit 200 (FIG. 46) identified by the address signal XNYM. Accordingly, the signal x1 is made of 32 (2×16=32) bits. Similarly, each of the columns x2 to x16 involves 32-bit display signal, so that the number of bits required for the 16 columns of the multicolor display members 103 in each multicolor display unit 200 is 512 (32×16=512) bits. Namely, 45 bits in total including the 20-bit synchronous signal and 13-bit address signal form the data necessary for controlling each multicolor display unit 200. This means that the 4,800 multicolor display units 200 of the display apparatus 300 need the following bits in total:

545 bits×4,800 units=2,616,000 bits

For displaying images at a rate of 24 frames per second, like a movie, with this display apparatus 300, it is necessary to supply data at the following rate:

2,616,000 bits×24 frames=62,784,000 bits/sec

This is nearly equal to 63 MHz.

When the display apparatus comprises 10 multicolor display units 200 for the purpose of simple advertisement and information, the apparatus needs the following bits:

545 bits×10 units=5,450 bits

For moving characters at a rate of 16 columns per second, it is necessary to supply data at the following rate:

5,450 bits×16 columns=87,200 bits/sec

This is nearly equal to 10 KHz.

FIG. $4^9$ is a block diagram showing the address IC 390. According to the invention, one address IC 390 is arranged for one multicolor display unit 200, i.e., 4,800 address. ICs 390 in total in the multicolor display apparatus. A data input 330 is a pulse train signal such as one shown in FIG. 48. The first signal CL of the input 330 falls in a passband of a band-pass filter 331, so that the signal CL is passed through the band-pass filter 331 and supplied to a clock generator 332 involving an externally synchronized multivibrator and PLL. The clock generator 332 generates the same clock pulses as those used in the signal source. The address IC 390 operates according to these clock pulses.

Data pulses following the signal CL are removed by the band-pass filter 331, so that they do not affect frequencies generated by the clock generator 332. A 20-bit counter 333 provides a signal indicating a count of the signal CL, to open a gate 334. Then, the 13-bit unit address signal XnYm (FIG. 48) following the signal CL is passed through the gate 334 and stored in a 13-bit latch 338. An address storage 342 is a nonvolatile memory, which stores an address indicating the position of the unit in question in the arrangement of FIG. 47.

A coincidence circuit 340 compares the unit address XMYN contained in the data signal latched by the latch 338 with the address stored in the address storage 342. If they coincide with each other, the coincidence circuit 340 provides a coincidence signal to open a gate 345 to guide data y1 to y16 (FIG. 48) of 32 bits for the 16 multicolor display elements in the column x1 of the multicolor display unit in question, to a 32-bit counter 347 and to a group of gates 355. The coincidence signal is also passed through a gate 351 to increment a 16-bit counter 352.

In response to an output of the 16-bit counter 352, a first gate of the gate group 355 is opened to send the data for the column x1 to a drive IC 363 for driving the column x1. When the 32-bit counter 347 counts all of the 32 bit data, an output signal of the counter 347 is passed through the gate 351 to increment the 16-bit counter 352. Then, according to an output of the counter 352, the next gate of the gate group 355 is opened to send 32-bit data for a column x2 to a drive IC 363 for driving the column x2.

Namely, the 16-bit counter 352 selects, for the first count, the gate for the row x1 among the gate group 355 in response to the coincidence signal provided by the coincidence circuit 340. Thereafter, the 16-bit counter 352 counts outputs of the 32-bit counter 347, to successively select gates for columns x2, x3, . . . , x16 among the gate group 355. In this way, data signals are successively sent to the 16 drive ICs 363.

Whenever any one of the multicolor display units is replaced, the address of the unit in question is written from the outside into the address storage 342 through an address rewrite input 350.

Figure 49:
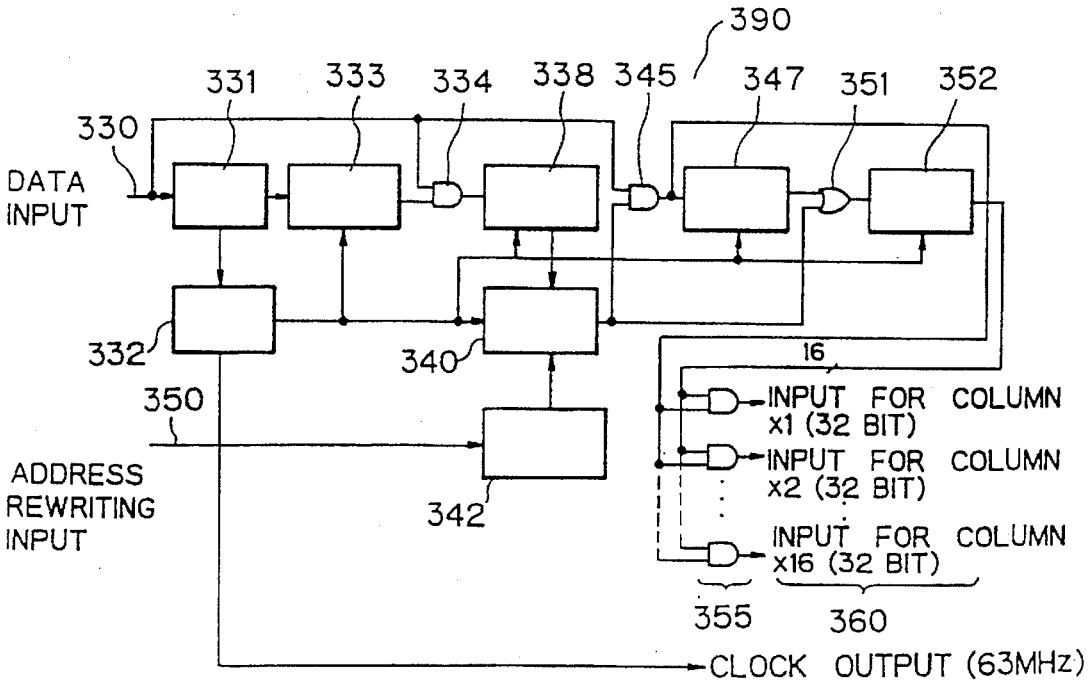
FIG. 49 is a block diagram showing an address IC according to the invention.
Figure 50:
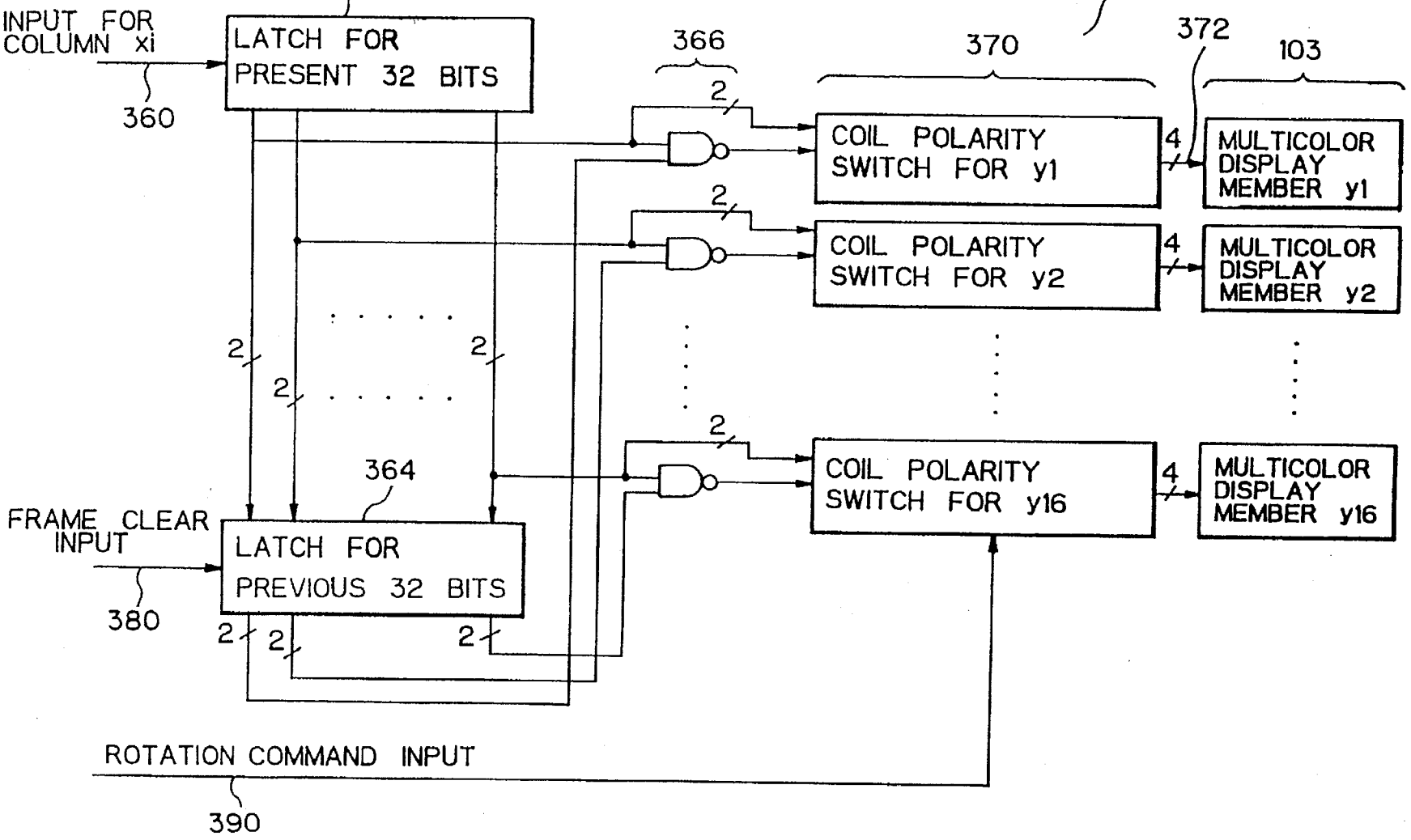
FIG. 50 is a block diagram showing a drive IC according to the invention.

FIG. 50 is a block diagram showing the drive IC 363. As explained before, one drive IC 363 drives a column of 16 multicolor display elements in a multicolor display unit, and in the above example, 16 drive ICs 363 are arranged for 16 columns of the multicolor display elements of one multicolor display unit. In FIG. 50, an xi input 360 is one of the x1 to x16 inputs 360 in FIG. 49, i.e., 32-bit data for a corresponding column of the multicolor display elements, among the data signal selected by the address IC 390. As explained before, every 2 bits indicate one of four colors, and there are 32 bits in total for the 16 multicolor display elements.

The input data are first stored in a present 32-bit latch 362. There is prepared a previous 32-bit latch 364 for storing previous 32-bit data.

A group of NAND gates 366 compares every two bits of the contents of the two latches 362 and 364 with one another. Any NAND gate 366 that finds a coincidence does not provide an output for activating a corresponding coil polarity switching circuit 370 for switching the polarities of the coils of the motor of the corresponding multicolor display element. If the present and previous data coincide with each other, a color to be displayed will not be changed. In this case, the displayed color is kept as it is.

When present and previous data for any multicolor display element do not coincide with each other, a color to be displayed by the multicolor display element in question will be changed. In this case, the corresponding NAND gate 366, i.e., the comparison circuit provides an output signal, which is supplied to a corresponding coil polarity switching circuit 370.

In this way, new data are written in all of the 4,800 multicolor display units. Thereafter, a rotation command input 390 is fed to all of the units. Then, according to the input 2-bit data, each coil polarity switching circuit 370 determines a color to display and provides voltages to four output lines 372 that are connected to one of the corresponding y1 to y16 multicolor display element 103. As a result, the two sets of coils of the motor of the multicolor display element 103 are driven to display the specified color. Except those with no color change, the multicolor display elements 103 simultaneously change their display colors. Thereafter, the contents of the present 32-bit latch 362 are transferred to the previous 32-bit latch 364, to prepare for receiving the next data.

In this way, the present and previous data are compared with each other, and the multicolor display elements with no data change are not activated. This prevents a flickering of screen and conserves power.

If an erroneous operation due to noise, etc., causes an unwanted color to be displayed, and if there is no change in display data for a long time, the unwanted color will be displayed for a long time. To avoid this sort of adverse effect, a frame clear input 380 is supplied, for example, every 10 minutes to stop providing outputs of the previous 32-bit latches 364, thereby activating all of the motors of the 16 multicolor display elements according to the data from the present 32-bit latches 362. This technique corrects the displayed unwanted colors. This operation is performed by sequentially specifying the addresses (XN, YM) and (xn, ym). The frame clear input 380 may be provided from the signal source through an exclusive-use signal line, or inserted in the data signal. A large amount of power will be needed if the 4,800 multicolor display units are simultaneously cleared. Accordingly, the units are cleared sequentially, to conserve power.

Figure 51:
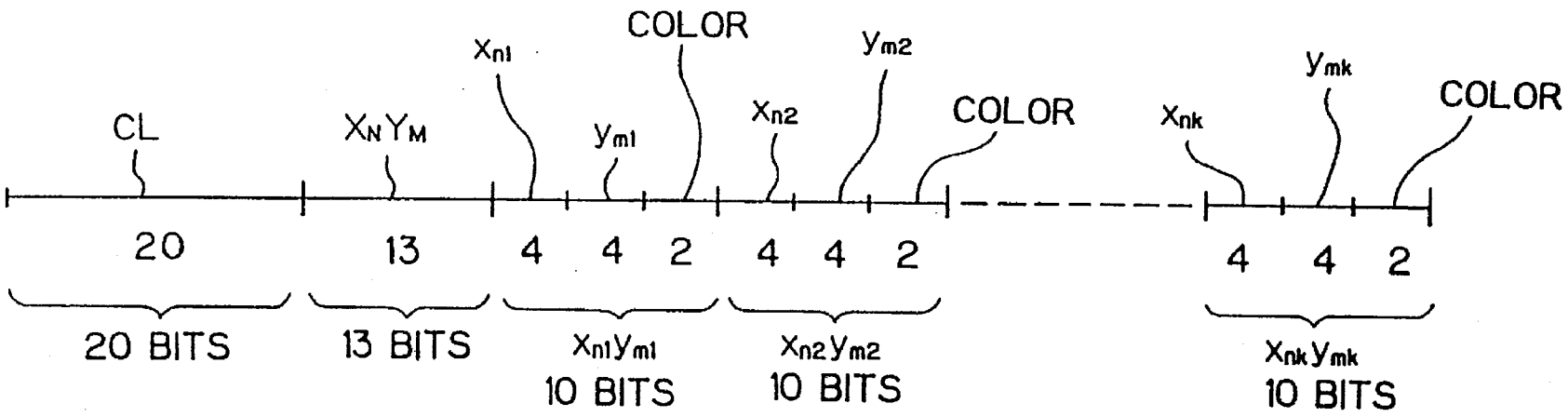
FIG. 51 is a view explaining a serial display signal according to the invention.

FIG. 51 explains another data format according to the invention. This format specifies the addresses and colors of the multicolor display elements of each multicolor display unit. Namely, the signal source selects, for each multicolor display unit, multicolor display elements whose colors are to be changed, and provides each unit address (XN, YM) followed by data (xnl, yml) to (xnk, ymk) in which the data (xn, ym) are the addresses of the selected 256 multicolor display elements in each multicolor display unit, and the lower two bits are for specifying one of the four colors for corresponding selected multicolor display elements. A circuit used for this method is formed by modifying the circuits of FIGS. 49 and 50, so that the details thereof will not be explained. If the number of the multicolor display elements whose colors are to be changed is not so great, this method involves a smaller quantity of bits than the example of FIG. 48 that sends data of all of the multicolor display elements.

Figure 52A:
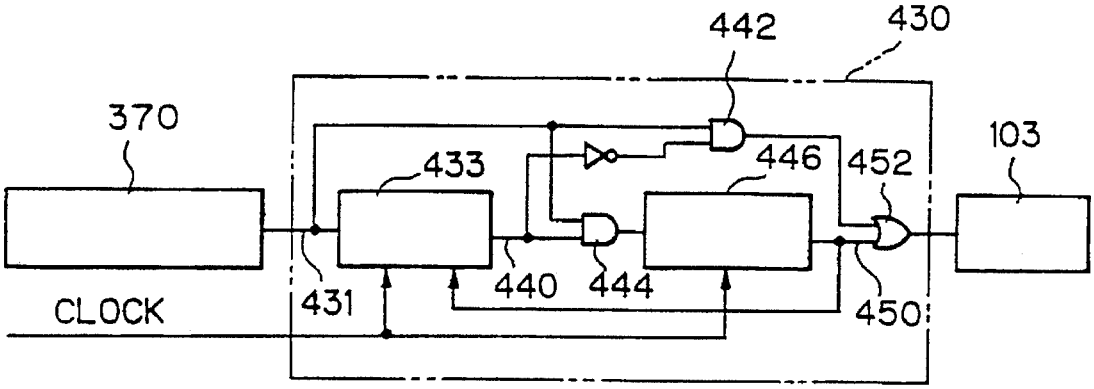
FIGS. 52(A) and 52(B) are views showing a thinning circuit of the drive IC of FIG. 50.
Figure 52B:
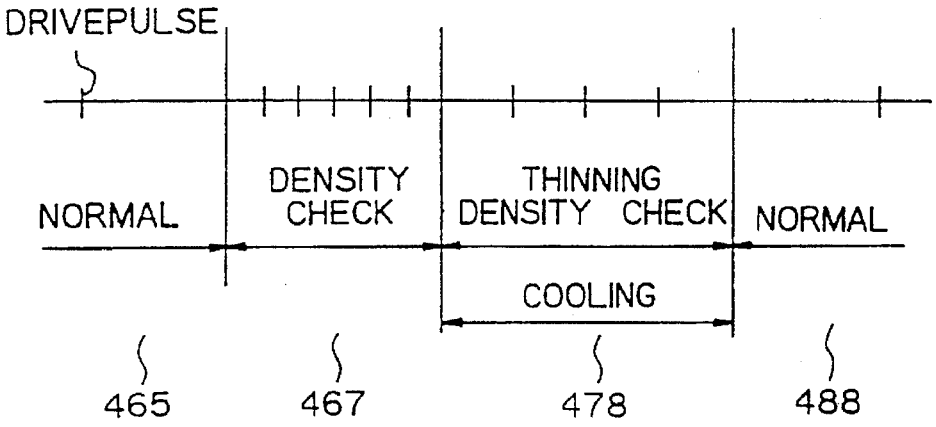

FIG. 52(A) is a block diagram showing a thinning circuit 430 disposed between the coil polarity switching circuit 370 of the drive IC 363 of FIG. 50 and the multicolor display element 103. FIG. 52(B) is a view showing a coil driving output. If the motor of the multicolor display element is frequently operated in displaying animations, the coils of the motor may be heated to a high temperature. In this case, it is necessary to slightly sacrifice the switching frequencies of displayed images by thinning the images to be displayed.

The coil polarity switching circuit 370 provides a coil driving output 431, that is supplied to a timer counter 433. The timer counter 433 monitors the density of the coil drive output in a fixed time. In a period 465, the density is in a range that does not create a heat problem. In this case, the coil driving output 431 as it is drives the multicolor display element 103 through gates 442 and 452. In a period 467, the density increases to a critical level. Then, an output 440 of the timer counter 433 closes the gate 442 and opens a gate 444. Accordingly, the coil drive output 431 is guided to a thinning timer counter 446. The thinning timer counter 446 decreases the density of the drive pulses for a period 478, thereby cooling the coils of the motor. The thinning timer counter 446 may be made of a standard frequency dividing circuit, etc. If the cooling is insufficient, a temperature sensor (not shown) disposed in the vicinity of the motor coils checks it, or the timer counter 433 or another separate timer counter again monitors the density of a thinned output 450, to repeat the thinning process. One of the drive outputs 431 and thinned outputs 450 are passed through the gate 452 to drive the motor of the multicolor display element 103. During the normal periods 465 and 488, the timer counter 433 is reset after the fixed time, and does not provide the output 440.

Figure 53:
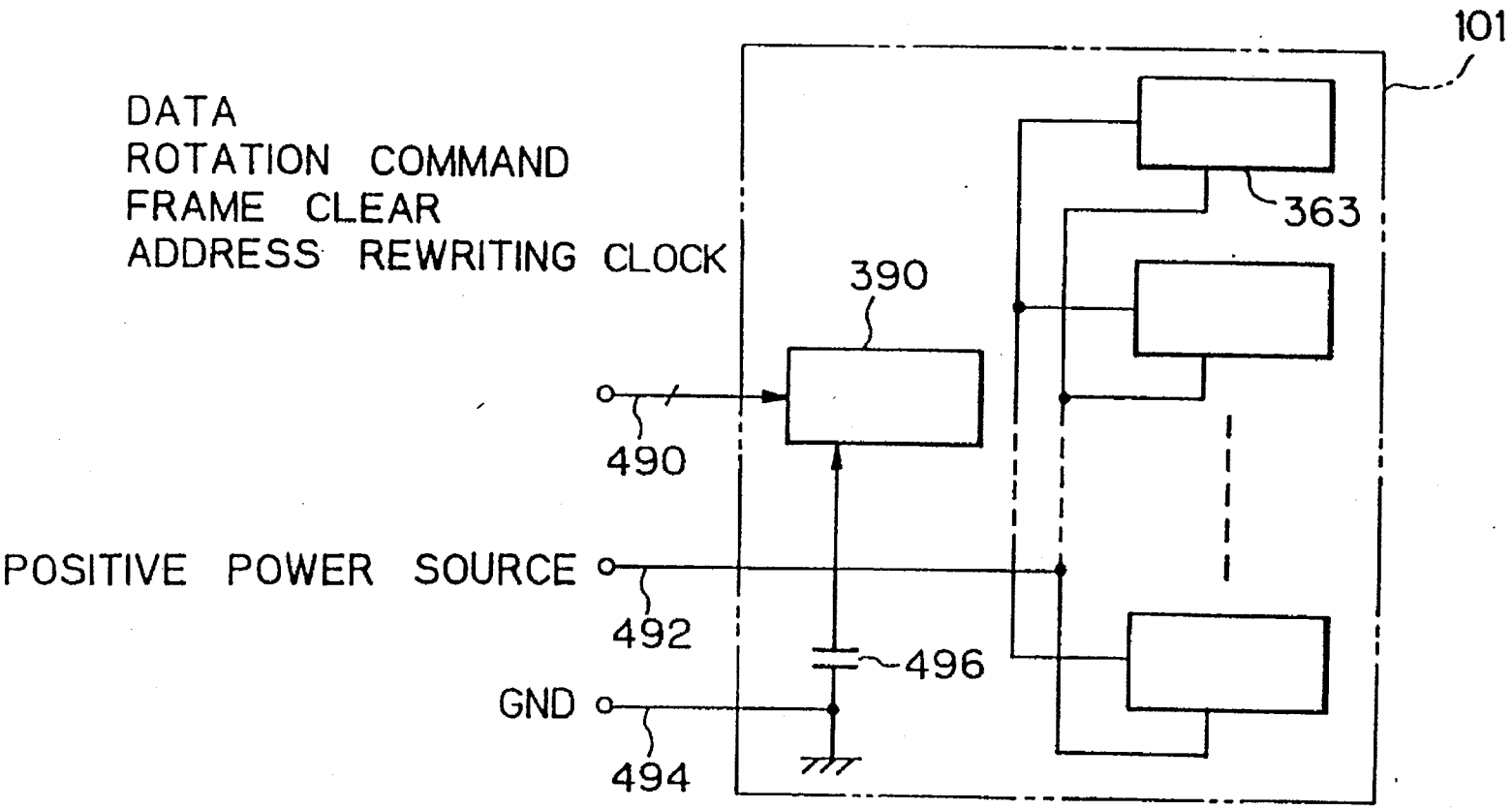
FIG. 53 is a view showing ICs and input signal lines on a mother board according to the invention.

FIG. 53 shows the address and drive ICs on the mother board 101. These ICs are mounted on the back of the mother board 101, as shown in FIG. 45. As explained before, the data, rotation instruction, frame clear, address rewrite, and clock signals are supplied from the signal source to the ICs. These signals may be transmitted through separate signal lines or several common signal lines. In addition to these signals, electricity from a positive power source 492 and GND 494 is supplied to the ICs.

The positive power source 492 is connected to a capacitor 496 disposed on the mother board 101. The capacitor 496 is always charged by the positive power source 492. When a lot of electric power is needed by the drive ICs 363 to simultaneously drive the motors of the multicolor display members 103, the capacitor 496 also provides electric power. Due to the capacitor 496, the capacity of the positive power source 492 may be relatively small. According to the embodiment, the 4,800 multicolor display units 200 require 4,800 capacitors. These capacitors may be collectively arranged on the power supply side. Instead of the capacitors, batteries having a larger buffer effect than the capacitors may be employed.

As explained above, this invention arranges the address ICs and drive ICs on the multicolor display apparatus to provide the apparatus with intelligence. Namely, it is not necessary to directly connect a signal source to respective multicolor display elements. This arrangement is capable of sending addresses and color data as serial signals to control the display apparatus, thereby simplifying connection between the signal source and the display apparatus, as well as the signal source itself. The invention, therefore, improves productivity and reliability, produces easy maintenance, and reduces costs.

The multicolor display unit and multicolor display apparatus according to the invention preferably employ a mask disposed over the front face of a display area. The mask helps to clearly display colors and distinctly separate adjacent colors.

If there is no mask in front of each multicolor display element 103 in the multicolor display unit 200 of the multicolor display apparatus 300, as shown in FIG. 4, colors adjacent to a displayed color may be observed from the outside.

Figure 54:
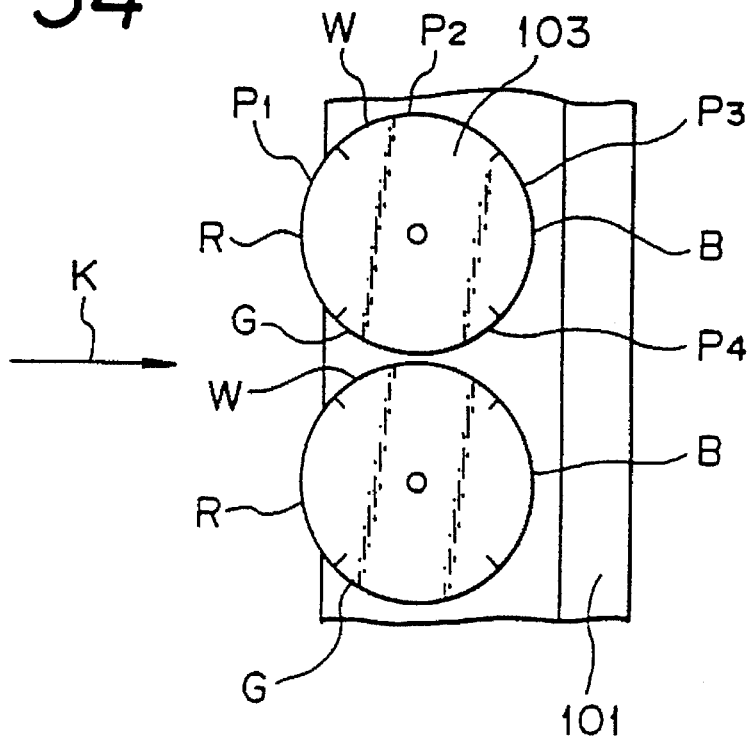
FIG. 54 is a side view showing cylindrical multicolor display elements of a multicolor display unit according to the invention.

FIG. 54 is a side view showing two multicolor display elements 103. Each of the elements 103 is displaying red (R). In this case, green (G) and white (W) adjacent to the red (R) are seen through a gap between the two multicolor display elements 103, thereby deteriorating the contrast of the display apparatus as a whole.

Figure 55:
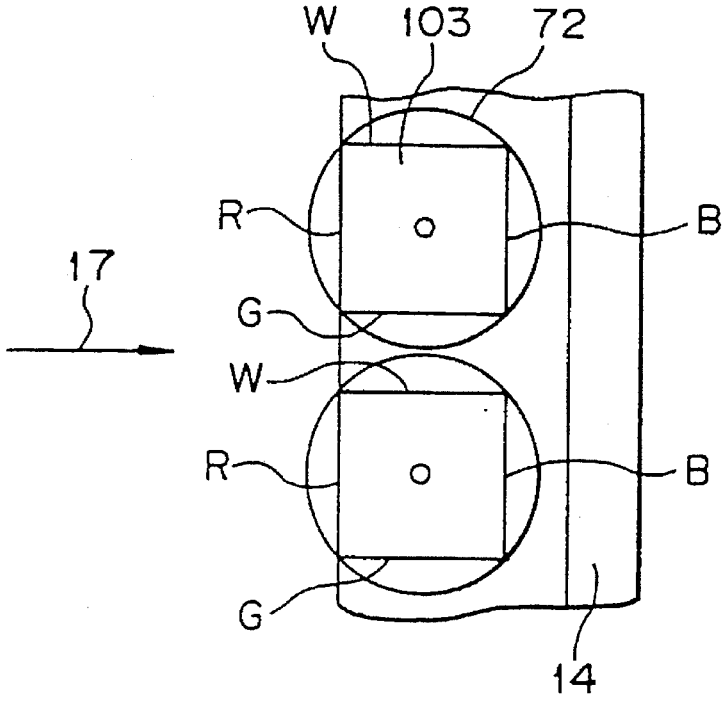
FIG. 55 is a side view showing cubic multicolor display elements of a multicolor display unit according to the invention.

In FIG. 55, each of the multicolor display elements 103 has a cuboid shape with flat color regions. Adjacent multicolor display elements 103 are sufficiently separated from each other to be freely turnable. Namely, the elements 103 are disposed such that the circumscribed circles 72 of the adjacent multicolor display elements 103 do not interfere with each other. As a result, the surface of the mother board 101 disposed behind the multicolor display elements 103 is visible through gaps between the elements 103. In addition, from an oblique direction, the green (G) and white (W) are also visible to deteriorate the quality of displayed images.

Figure 56:
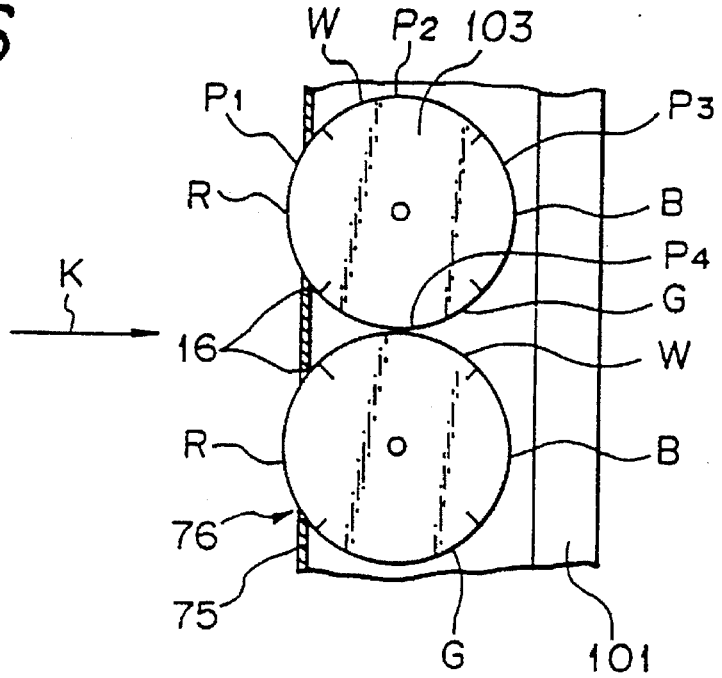
FIG. 56 is a side view showing cylindrical multicolor display elements with a mask according to the invention.

To solve these problems as shown in FIG. 56, the invention arranges a mask 75 having many windows 76 in front of the multicolor display apparatus 300 or the multicolor display unit 200 including a plurality of the multicolor display members 103. The windows 76 are configured to show the multicolor display elements 103, respectively. The solid portion of the mask 75 covers the mother board 101 and side faces of the multicolor display elements 103, thereby concealing unwanted colors.

FIG. 56 is a side view showing an embodiment of the invention. In the figure, each of the cylindrical multicolor display elements 103 is painted in four colors, i.e., red (R), green (G), blue (B), and white (W). A mask 75 is disposed to cover gaps between adjacent multicolor display elements 103. The colored region to display each of the multicolor display elements 103 is preferably protrudes from a corresponding window 76 of the mask 75. This is advantageous in terms of the quantity of light irradiating the color region and an angle of visibility.

Figure 57:
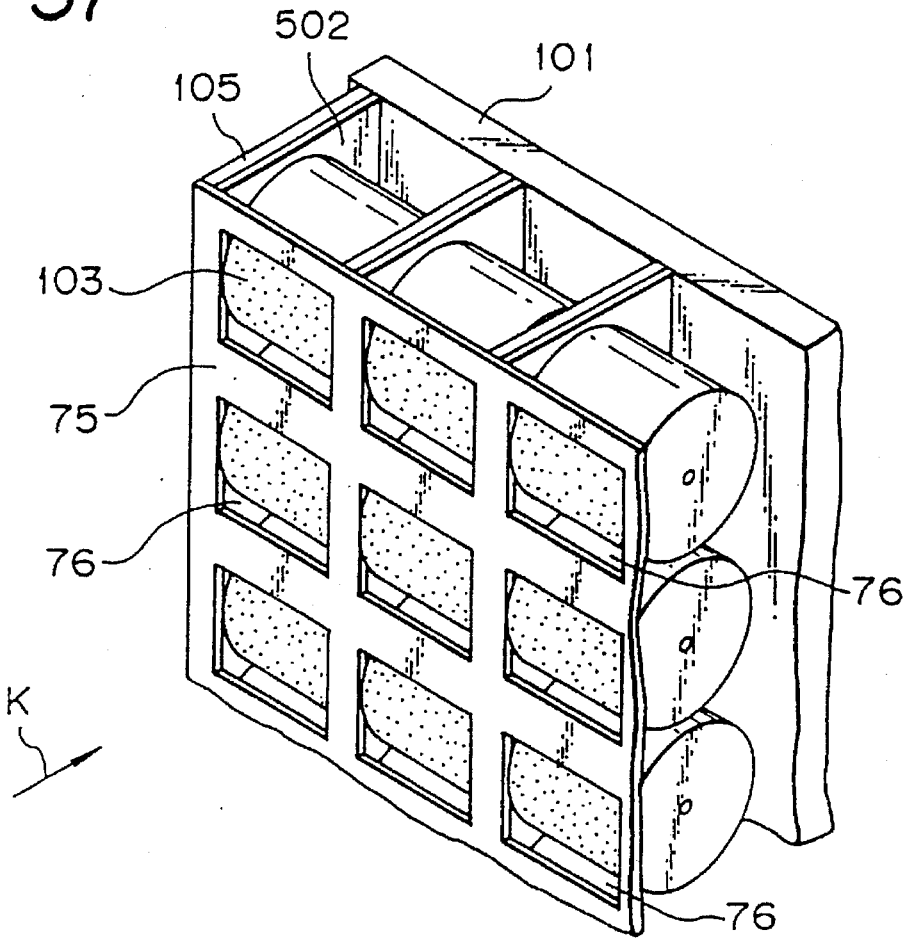
FIG. 57 is a perspective view showing a multicolor display unit with a mask according to the invention.

FIG. 57 is a perspective view showing the display apparatus with the mask 75 of FIG. 56. The mask 75 is formed in a matrix. The size of each window of the mask 75 depends on the size of a corresponding multicolor display elements 103.

Figure 58:
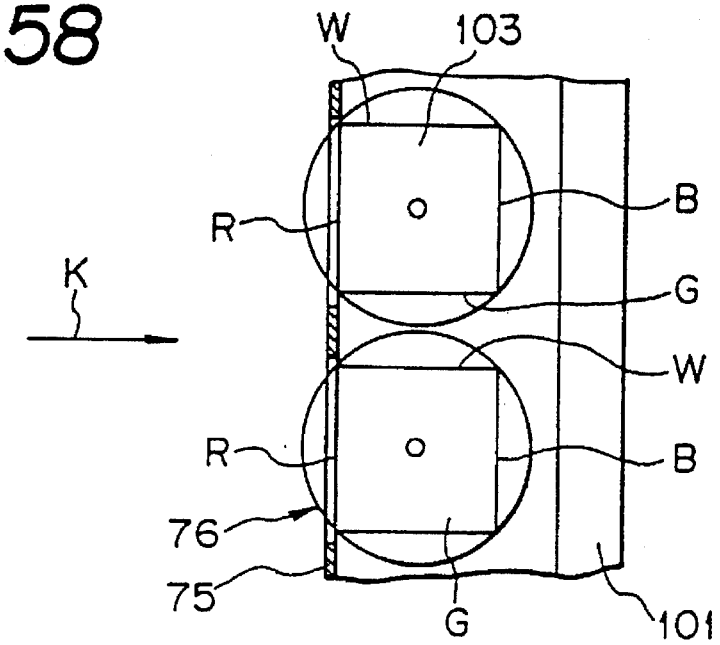
FIG. 58 is a side view showing cubic multicolor display elements with a mask according to the invention.

FIG. 58 is a side view showing multicolor display elements 103 each having a cuboid shape. A mask 75 is arranged in front of the elements 103.

Figure 59:
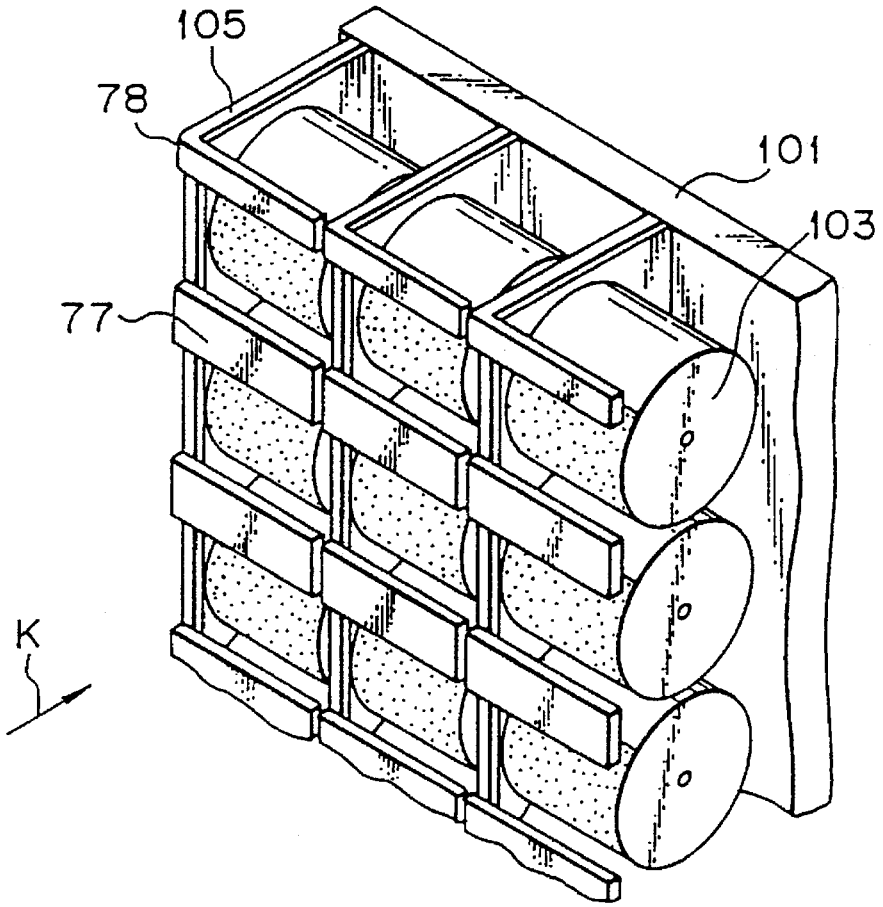
FIG. 59 is a perspective view showing a multicolor display unit with masks integral with a base plate, according to the invention.

FIG. 59 shows a mask that is not an independent structure, according to the invention. A portion 77 is bent from a base plate 105, to form a mask portion for covering a gap between corresponding multicolor display members. An end face 78 of the base plate 105 also serves as a mask for covering a part of a mother board 101. This structure reduces the number of parts and costs.

In the above embodiments, it is preferable to paint the mask 75 in a single color. When one of the colors painted on the multicolor display elements 103 are used as a background color in displaying characters and graphics, the mask is preferably painted in the background color to provide a vivid background. When the colors of the multicolor display elements 103 are variously combined and additively mixed, it is preferable to paint the mask 75 in black.

Next, a protective structure for the multicolor display apparatus 300 and multicolor display units 200 according to the invention will be explained.

The multicolor display apparatus 300 and multicolor display units 200 are installed indoors or outdoors in public view. The apparatus 300 and units 200, therefore, are always exposed to light, heat, dust, rain, wind, snow, salt, etc. It is necessary, therefore, to provide the apparatus 300 and units 200 with some protective means. Otherwise, the rotary portions, drive means, control circuits, etc., of the multicolor display elements 103 may fail to immobilize. In addition, ultraviolet rays may change and deteriorate the colors painted on the multicolor display elements 103. Also, components of the apparatus 300 and units 200 may break and corrode and malfunction.

In FIGS. 3, 6, 16, and 17, the invention packs a group of the multicolor display elements 103 in the sealed casing 106 to protect them.

A new sealed casing having extended functions according to the invention will be explained.

A dustproof and waterproof casing 106 according to the invention is provided with an ultraviolet ray filter and heater wires. The casing 106 prevents dust and water from entering the multicolor display units 200, the ultraviolet ray filter prevents deterioration of the colors of the multicolor display members, and the heater prevents freezing.

The protective casing according to the invention will be explained with reference to FIGS. 60, 61, and 62.

Figure 60:
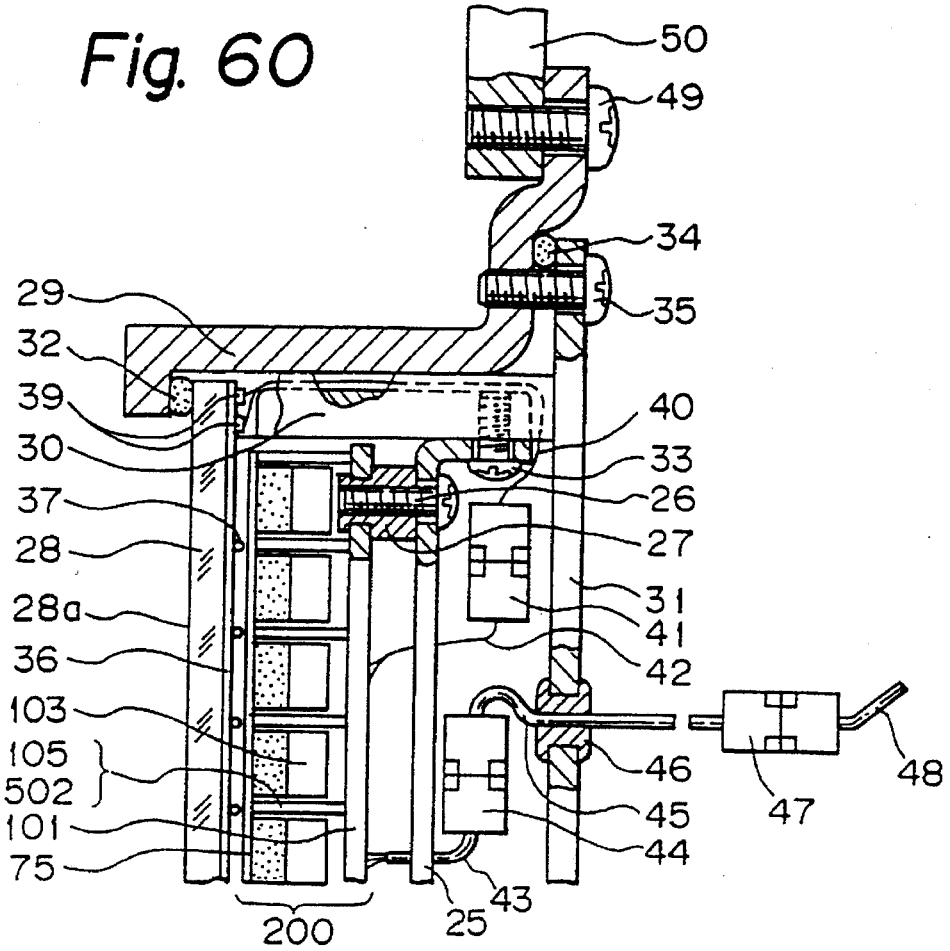
FIG. 60 is a sectional view showing a multicolor display unit disposed inside a casing according to the invention.
Figure 61:
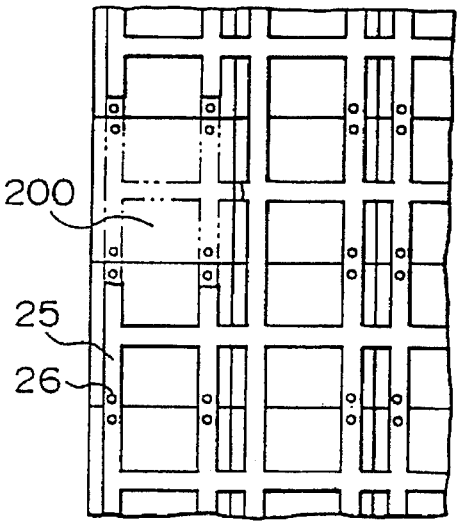
FIG. 61 is a back view showing multicolor display units fitted to a support frame according to the invention of FIG. 60.

In FIG. 60, a plurality of the multicolor display units 200 are fitted to a support frame 25 with screws 26 and bushes 27. FIG. 61 is a view seen from the right-hand side of FIG. 60, showing the support frame 25 and multicolor display units 200. The support frame 25 is formed in a matrix. The protective casing mainly comprises a transparent windshield 28, an outer frame 29, and a back panel 31. The support from 25, to which multicolor display units 200 are fitted, is fixed to an inner frame 30 with screws 33. Packing 32, the windshield 28, and the inner frame with the support frame 25 bearing multicolor display unit 200 are disposed in the outer casing 29. The back panel 31 is fixed to the outer casing 29 with screws 35 through packing 34. The windshield 28 has a coarse outer face 28*a* to prevent reflection of external light. An ultraviolet ray filter 36 is arranged over the inner face of the windshield 28 to prevent ultraviolet rays from changing the colors of the multicolor display elements 103. Heater wires 37 are arranged on the inner face of the windshield 28.

Figure 62:
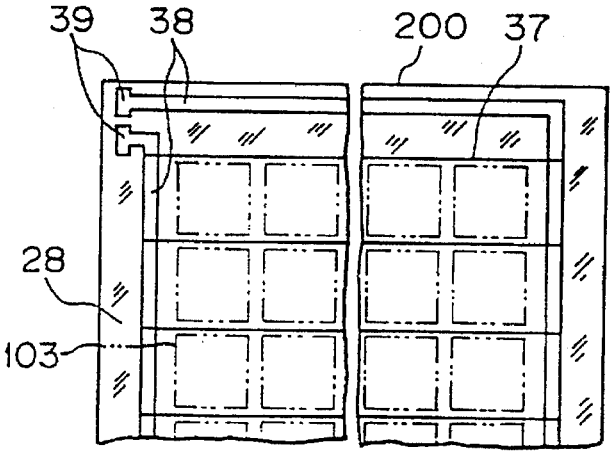
FIG. 62 is a plan view showing heater wires disposed on an inner face of a windshield of FIG. 60.

FIG. 62 shows the inner face of the windshield 28. The heater wires 37 are arranged between low resistance common lines 38 and between the multicolor display elements 103 so that the heater wires do not bother the display elements 103. Wires 40 from heater terminals 39, a connector 41, and wires 42 are connected to power source lines of the mother board 101. The heater wires 37 may be arranged over a mask 75, instead of over the inner face of the windshield 28. The mask 75 itself may be made of resistive heating material or a surface heating sheet, without using the heater wires.

In this way, the multicolor display apparatus 300 comprising a plurality of the multicolor display units 200 is received in the sealed casing. A cable 43, connector 44, and cable 45 from the mother board 101 of each multicolor display unit 200 are passed through a waterproof ring 46 disposed on the back panel 31, and connected to an external power source/signal line 48 through a waterproof connector 47. The multicolor display apparatus received in the casing is fitted to an outer wall 50 with screws 49.

Figure 63:
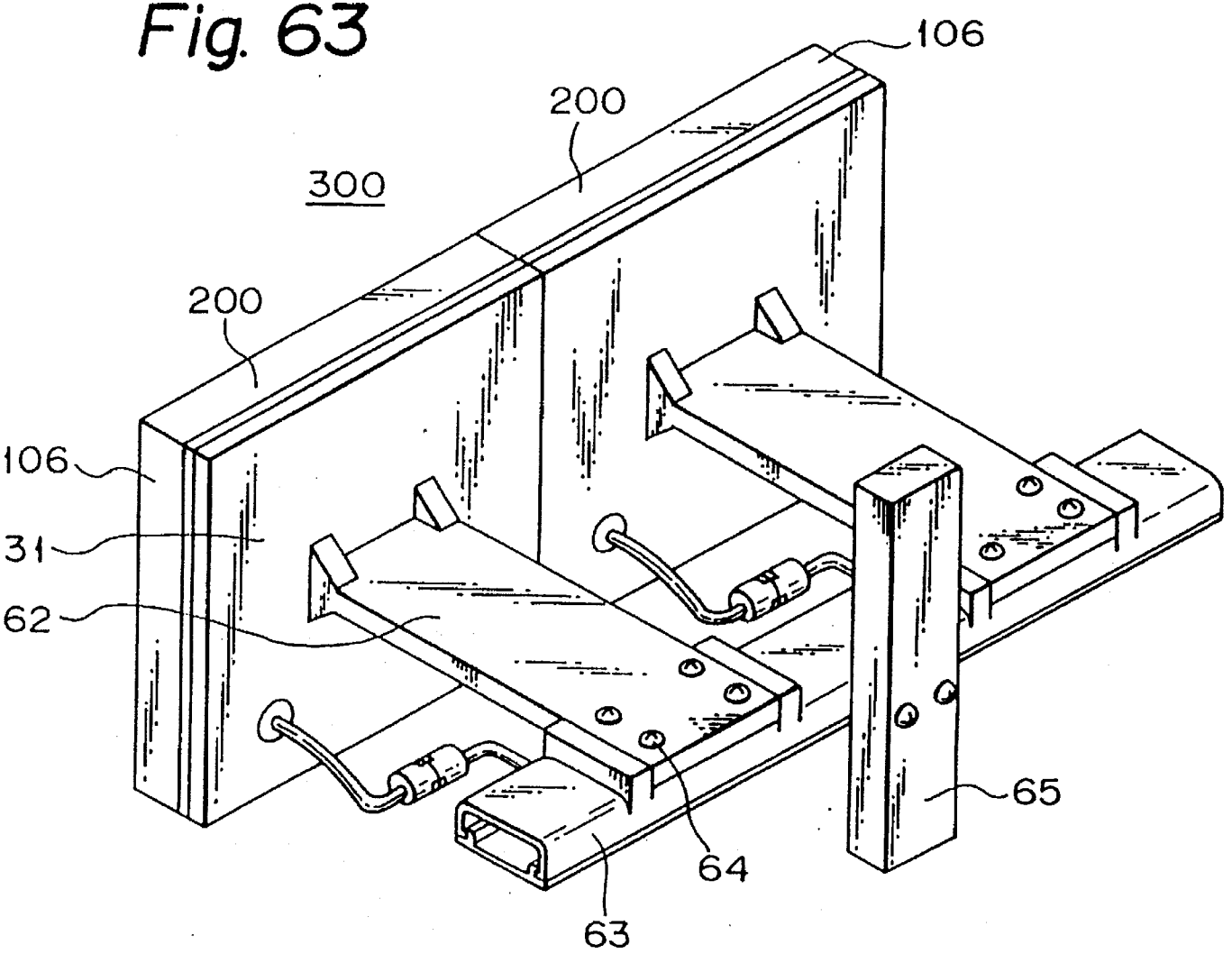
FIG. 63 is a perspective view showing casings fitted to a support frame according to the invention.

FIGS. 63, 64, 65(A), and 65(B) show a sealed casing according to another embodiment of the invention. FIG. 63 is a perspective view showing the back of a multicolor display apparatus 300 according to the embodiment. Each of multicolor display units 200 is received in a separate casing 106. The casing 106 has a back panel 31 to which a lever 62 is attached. The lever 62 is fixed to a support frame 63 with screws 64. The support frame 63 is fixed to a support frame 65.

Figure 64:
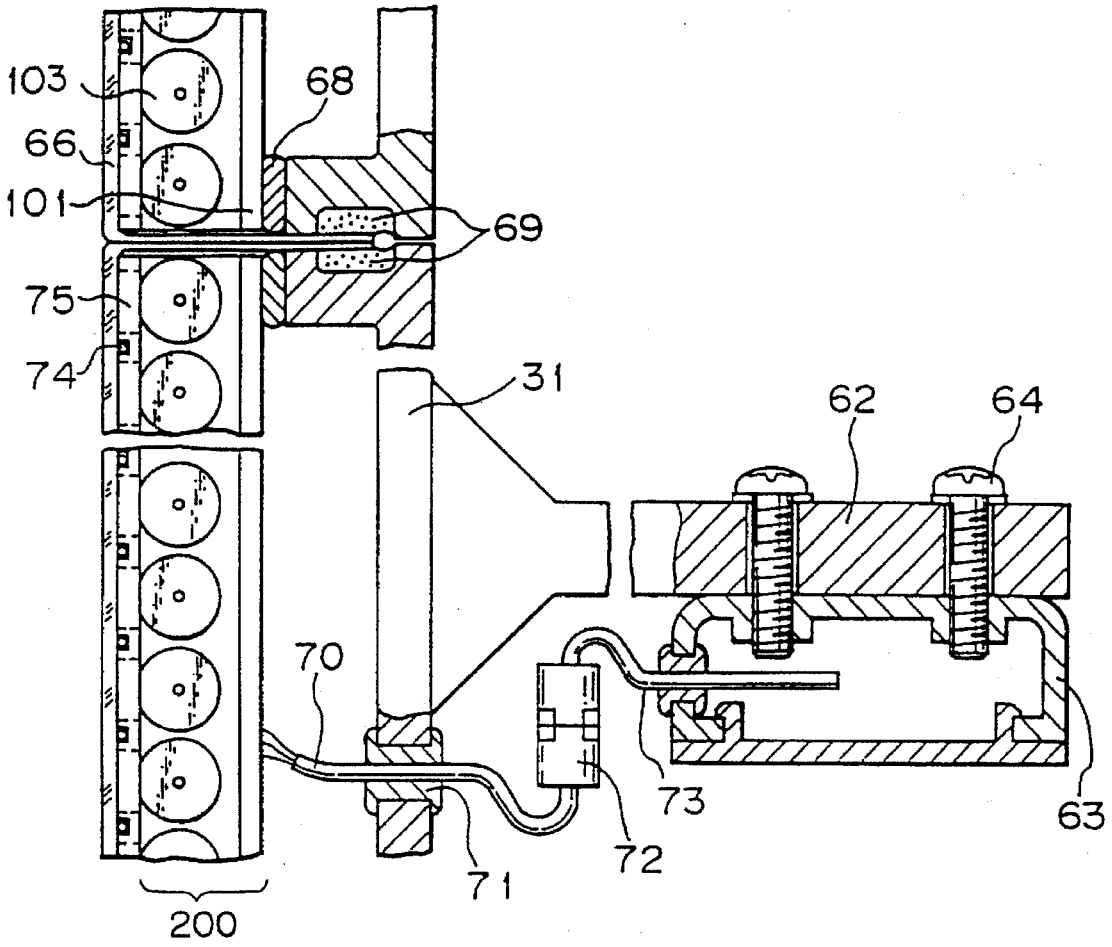
FIG. 64 is a sectional view showing multicolor display units disposed inside the casings of FIG. 63.

FIG. 64 is a sectional view showing the casing 106 of FIG. 63. An outer frame 66 has a box-like shape having an integrally formed windshield portion and side face portions. The outer frame 66 must bear load and shocks when assembled, so that the windshield face may have a thickness of, for example, one millimeter. Since each side face of the outer frame 66 forms a joint with respect to the adjacent casing 106 and influences a screen appearance, it must be thin, for example, 0.2 millimeters. The windshield portion of the outer frame 66 has a coarse outer face to prevent reflection, and an ultraviolet ray filter is disposed over the inner face of the windshield portion. A mask 75 and the multicolor display unit 200 are received in the outer frame 66, and the back panel 31 is fitted to the outer frame 66 through a packing 68 and sealed with a sealing agent 69. This completes a dustproof and waterproof structure.

The mother board 101 of the multicolor display unit 200 has an electric cable 70, which is passed through a waterproof ring 71 on the back panel 31 and connected to an external power source/signal cable 73 through a waterproof connector 72. The cable 73 is passed through the support frame 63 to which the lever 62 of the casing 106 is fixed, and connected to a power source circuit (not shown), control circuit (not shown), etc.

Heater wires are arranged over the inner face of the windshield portion of the outer frame 66 or over the mask 75. In FIG. 64, the heater wires 74 are disposed in recesses formed on the mask 75. If the mask is thin, the recesses are not needed. The heater wires 74 are connected to a power source through leads (not shown). Similar to the previous embodiment, the mask itself may be made of a heating material.

Figure 65A:
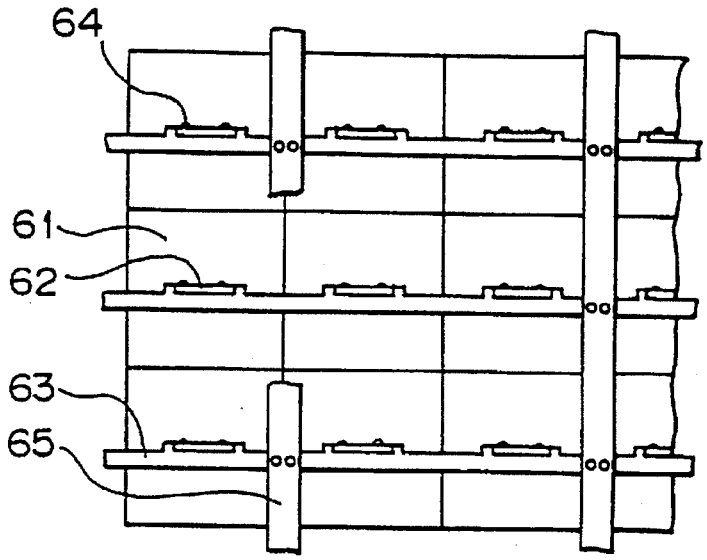
FIG. 65A is a back view showing the casings of FIG. 63 arranged in a matrix on the support frame.
Figure 65B:
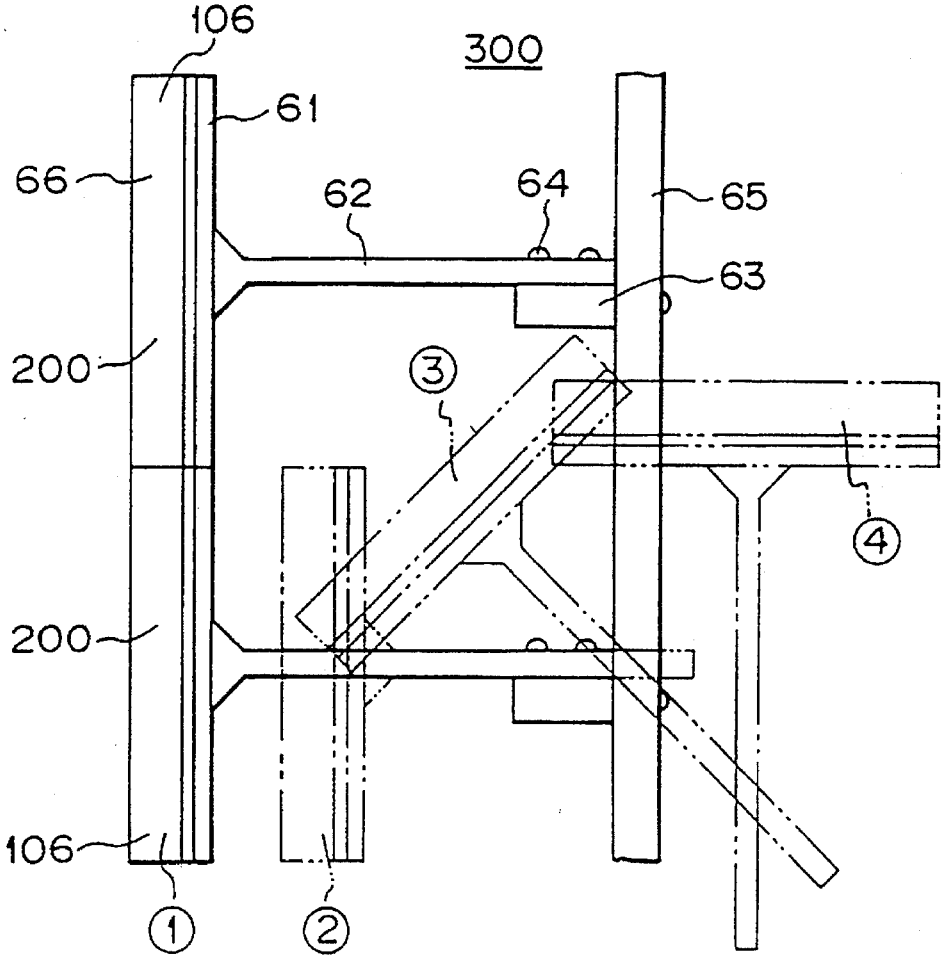
FIG. 65B is a view showing detaching and attaching procedures of the casing of FIG. 65.

FIG. 65(A) is a back view showing support frames 63 and 65 forming a lattice structure. Many multicolor display units each separately enclosed in a casing are arranged in a matrix and fixed to the support frame 63 with screws 64. The support frames 63 are arranged at intervals of the width of one casing, while the support frames 65 are disposed at intervals of the width of two casings. With this arrangement, each of the multicolor display units 200 enclosed in the casing 106 can be removed and installed from the back as indicated by (1), (2), (3), and (4) in FIG. 65(B). This arrangement simplifies the erection and replacement of the multicolor display apparatus 300 to and from a high place such as the top of a building.

As explained above, the invention installs a multicolor display apparatus in a dustproof and water proof casing, so that the apparatus achieves high reliability and durability, even if it is arranged outdoors. The windshield surface of the apparatus prevents reflection, and heater wires thereof prevent freezing. The apparatus of the invention is easy to install and maintain.

In the above embodiments, each multicolor display element involves a cylindrical or cuboid rotary member having a plurality of color regions (P1, P2, P3, P4). According to the invention, the shape of the rotary member of the multicolor display element is not limited by these examples. For example, the shape may be polyhedral.

When the rotary member has a cuboid shape, this shape may prevent integration of the multicolor display elements or an increase in the number of displayed colors greater than four.

Polyhedral rotary members having triangular, pentagonal, and hexagonal cross sections according to the invention will be explained.

Figure 66:
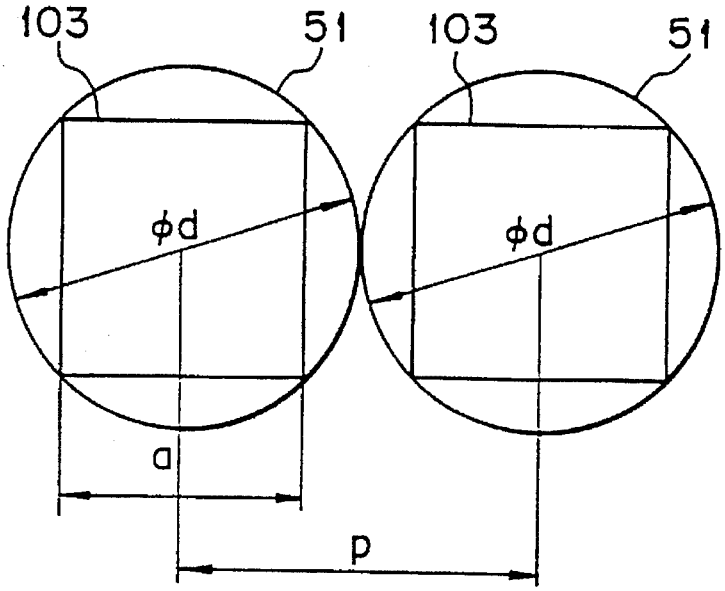
FIG. 66 is a view showing an arrangement of cubic rotary members.

FIG. 66 shows multicolor display elements 103 disposed side by side. Each of the elements 103 is cuboid. These elements 103 must be turned without interfering with each other. For this purpose, a distance p between the elements 103 must be greater than a diameter d of a circumscribed circle 51 of the multicolor display elements 103. This means that the length "a" of a side of a color region of the multicolor display elements 103 is smaller than 0.707 p.

When many multicolor display elements are arranged in a matrix on a multicolor display apparatus, an aperture factor of the apparatus is defined as a ratio of an effective display area to a total display area. The larger the aperture factor, the clearer an image is displayed on the apparatus. It will be desirable to increase the aperture factor of the multicolor display apparatus.

To display colorful images with the multicolor display apparatus having many multicolor display elements arranged in a matrix, each of the multicolor display elements must have many colors to be switched from one to another. Four colors for each of the multicolor display elements, therefore, are sometimes insufficient.

On the other hand, if the display apparatus is required to display only red or blue characters on a white background, each of the multicolor display elements may have only three colors, i.e., red, blue, and white. In this case, the multicolor display apparatus according to the invention employs multicolor display members each having a triangle pipe shape. When a distance between adjacent two multicolor display members is p, the length of each side of a color region of the multicolor display member will be expanded to 0.866 p.

Figure 67:
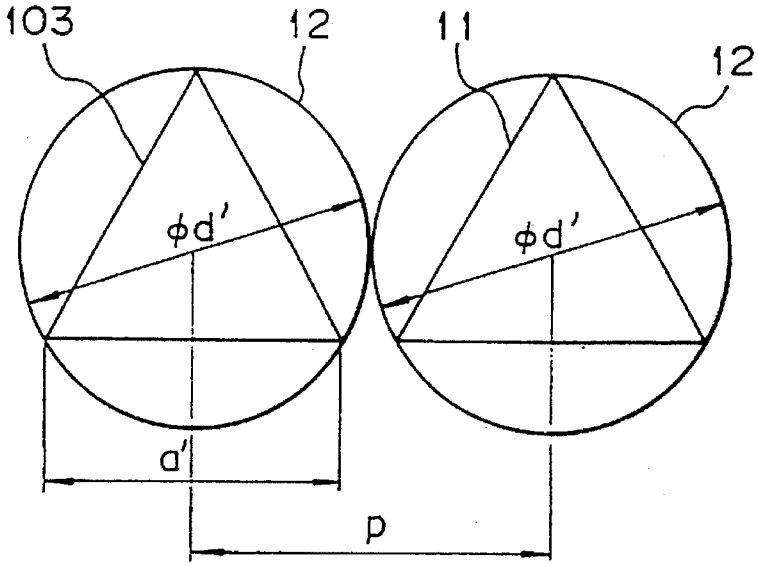
FIG. 67 is a plan view showing an arrangement of triangular rotary members according to the invention.

FIG. 67 is a side view showing an embodiment of the invention. In the figure, multicolor display elements 103 each having a rotary member are disposed side by side. Each multicolor display elements 103 has an equilateral triangle pipe shape. To let the multicolor display elements 103 turn freely, a distance p between the adjacent multicolor display elements 103 must be equal to or larger than a diameter d' of a circumscribed circle 12 of the triangle. This means that the length a' of a color region of the multicolor display elements 103 is 0.866 p. Compared with 0.707 p of the cuboid shape, the equilateral triangle pipe of the invention can increase the length of each side of the color region by 22%.

To correctly position the triangle rotary member painted in three colors of the multicolor display element, a rotor of a motor of the rotary member must be driven one-third turn at a time. For this purpose, the motor must have three magnetic cores, three coils and three stators equidistantly arranged around the rotor.

Figure 68A:
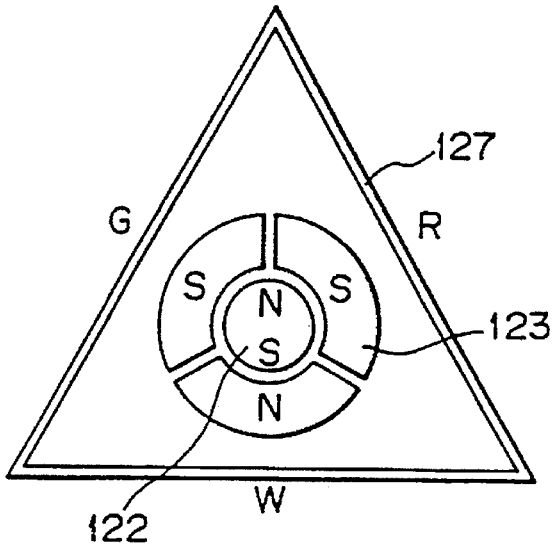
FIGS. 68(A) to 68(C) are views showing operations of the rotary member of FIG. 67.
Figure 68B:
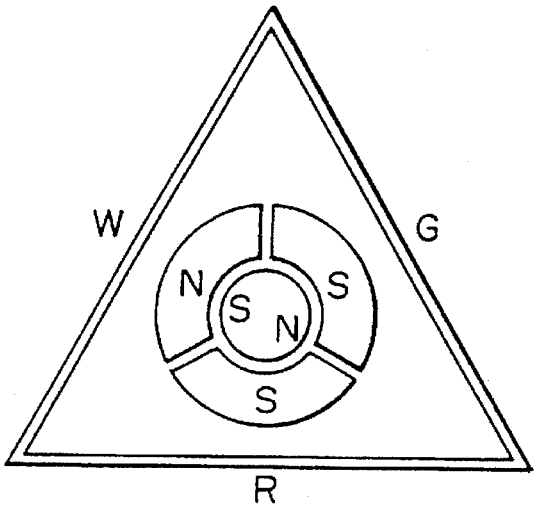
Figure 68C:
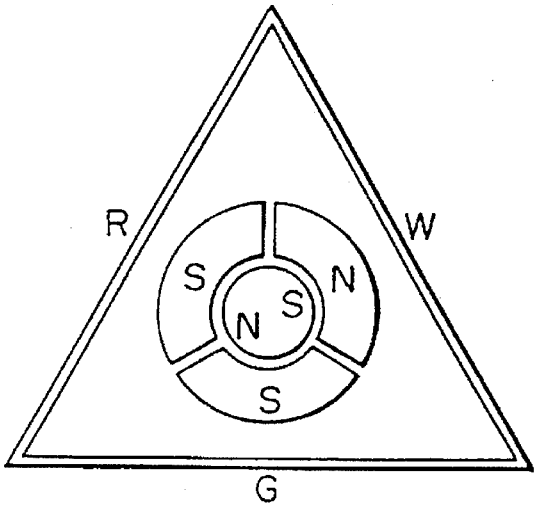

FIGS. 68(A) to 68(C) show the arrangement of such a multicolor display element. When the coils wound around the magnetic cores are driven to polarize the stators 123 as shown in FIG. 68(A), one magnetic pole of a magnet 122 of the rotor is attracted by the center of one of the stators 123, while the other magnetic pole of the magnet 122 is attracted by a gap between adjacent stators. Accordingly, the rotor may take three positions to display one of the three colors of the multicolor display element 103. In this way, the colors on the color regions are switched from one to another by controlling the magnetization of the stators 123.

This embodiment increases the aperture factor of the multicolor display apparatus 300, thereby clearly displaying images, improving visibility, and effectively transmitting information.

The multicolor display apparatus according to the invention employs, for example, additive primary colors, i.e., red, green, and blue. Accordingly, various combinations of these colors may provide a variety of colors when seen from a distance. Actually, however, required colors are not always correctly attained because of a lack of brightness. For example, if the red, green, and blue are uniformly mixed, the mixture theoretically provides white. In practice, however, it provides a blackish color due to a lack of brightness. Accordingly, it is usual to employ multicolor display elements each having four color regions painted in the three primary colors plus white. This technique may provide white but not black. Another difficult color is yellow. Yellow is theoretically a mixture of red and green, but actually achieved with very low brightness. Accordingly, the triangle rotary member has a limitation in reproducing a variety of colors.

As repeatedly explained, many multicolor display elements are arranged to form a multicolor display unit, and many multicolor display units are arranged to make a multicolor display apparatus. When each of the multicolor display elements has a cuboid shape with four color regions painted in red, green, blue, and white, it is sometimes insufficient to provide effective colors. Namely, each of the multicolor display elements is sometimes required to have more color regions.

To meet such a requirement, the invention provides a multicolor display element having color regions painted in, for example, five colors of red, green, blue, white, and black, or six colors with yellow added to the five colors. To correctly display these colors, a motor of the multicolor display element is designed to turn at intervals of one-fifth or one-sixth turn. This sort of multicolor display element can clearly display black, yellow, etc., which are difficult for the conventional display apparatus to display.

Figure 69:
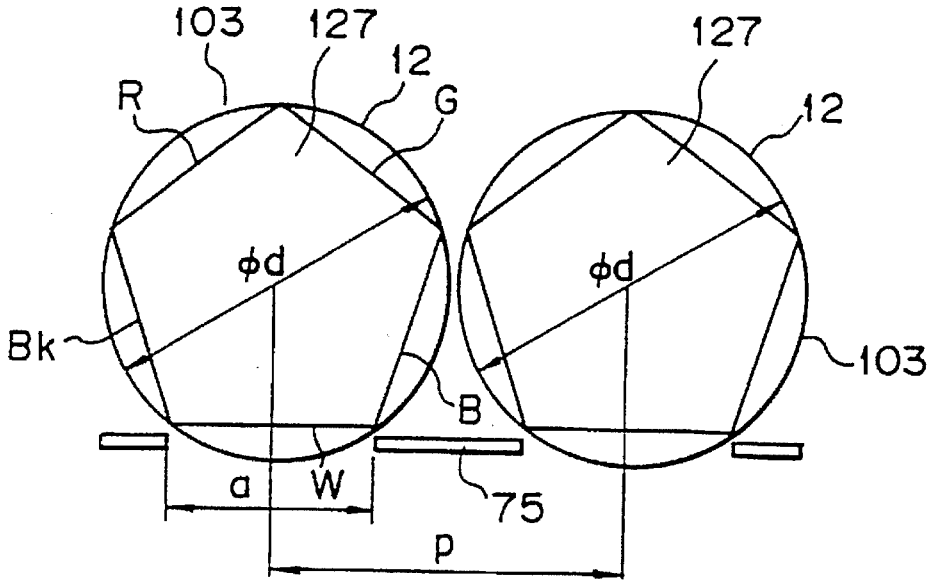
FIG. 69 is a side view showing an arrangement of pentagonal rotary members according to the invention.

FIG. 69 is a side view showing an embodiment of the invention. Multicolor display members 103 have each a rotary member 127 of a regular pentagonal pipe shape. The rotary member 127 has color regions painted in red (R), green (G), blue (B), white (W), and black (Bk). This display element 103 can display black, which is not obtainable by mixing colors. A mask 75 covers all color regions except the front one.

To freely turn the rotary members 127, a distance p between the adjacent multicolor display element 103 must be equal to or larger than a diameter d of a circumscribed circle 12 of the pentagonal pipe. This means that the length "a" of each side of the color region is substantially 0.588 p. This figure is an upper limit of an aperture factor, i.e., a ratio of an effective display area to a total display area.

Figure 70:
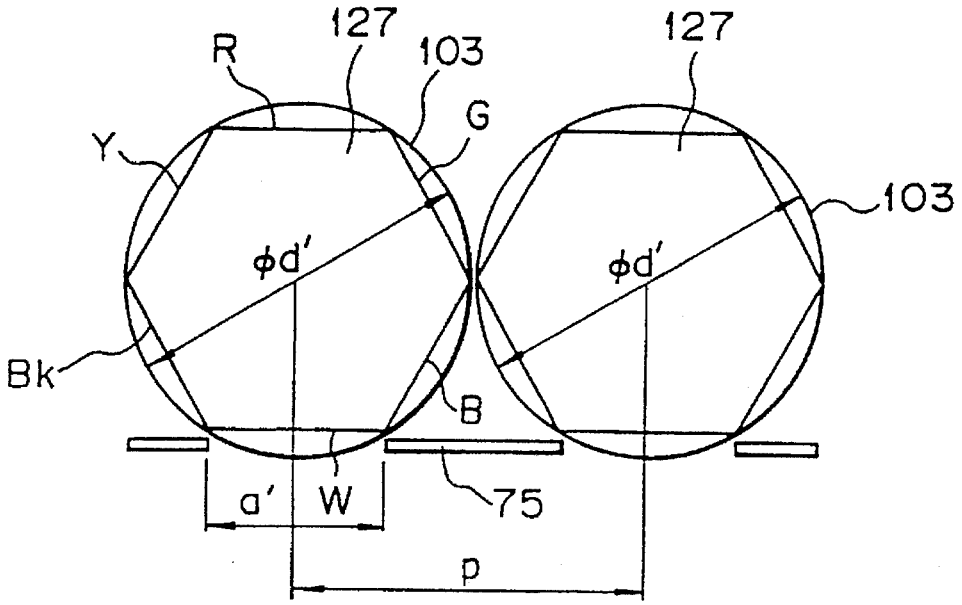
FIG. 70 is a side view showing an arrangement of hexagonal rotary members according to the invention.
Figure 71A:
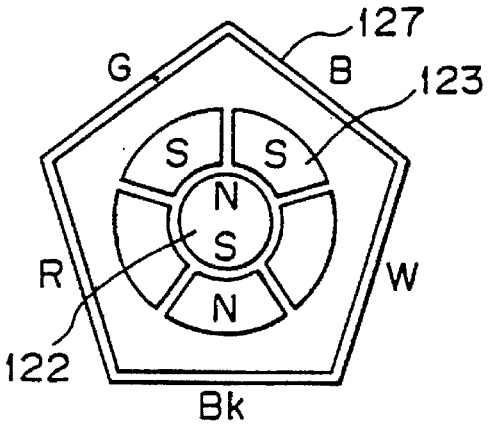
FIGS. 71(A) to 71(E) are views showing operations of the rotary member of FIG. 69.
Figure 71B:
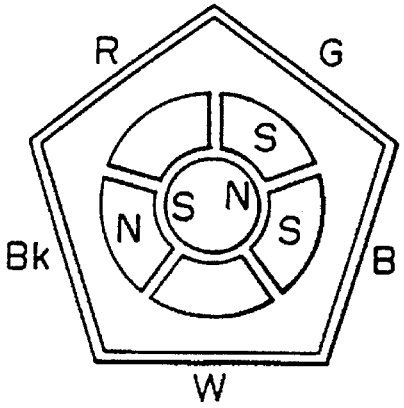
Figure 71C:
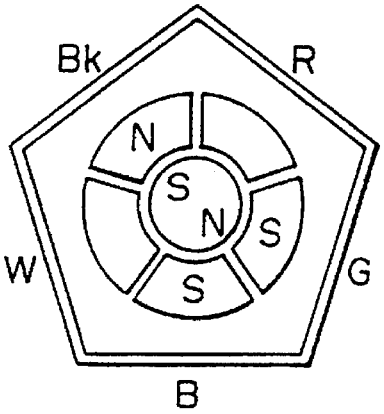
Figure 71D:
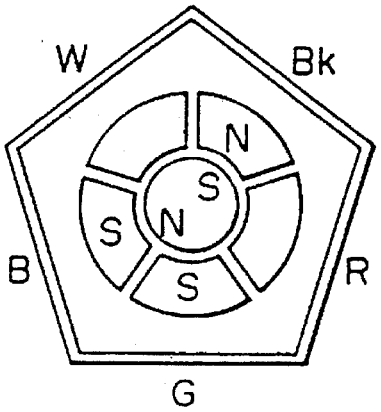
Figure 71E:
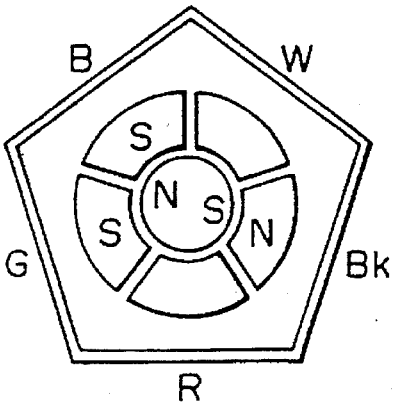
Figure 72A:
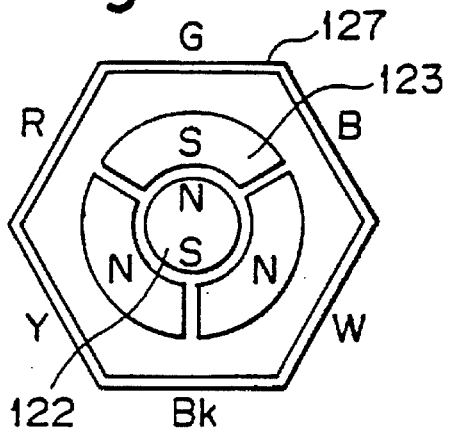
FIGS. 72(A) to 72(F) are views showing operations of the rotary member of FIG. 70.
Figure 72B:
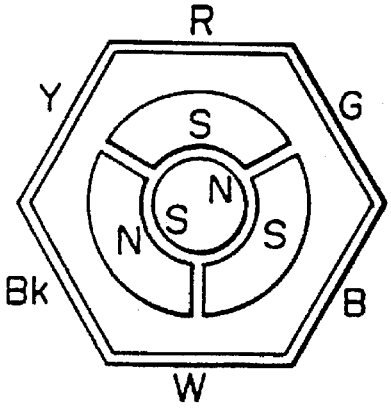
Figure 72C:
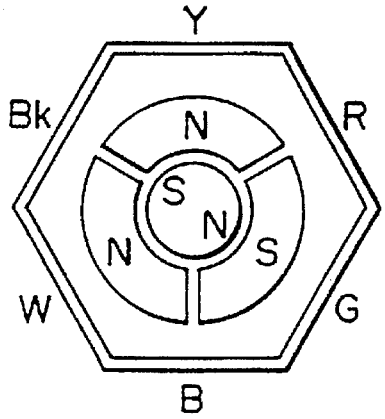
Figure 72D:
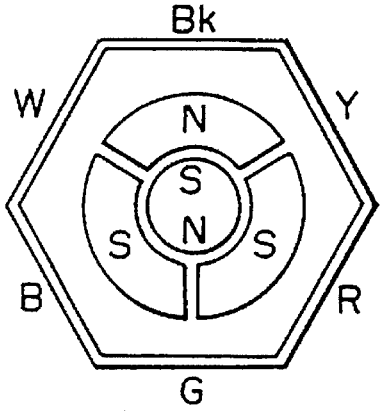
Figure 72E:
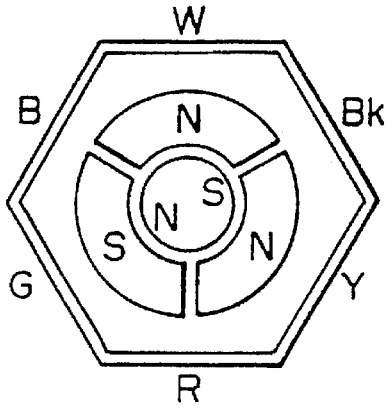
Figure 72F:
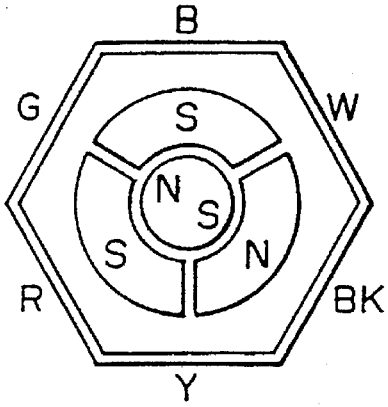

FIG. 70 is a side view showing another embodiment of the invention. Multicolor display members 103 are arranged adjacent to each other. Each of the multicolor display elements 103 has a rotary member 127 of regular hexagonal pipe shape. The rotary member 127 has color regions painted in red (R), green (G), blue (B), white (W), black (Bk), and yellow (Y). Accordingly, this multicolor display member can clearly display black and yellow. A mask 75 covers the color regions except the front one.

With a distance p between the adjacent multicolor display members 103 and a diameter d' of a circumscribed circle 22, the distance a' of a side of each color region is 0.5 p, which will be an upper limit of an aperture factor.

For the multicolor display element 103 employing the rotary member 127 of pentagonal or hexagonal pipe shape, a rotor of a motor must turn at intervals of one-fifth or one-sixth turn.

FIGS. 71(A) to 71(E) show a motor for such a pentagonal rotary member 127. The motor comprises five magnetic cores, coils, and stators equidistantly arranged around a rotor. The coils wound around the magnetic cores are driven to polarize the stators 123 as shown in the figures. As a result, one magnetic pole of a magnet 122 of the rotor is attracted by the center of one of the stators 123, and the other magnetic pole thereof is attracted by a magnetic field at a gap between ones of the adjacent stators 123. Accordingly, the rotor can be positioned at an optional one of the five locations, to display one of the optional five color regions of the rotary member 127.

FIGS. 72(A) to 72(F) show a motor for the hexagonal rotary member. The motor comprises a rotor and three magnetic cores, coils, and stators disposed around the rotor. The numbers of the magnetic cores, coils, and stators may each be six instead of three. The coils wound around the magnetic cores are driven to polarize the stators 123 as shown in the figures. One magnetic pole of a magnet 122 of the rotor is attracted by the center of one of the stators 123, and the other magnetic pole of the magnet 122 is attracted by a gap between adjacent stators. Accordingly, the rotor is positioned at one of six locations, to display an one of the optional six color regions of the rotary member 127.

In this way, the magnetization of the stators 123 is controlled to change displayed colors from one to another. The configuration of the motor is not limited to those explained above. Although the embodiments of FIGS. 69 to 72 employ pentagonal and hexagonal display members, these shapes do not limit the invention. The display members according to the invention may have a cylindrical shape defined by a circumscribed circle of a polyhedral pipe, with five or six axial color regions defined on the periphery of the cylinder and painted in different colors. The five or six colors explained with the embodiments are only examples. Any colors and any combinations of the colors may be selected as required.

These embodiments explained above directly display black, yellow, etc., which are difficult to produce for a conventional additive mixture of three primary colors, i.e., red, green, and blue. The embodiments, therefore, can display clear images with a variety of colors.

According to the invention, a plurality of the multicolor display elements are assembled to form a multicolor display unit 200, and a plurality of the multicolor display units 200 are assembled to form a multicolor display apparatus 300. Namely, each pixel of the apparatus 300 comprises one multicolor display unit 200. In this arrangement, a combination of colors provided by the multicolor display elements is a very important factor in each of the multicolor display units 200, and similarly, a combination of the multicolor display units 200 is a very important factor in the multicolor display apparatus 300.

Examples of large display apparatuses are disclosed in, for example, Japanese Examined Patent Publication Nos. 63-63910 and 63-63911. An example of a multicolor display apparatus is disclosed in Japanese Unexamined Patent Publication No. 3-158374 of this applicant. According to these disclosures, a multicolor display apparatus comprises many display elements arranged in a matrix. Each of the display elements has four color regions painted in, for example, red, green, blue, and white, respectively. These color regions are turned to display a required color, to thereby display color characters and graphics on the display apparatus. The display elements of any of these disclosed display apparatuses use the same combination of colors.

When the display elements use the same combination of colors, it is impossible to display complementary colors of the colors painted on the display elements, with the same brightness, and it is also impossible to display black with respect to white.

These problems will be explained in detail with a simple unit block comprising 4 display elements (2 rows and 2 columns). Each of the display elements is painted in red, green, blue, and white. When the unit block is seen from a distance, the brightness of each color is averaged by its area. If the red, green, and blue have each a brightness of 1 and the white has a brightness of 3, and if the unit block displays one of red, green, and blue, the brightness of the unit block will be $1\times4/4=1$. Similarly, when the unit block displays white, the brightness thereof will be $3\times4/4=3$. In each case, the brightness of the unit block is equal to the brightness of each display element.

To display yellow with this unit block, an additive mixture of red and green is used. Namely, two of the display elements display red, and the other two display green. In this case, the area of each color is halved compared with displaying one of red, green, blue, and white with all of the four display elements. Although the unit block of this color combination provides yellow when seen from a distance, the brightness of red and green is each $1\times2/4=0.5$. As a result, the brightness of the yellow as a result of the additive mixture of red and green is also 0.5. Similarly, magenta and cyan will have a brightness of 0.5.

An actual display apparatus has more display elements to improve color display ability. It is theoretically difficult, however, to achieve the same brightness on a mixed color as that on a single color. As is apparent from the above explanation, the brightness is worsened when two or three of the red, blue, and green are equally mixed. When they are mixed as a replacement of black, there will be no problem. When they are mixed to display cyan, magenta, or yellow, i.e., a complementary color of any one of the red, green, and blue, the brightness worsens.

To solve the problem, the invention employs display elements having different combinations of colors. Namely, a combination of colors employed by some of the display elements is different from a combination of colors employed by others. These different display elements are arranged at a predetermined ratio in a unit block.

Figure 73:
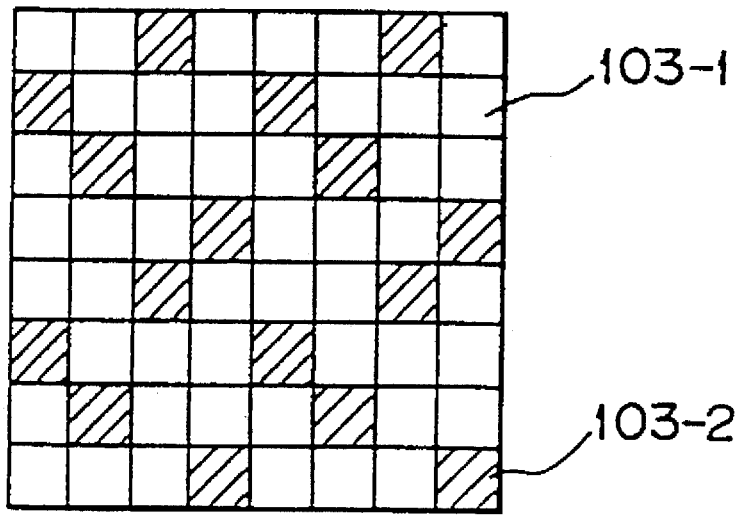
FIG. 73 is a view showing an arrangement of multicolor display elements in a multicolor display unit according to the invention.

FIG. 73 shows a multicolor display unit 200 comprising a plurality of multicolor display elements 103, the unit 200 serving as a unit block in a multicolor display apparatus 300 according to the invention. In the figure, the unit block, i.e., the multicolor display unit 200 comprises 64 multicolor display members arranged in eight rows and eight columns. In the multicolor display unit 200, there are first multicolor display elements 103-1 each having four color regions painted in, for example, red, green, blue, and white, respectively, and second multicolor display elements 103-2 each having four color regions painted in cyan, magenta, yellow, and black, respectively. The first and second multicolor display elements 103-1 and 103-2 are arranged at a ratio of 3:1. The brightness, i.e., the saturation of the first multicolor display elements 103-1 is 1, and that of the second multicolor display elements 103-2 is 2.5.

When any one of the red, green, blue, and white is required, the first multicolor display elements 103-1 directly displays the required color, while the second multicolor display elements 103-2 display black. When yellow is required, a half of the first multicolor display elements 103-1 display red, and the remainder of them display green. At the same time, all of the second multicolor display elements 103-2 display yellow. When seen from a distance, the saturation of the yellow realized by the red and green of the first multicolor display elements 103-1 is 0.5, while that of the yellow directly displayed by the second multicolor display elements is 2.5. Accordingly, the saturation per unit area will be $(0.5\times3+2.5)/4=1$. This saturation is the same as that achieved when one of the red, green, blue, and white is displayed. The same is true for cyan and magenta.

Colors other than the above may freely be displayed by changing combinations of colors. It is also possible to change the kinds of colors, ratio of saturation, and numbers of the first and second multicolor display elements 103-1 and 103-2 in a unit block, to achieve a variety of color expressions.

According to the invention, a multicolor display apparatus may employ combinations of various kinds of . multicolor display units (200-1, 200-2, 200-3, . . . ) each involving different numbers of the first and second multicolor display elements. This realizes a variety of multicolor display apparatuses that may be selected according to requirements.

As explained above, the multicolor display apparatus according to the invention realizes a variety of color expressions compared with a multicolor display apparatus employing a single kind of multicolor display members.

We claim:

1. A method for driving a multicolor display element having a rotary member with a plurality of separate display regions of different colors, for displaying one of the colors at a time, the rotary member having a shaft to which the rotary member is fixedly mounted, a support member for rotatably supporting the shaft, drive means coupled to the support member for rotating the rotary member, the drive means including a permanent circular magnet, having a circular peripheral side surface, fixed to the shaft to rotate with the rotary member, a plurality of stators coupled to the support member, and arranged close to and around the circular peripheral side surface of the permanent circular magnet so as to substantially surround the circular peripheral side surface thereof, each one of said plurality of stators having an arcuate inner side surface which is provided on a portion of each said stator opposite said circular peripheral side surface of said magnet, said arcuate inner side surface having a uniform radius from the center of said magnet, said plurality of stators being mutually arranged in an identical plane with a first clearance formed between said circular peripheral side surface of said magnet and said arcuate inner side surface of each said respective stator, said first clearance being uniform along the overall peripheral side surface of said magnet, each of the plurality of stators including a magnetizable core with a magnetizing coil wound thereon, the method, comprising:

applying to said magnetizing coils a driving waveform corresponding to an acceleration pulse, selectively polarizing the cores in response to the magnetization of the goils by the acceleration pulse to cause the rotary member to rotate to display a selected display region, applying to said magnetizing coils a driving waveform corresponding to a braking pulse, and selectively polarizing the cores in response to the magnetization of the coils by the braking pulse to stop the rotation of the rotary member at the selected display region.

2. A method for driving a multicolor display element according to claim 1, comprising:

interposing a low or non-driving pulse at an intermediate position between said acceleration and said braking pulses.

3. A method for driving a multicolor display element having a rotary member with a plurality of separate display regions of different colors for displaying one of the colors at a time, the rotary member having a shaft to which the rotary member is fixedly mounted, a support member for rotatably supporting the shaft, drive means coupled to the support member for rotating the rotary member, the drive means including, a permanent circular magnet, having a circular peripheral side surface, fixed to the shaft to rotate with the rotary member, a plurality of stators coupled to the support members and arranged close to and around the circular peripheral side surface of the permanent circular magnet so as to substantially surround the circular peripheral side surface thereof, each one of said plurality of stators having an arcuate inner side surface which is provided on a portion of each said stator opposite said circular peripheral side surface of said magnet, said arcuate inner side surface having a uniform radius from the center of said magnet, said plurality of stators being mutually arranged in an identical plane with a first clearance formed between said circular peripheral side surface of said magnet and said arcuate inner side surface of each said respective stator, said first clearance being uniform along the overall peripheral side surface of said magnet, each of the plurality of stators Including a magnetizable core with a magnetizing coil wound thereon, said method comprising:

applying a driving waveform having a first phase or a first amplitude to one set of the magnetizing coils of a display element, applying a driving waveform having a second phase delayed from the first phase or a second amplitude smaller than the first amplitude to another set of the magnetizing coils of said display element, and selectively polarizing the cores in response to the magnetization of the coils by the first and second phase waveforms or by the first and second amplitude waveforms to restrict the direction of rotation of the magnet to one direction at times when the magnet is turned 180 degrees to display a selected display region.

4. A method for driving a multicolor display element which comprises;

a rotary member having a plurality of separate display regions of different colors, for displaying one of the colors at a time, the rotary member having a shaft to which the rotary member is fixedly mounted, a support member for rotatably supporting the shaft, drive means coupled to the support member for rotating the rotary member, the drive means including, a permanent circular magnet having a circular peripheral side surface fixed to the shaft to rotate with the rotary member, a plurality of stators coupled to the support member, and arranged close to and around the circular peripheral side surface of the permanent circular magnet so as to substantially surround the circular peripheral side surface thereof, each one of said plurality of stators having an arcuate inner side surface which is provided on a portion of each said stator opposite said circular peripheral side surface of said magnet, said arcuate inner side surface having a uniform radius from the center of said magnet,said plurality of stators being mutually arranged in an identical plane with a first clearance formed between said circular peripheral side surface of said magnet and said arcuate inner side surface of each said respective stator, said first clearance being uniform along the overall peripheral side surface of said magnet, each of the plurality of stators including a magnetizable core with a magnetizing coil wound thereon; the method comprising:

applying to said magnetizing coils a driving waveform corresponding to the first 90 degree turn and a second driving waveform corresponding to a second 90 degree turn to polarize the coils to cause the rotary member to rotate 180 degrees to display a selected display region.

5. A method for driving a multicolor display element having a rotary member having a plurality of separate display regions of different colors for displaying one of the colors at a time, the rotary member having a shaft to which the rotary member is fixedly mounted, a support member for rotatably supporting the shaft, drive means coupled to the support member for rotating the rotary member, the drive means including a permanent circular magnet, having a circular peripheral side surface, fixed to the shaft to rotate with the rotary member, a plurality of stators coupled to the support member and arranged close to and around the circular peripheral side surface of the permanent circular magnet so as to substantially surround the circular peripheral side surface thereof, each one of said plurality of stators having an arcuate inner side surface which is provided on a portion of each said stator opposite said circular peripheral side surface of said magnet, said arcuate inner side surface having a uniform radius from the center of said magnet, said plurality of stators being mutually arranged in an identical plane with a first clearance formed between said circular peripheral side surface of said magnet and said arcuate inner side surface of each said respective stator, said first clearance being uniform along the overall peripheral side surface of said magnet, each of the plurality of stators including a magnetizable core with either a magnetizing coil or a pair of a magnetizing coil and a detection coil wound thereon; said method comprising:

applying to the magnetizing coils of the plurality of stators a driving waveform to selectively polarize the cores to rotate the magnet causing the rotary member to display a selected region;

detecting a voltage induced by a magnetic field change in the magnetizing or detection coils in response to rotation of the magnet;

amplifying and applying the detected induced voltage as a braking pulse to the magnetizing coils to limit rotation of the rotary member.

6. A method for driving a multicolor display element which comprises;

a rotary member having a plurality of separate display regions of different colors, for displaying one of the colors at a time, the rotary member having a shaft to which the rotary member is fixedly mounted;

a support member for rotatably supporting the shaft;

drive means coupled to the support member for rotating the rotary member, the drive means including a permanent circular magnet, having a circular peripheral side surface, fixed to the shaft to rotate with the rotary member, a plurality of stators coupled to the support member, and arranged close to and around the circular peripheral side surface of the permanent circular magnet so as to substantially surround the circular peripheral side surface thereof, each one of said plurality of stators having an arcuate inner side surface which is provided on a portion of each said stator opposite said circular peripheral side surface of said magnet, said arcuate inner side surface having a uniform radius from the center of said magnet, said plurality of stators being mutually arranged in an identical plane with a first clearance formed between said circular peripheral side surface of said magnet and said arcuate inner side surface of each said respective stator, said first clearance being uniform along the overall peripheral side surface of said magnet, each of the plurality of stators including a magnetizable core with either a magnetizing coil or a pair of a magnetizing coil and a detection coil wound thereon; said method comprising:

applying to the magnetizing coils of the plurality of stators a driving waveform to selectively polarize the cores to rotate the magnet causing the rotary member to display a selected region;

detecting a voltage induced by a magnetic field change in the magnetizing or detection coils in response to rotation of the magnet to detect erroneous operation of the motor; and repeating the application of the driving waveform in response to the said erroneous detection.

7. A method for driving a multicolor display element according to claim 1, wherein the driving waveform applied to the coils further comprises, a deceleration pulse.

8. A method of driving a multicolor display element according to claim 7, wherein at least either the acceleration pulse or the deceleration pulse comprises a plurality of pulses.

* * * * *

UNITED STATES PATENT AND TRADEMARK OFFICE

CERTIFICATE OF CORRECTION

PATENT NO. : 5,627,563

DATED : May 6, 1997

INVENTOR(S) : Tadahiko NAKAGIRI

It is certified that error appears in the above-indentified patent and that said Letters Patent is hereby corrected as shown below:

Title page, item [75], line 2 under "Inventors:", "Tokyo;" should read --Tokyo, Japan--;

lines 2-3, delete "Mitsuhiro Okamoto, Sayama, all of Japan".

Claim 1, column 39, lines 29-30, "the method, comprising:" should read --the method comprising:--;

line 34, "goils" should read --coils--.

Claim 3, column 40, line 7, "Including" should read --including--.

UNITED STATES PATENT AND TRADEMARK OFFICE

CERTIFICATE OF CORRECTION

PATENT NO. : 5,627,563

DATED : May 6, 1997

INVENTOR(S) : Tadahiko Nakagiri

It is certified that error appears in the above-indentified patent and that said Letters Patent is hereby corrected as shown below:

Claim 7, column 42, line 36, "comprises, a" should read --comprises a--.

Signed and Sealed this

Twenty-third Day of September, 1997

*Attest:*

Bruce Lehman

BRUCE LEHMAN

*Attesting Officer*

*Commissioner of Patents and Trademarks*